US011002099B2

(12) United States Patent
Clausen et al.

(10) Patent No.: US 11,002,099 B2
(45) Date of Patent: May 11, 2021

(54) VALVES FOR ACTUATING DOWNHOLE SHOCK TOOLS IN CONNECTION WITH CONCENTRIC DRIVE SYSTEMS

(71) Applicant: National Oilwell DHT, L.P., Conroe, TX (US)

(72) Inventors: Jeffery Ronald Clausen, Tulsa, OK (US); Nicholas Ryan Marchand, Edmonton (CA); Sean Matthew Donald, Spring, TX (US)

(73) Assignee: NATIONAL OILWELL DHT, L.P., Conroe, TX (US)

( * ) Notice: Subject to any disclaimer, the term of this patent is extended or adjusted under 35 U.S.C. 154(b) by 0 days.

(21) Appl. No.: 16/497,862

(22) PCT Filed: Mar. 28, 2018

(86) PCT No.: PCT/US2018/024847
§ 371 (c)(1),
(2) Date: Sep. 26, 2019

(87) PCT Pub. No.: WO2018/183499
PCT Pub. Date: Oct. 4, 2018

(65) Prior Publication Data

US 2020/0024924 A1 Jan. 23, 2020

Related U.S. Application Data

(60) Provisional application No. 62/607,900, filed on Dec. 19, 2017, provisional application No. 62/532,802, (Continued)

(51) Int. Cl.
*E21B 31/00* (2006.01)
*E21B 34/10* (2006.01)

(52) U.S. Cl.
CPC ..... *E21B 31/005* (2013.01); *E21B 34/10* (2013.01)

(58) Field of Classification Search
CPC ..... E21B 31/005
(Continued)

(56) References Cited

U.S. PATENT DOCUMENTS 4,323,991 A 4/1982 Holmes et al.
6,219,301 B1 4/2001 Moriarty
(Continued)

FOREIGN PATENT DOCUMENTS

CN 104373043 A 2/2015
CN 106014316 A 10/2016
(Continued)

OTHER PUBLICATIONS

PCT/US2018/024847 International Search Report and Written Opinion dated Jun. 11, 2018 (17 p.).
(Continued)

*Primary Examiner* — Taras P Bemko
(74) *Attorney, Agent, or Firm* — Conley Rose, P.C.

(57) ABSTRACT

A system for generating pressure pulses in drilling fluid includes a concentric drive power section. The power section includes a stator and a rotor rotatably disposed in the stator. The rotor is coaxially aligned with the stator. The system also includes a valve. The valve includes a first valve member coupled to the stator and a second valve member coupled to the rotor. The second valve member is configured to rotate with the rotor relative to the first valve member and the stator. The rotation of the second valve member relative to the first valve member is configured to generate pressure pulses in drilling fluid flowing through the concentric drive power section.

47 Claims, 27 Drawing Sheets

Related U.S. Application Data filed on Jul. 14, 2017, provisional application No. 62/477,830, filed on Mar. 28, 2017.

(58) Field of Classification Search
USPC ..... 166/374
See application file for complete search history.

(56) References Cited

U.S. PATENT DOCUMENTS

| | | | | |
|---|---|---|---|---|
| 6,439,318 | B1 | 8/2002 | Eddison et al. | |
| 6,976,832 | B1 | 12/2005 | Wheeler et al. | |
| 9,366,100 | B1 | 6/2016 | Baudoin | |
| 9,598,923 | B2 | 3/2017 | Gilleylen et al. | |
| 2006/0243493 | A1* | 11/2006 | El-Rayes | E21B 4/02 175/107 |
| 2015/0075867 | A1 | 3/2015 | Eddison et al. | |
| 2015/0114721 | A1 | 4/2015 | Marchand et al. | |

FOREIGN PATENT DOCUMENTS

| | | | |
|---|---|---|---|
| WO | 97/44565 | A1 | 11/1997 |
| WO | 2013/159153 | A1 | 10/2013 |
| WO | 2017/027960 | A1 | 2/2017 |
| WO | 2017/045082 | A1 | 3/2017 |

OTHER PUBLICATIONS

PCT/US2018/024847 Article 19 Amendments and Response to International Search Report and Written Opinion dated Jun. 11, 2018; Response filed Aug. 10, 2018 (29 p.).

European Search Report dated Oct. 28, 2020, for European Application No. 18778324.6 (9 p.).

* cited by examiner

VALVES FOR ACTUATING DOWNHOLE SHOCK TOOLS IN CONNECTION WITH CONCENTRIC DRIVE SYSTEMS

CROSS-REFERENCE TO RELATED APPLICATIONS

This application is a 35 U.S.C. § 371 national stage application of PCT/US2018/024847 filed Mar. 28, 2018, and entitled "Valves for Actuating Downhole Shock Tools in Connection with Concentric Drive Systems," which claims benefit of U.S. provisional patent application Ser. No. 62/607,900 filed Dec. 19, 2017, and entitled "Valves for Actuating Downhole Shock Tools in Connection with Concentric Drive Systems," which is hereby incorporated herein by reference in its entirety. This application also claims benefit of U.S. provisional patent application Ser. No. 62/532,802 filed Jul. 14, 2017, and entitled "Valves for Actuating Downhole Shock Tools in Connection with Concentric Drive Systems," which is hereby incorporated herein by reference in its entirety. This application claims benefit of U.S. provisional patent application Ser. No. 62/477,830 filed Mar. 28, 2017, and entitled "Agitator Valves for Concentric Drive Systems," which is hereby incorporated herein by reference in its entirety.

STATEMENT REGARDING FEDERALLY SPONSORED RESEARCH OR DEVELOPMENT

Not applicable.

BACKGROUND

The disclosure relates generally to downhole tools. More particularly, the disclosure relates to downhole systems for inducing axial oscillations in drill strings during drilling operations. Still more particularly, the disclosure relates to valves used in connection with concentric drive systems to generate pressure pulses in drilling fluid that actuate shock tools that produce axial oscillations.

Drilling operations are performed to locate and recover hydrocarbons from subterranean reservoirs. Typically, an earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone.

During drilling, the drillstring may rub against the sidewall of the borehole. Frictional engagement of the drillstring and the surrounding formation can reduce the rate of penetration (ROP) of the drill bit, increase the necessary weight-on-bit (WOB), and lead to stick slip. Accordingly, various downhole tools that induce vibration and/or axial reciprocation may be included in the drillstring to reduce friction between the drillstring and the surrounding formation, as well as increase ROP. One such tool is an axial reciprocation tool that includes a valve that generates pressure pulses in drilling fluid and a shock tool that converts the pressure pulses in the drilling fluid into axial reciprocation.

The valve is operated by a downhole power section (rotor and stator assembly), and is usually positioned between the rotor of the power section and a bottom sub. In addition, the valve is typically made of two carbide plates with flow ports (holes or slots) therethrough. One of the plates, referred to as the oscillating valve plate, is connected to and rotates with the rotor of the power section, and the other plate, referred to as a stationary valve plate, is connected to and static relative to the bottom sub. Accordingly, flow exiting the power section passes through the valve and onward through the drill string or bottom hole assembly (BHA) therebelow.

Most conventional power sections include Moineau type mud motors in which the rotor rotates eccentrically within the stator as drilling fluid flows therethrough. The eccentric rotary motion of the rotor causes the alignment between the flow ports of the oscillating valve plate and the stationary valve plate to vary in a cyclical fashion. This, in turn, cyclically varies the flow area through the valve, which causes pressure fluctuations or pulses in the drilling fluid flowing therethrough.

As noted above, the shock tool induces axial oscillations in the drillstring in response to pressure pulses generated by the valve. The shock tool is typically a spring-loaded stroking tool. The pressure pulses act on the pump open area of the shock tool, causing the shock tool to reciprocate axially, which imparts cyclical axial vibrations to the drillstring.

BRIEF SUMMARY OF THE DISCLOSURE

Embodiments of systems for generating pressure pulses in drilling fluid are disclosed herein. In one embodiment, a system comprises a concentric drive power section including a stator and a rotor rotatably disposed in the stator. The rotor is coaxially aligned with the stator. In addition, the system comprises a valve including a first valve member coupled to the stator and a second valve member coupled to the rotor. The second valve member is configured to rotate with the rotor relative to the first valve member and the stator. The rotation of the second valve member relative to the first valve member is configured to generate pressure pulses in drilling fluid flowing through the concentric drive power section.

In another embodiment, a system for generating pressure pulses in drilling fluid comprises a concentric drive power section including a central axis, a stator, and a rotor rotatably disposed in the stator. The rotor and the stator are coaxially aligned with the central axis. The rotor includes a throughbore, a fluid inlet port extending radially from the throughbore to a radially outer surface of the rotor, and a fluid outlet port extending radially from the throughbore to the radially outer surface of the rotor. The fluid inlet port is axially spaced from the fluid outlet port. In addition, the system comprises a valve including an outer housing and a body rotatably disposed in the outer housing. The outer housing is coupled to an upper end of the stator and the body is coupled to an upper end of the rotor. The body has an upper end, a lower end, a throughbore extending axially from the upper end to the lower end, and a port extending radially from the throughbore to a radially outer surface of the body. Further, the system comprises an annulus radially positioned between the outer housing and the body. The body is configured to rotate with the rotor about the central axis relative to the outer housing and the stator. The body has a first rotational position with the annulus and the throughbore in fluid communication through the port and a second rotational position with fluid communication through the port between the annulus and the throughbore blocked.

Embodiments of methods for generating pressure pulses in drilling fluid to operate a downhole shock tool are disclosed herein. In one embodiment, a method comprises (a) flowing drilling fluid down a drillstring to a concentric rotary drive power section. The concentric rotary drive power section includes a rotor rotatably disposed in a stator.

The rotor and the stator are coaxially aligned with a central axis of the concentric rotary drive power section. In addition, the method comprises (b) selectively directing at least a portion of the drilling fluid into an annulus radially positioned between the rotor and the stator to drive the rotation of the rotor about the central axis relative to the stator. Further, the method comprises (c) rotating a first valve member with the rotor relative to a second valve member in response to (b). Still further, the method comprises (d) selectively directing at least a portion of the drilling fluid through a port of the first valve member. Moreover, the method comprises (e) cyclically opening and closing the port of the first valve member with the second valve member to cyclically block the flow of drilling fluid through the port. The method also comprises (f) generating pressure pulses in the drilling fluid during (e).

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings described below. In all Figures, uphole is to the left and downhole is to the right.

FIGS. 36-28 are enlarged cross-sectional view of an embodiment of a top mount radial valve in accordance with the principles described herein coupled to a concentric power section.

DETAILED DESCRIPTION OF THE PREFERRED EMBODIMENTS

Figure 1:
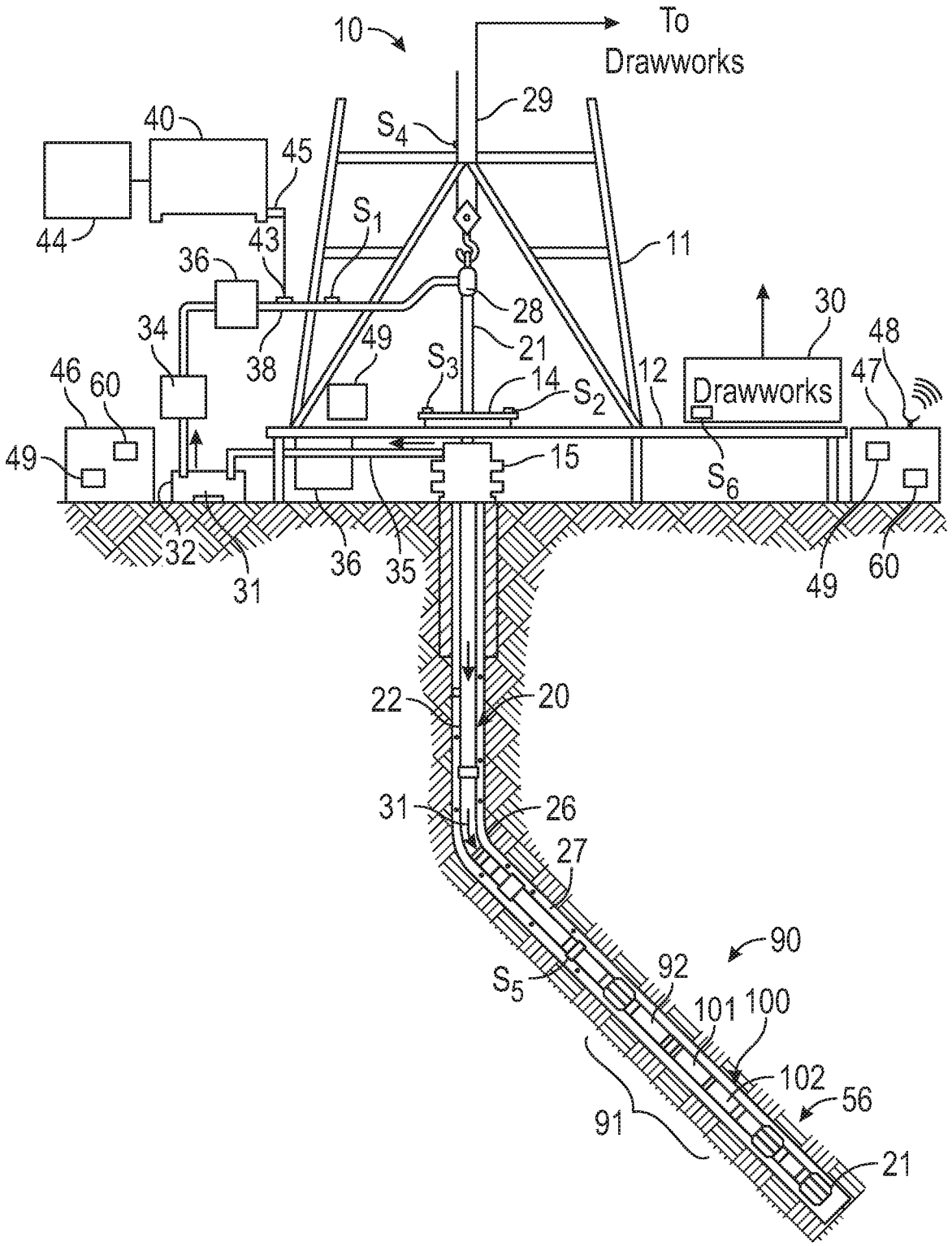
FIG. 1 is a schematic view of a drilling system including an embodiment of an axial reciprocation system in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims will be made for purposes of clarity, with "up", "upper", "upwardly" or "upstream" meaning toward the surface of the borehole and with "down", "lower", "downwardly" or "downstream" meaning toward the terminal end of the borehole, regardless of the borehole orientation.

As described above, the valves used to generate pressure pulses in drilling fluid to actuate downhole shock tools are typically used in connection with Moineau type mud motors. Such motors include a stator having a helical internal bore and a helical rotor rotatably disposed within the stator bore. The inner surface of the stator is typically made of an elastomeric material that provides a surface having some resilience to facilitate the interference fit between the stator and the rotor. Conventional rotors often comprise a steel tube or rod having a helical-shaped outer surface, which may be chrome-plated or coated for wear and corrosion resistance. When the rotor and stator are assembled, the rotor and stator lobes intermesh to form a series of cavities. More specifically, an interference fit between the helical outer surface of the rotor and the helical inner surface of the stator results in a plurality of circumferentially spaced hollow cavities in which fluid can travel. During rotation of the rotor, these hollow cavities advance from one end of the stator towards the other end of the stator. Each cavity is sealed from adjacent cavities by seals formed along contact lines between the rotor and the stator. Pressure differentials across adjacent cavities exert forces on the rotor that causes the rotor to rotate within the stator. The centerline of the rotor is typically offset from the center of the stator so that the rotor rotates within the stator on an eccentric orbit.

The eccentricity of conventional Moineau type mud motors limits the maximum speed, limits the ability to run bearings easily without driveshafts or flexshafts, and limits the ability to employ concentrically rotating assemblies above and below the power section within relatively short lengths. The eccentricity also limits the size of the passage through the rotor also limits and/or prevents fish through capability. Consequently, many conventional pressure pulse generating devices are not run above nuclear source tools due to the inability to run fishing tools to retrieve sources in the event the string being stuck.

Relatively high downhole temperatures can reduce the strength of the stator elastomeric material along the inside of the stator and/or result in excessive thermal expansion of the stator elastomeric material. To avoid premature deterioration or damage to the elastomeric material, the maximum pressure drop across the mud motor is usually reduced. Consequently, the primary limitation in running axial reciprocation tools in relatively high temperature downhole environments is the mud motor.

Due to the eccentric rotation of the rotor and the flow ports in the oscillating valve plate being radially offset from the mud motor centerline, most conventional pressure pulse generating valves for actuating downhole shock tools are operated continuously. In other words, they cannot be selectively actuated. Due to the continuous operation of conventional pressure pulse generating devices, they are typically not positioned directly adjacent measurement-while-drilling (MWD) devices as MWD interference problems can arise. In particular, the pressure pulses being continuously generated can disrupt the proper decoding of mud pulse MWD tools on surface, thereby potentially leading to errors or misinterpretations of surveys. In embodiments described herein that allow for selective actuation, offer the potential for a large percentage of the borehole to be drilled without generating any pressure pulses, and then on an as needed basis (e.g., when the drill string becomes hard to progress in an extended lateral section of the borehole), the pressure pulse generating device can be actuated or turned on. This option may significantly minimize MWD interference issues by allowing surveys to take place during periods of no pressure pulse generation. In this same manner, the size of the pressure pulse being generated towards the end of the borehole would also help to limit damage until the larger effect is needed.

Referring now to FIG. 1, a schematic view of an embodiment of a drilling system 10 is shown. Drilling system 10 includes a derrick 11 having a floor 12 supporting a rotary table 14 and a drilling assembly 90 for drilling a borehole 26 from derrick 11. Rotary table 14 is rotated by a prime mover such as an electric motor (not shown) at a desired rotational speed and controlled by a motor controller (not shown). In other embodiments, the rotary table (e.g., rotary table 14) may be augmented or replaced by a top drive suspended in the derrick (e.g., derrick 11) and connected to the drillstring (e.g., drillstring 20).

Drilling assembly 90 includes a drillstring 20 and a drill bit 21 coupled to the lower end of drillstring 20. Drillstring 20 is made of a plurality of pipe joints 22 connected end-to-end, and extends downward from the rotary table 14 through a pressure control device 15, such as a blowout preventer (BOP), into the borehole 26. Drill bit 21 is rotated with weight-on-bit (WOB) applied to drill the borehole 26 through the earthen formation. Drillstring 20 is coupled to a drawworks 30 via a kelly joint 21, swivel 28, and line 29 through a pulley. During drilling operations, drawworks 30 is operated to control the WOB, which impacts the rate-of-penetration of drill bit 21 through the formation. In addition, drill bit 21 can be rotated from the surface by drillstring 20 via rotary table 14 and/or a top drive, rotated by a power section 100 disposed along drillstring 20 proximal bit 21, or combinations thereof (e.g., rotated by both rotary table 14 via drillstring 20 and power section 100, rotated by a top drive and the power section 100, etc.). For example, rotation via downhole power section 100 may be employed to supplement the rotational power of rotary table 14, if required, and/or to effect changes in the drilling process. In either case, the rate-of-penetration (ROP) of the drill bit 21 into the borehole 26 for a given formation and a drilling assembly largely depends upon the WOB and the rotational speed of bit 21.

During drilling operations a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. The drilling fluid 31 pumped down drillstring 20 flows through power section 100 and is discharged at the borehole bottom through nozzles in face of drill bit 21, circulates to the surface through an annulus 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

While drilling, one or more portions of drillstring 20 may contact and slide along the sidewall of borehole 26. To reduce friction between drillstring 20 and the sidewall of borehole 26, in this embodiment, an axial reciprocation system 91 is provided along drillstring 20 proximal bit 21. Axial reciprocation system 91 includes power section 100 and a shock tool 92 coupled to power section 100. As will be described in more detail below, a valve (not visible in FIG. 1) coupled to power section 100 generates cyclical pressure pulses in the drilling fluid flowing down drillstring 20 through shock tool 92 and power section 100. The pressure pulses cyclically and axially extend and retract shock tool 92. With bit 21 disposed on the hole bottom, the axial extension and retraction of shock tool 92 induces axial reciprocation in the portion of drillstring 22 above power section 100, which reduces friction between drillstring 20 and the sidewall of borehole 26.

In general, shock tool 92 can be any shock tool known in the art that is actuated to reciprocally and axially extend and retract in response to pressure pulses in drilling mud generated by the valve disposed in power section 100. Examples of shock tools that can be used as shock tool 92 are disclosed in U.S. Pat. Nos. 2,240,519 and 3,949,150, each of which is hereby incorporated herein by reference in its entirety.

Figure 2:
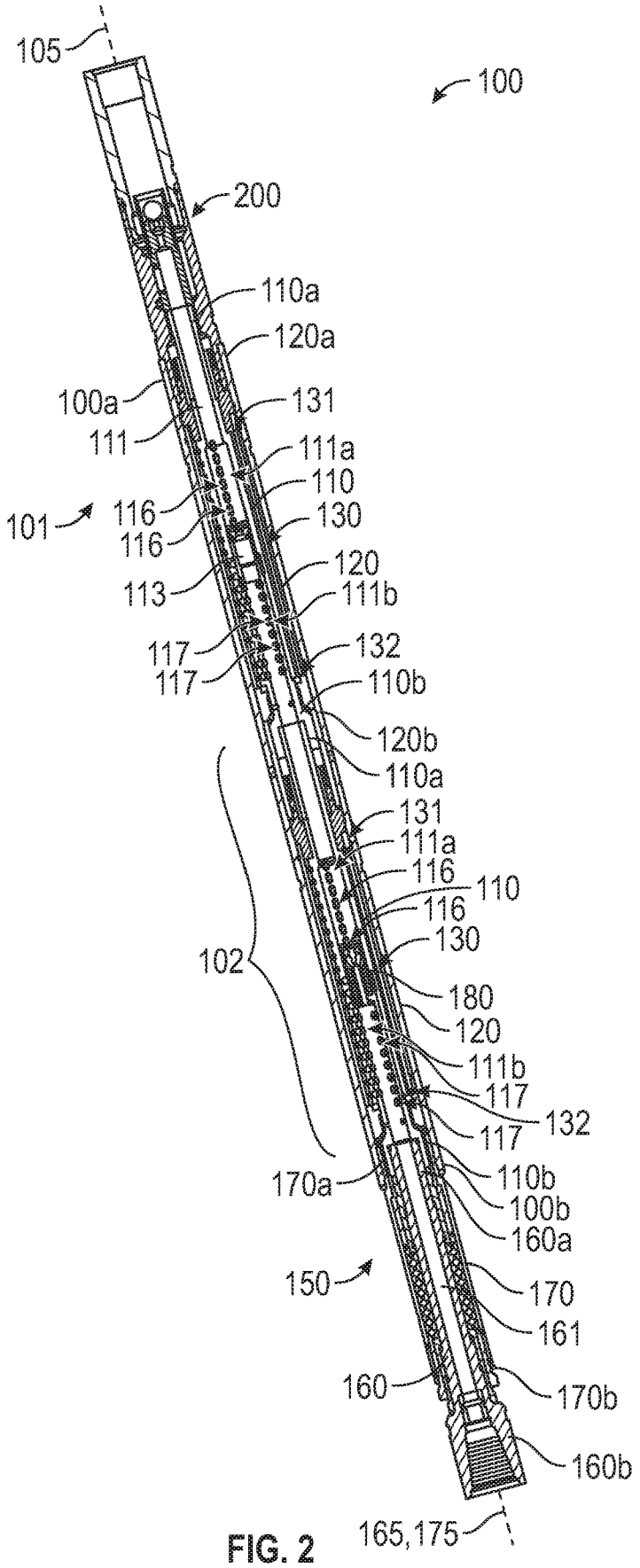
FIG. 2 is a longitudinal cross-sectional view of the concentric power section and top mount radial valve of FIG. 1.

Referring now to FIG. 2, power section 100 is shown. Unlike conventional Moineau type mud motors that include a rotor that rotates eccentrically within a stator, in this embodiment, power section 100 is a concentric rotary drive system. Namely, power section 100 includes an outer stator and a rotor that is coaxially disposed within and rotates concentrically relative to the stator.

Power section 100 has a first or upper end 100*a* coupled to shock tool 92, a second or lower end 100*b* coupled to a bearing assembly 150, and a central or longitudinal axis 105. As shown in FIG. 2, power section 100 includes two stages—a first or upper stage 101 and a second or lower stage 102 coupled to stage 101. Stages 101, 102 are serially arranged and connected end-to-end—first stage 101 extends from upper end 100*a* to second stage 102, and second stage 102 extends from lower end 100*b* to upper stage 101. Although power section 100 includes two stages 101, 102 in this embodiment, in other embodiments, the power section (e.g., power section 100) may include only one stage (e.g., stage 101) or more than two stages.

Figure 3:
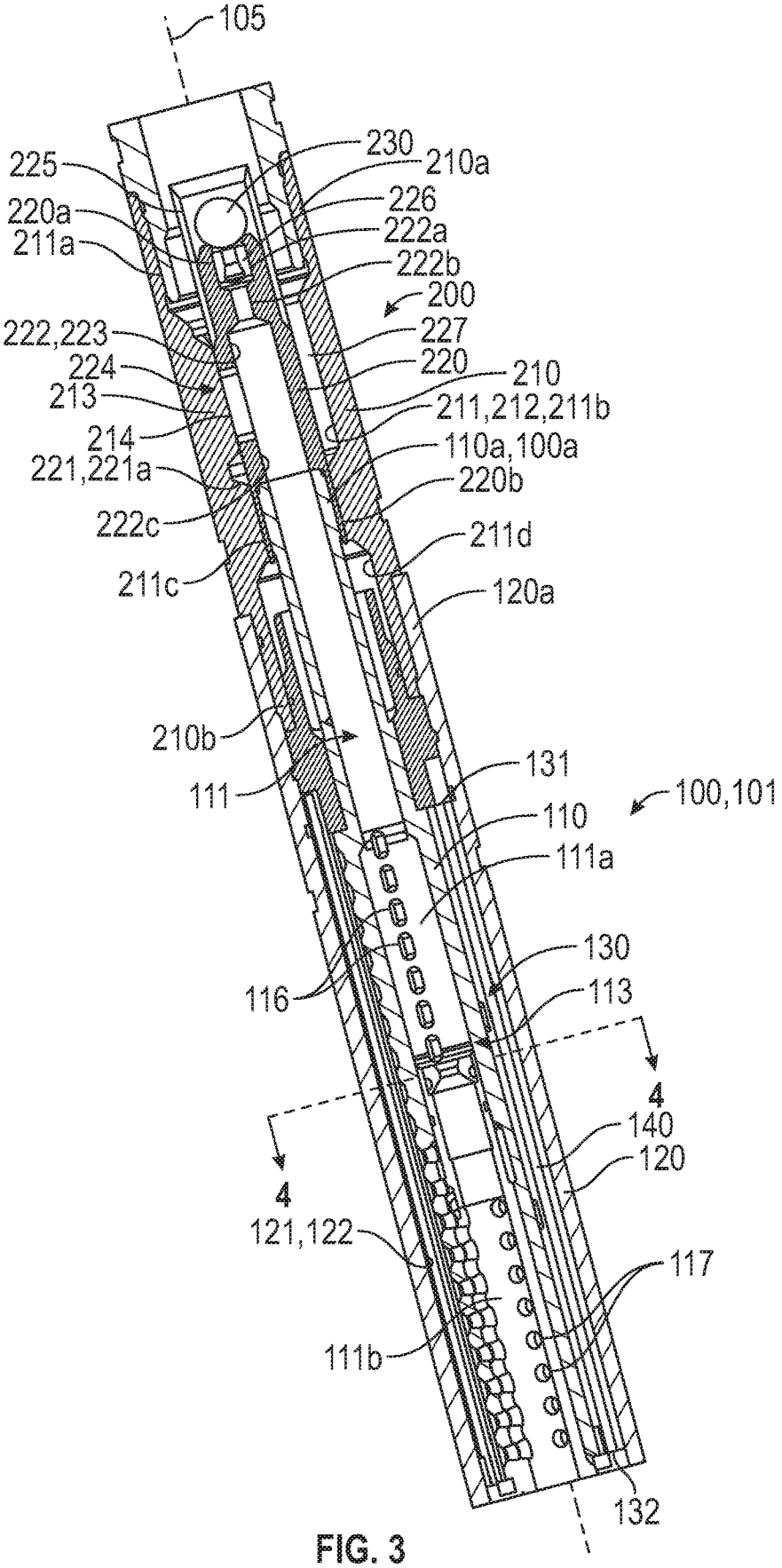
FIG. 3 is an enlarged view of one of the top mount radial valve and the first stage of the concentric power section of FIG. 2.
Figure 4:
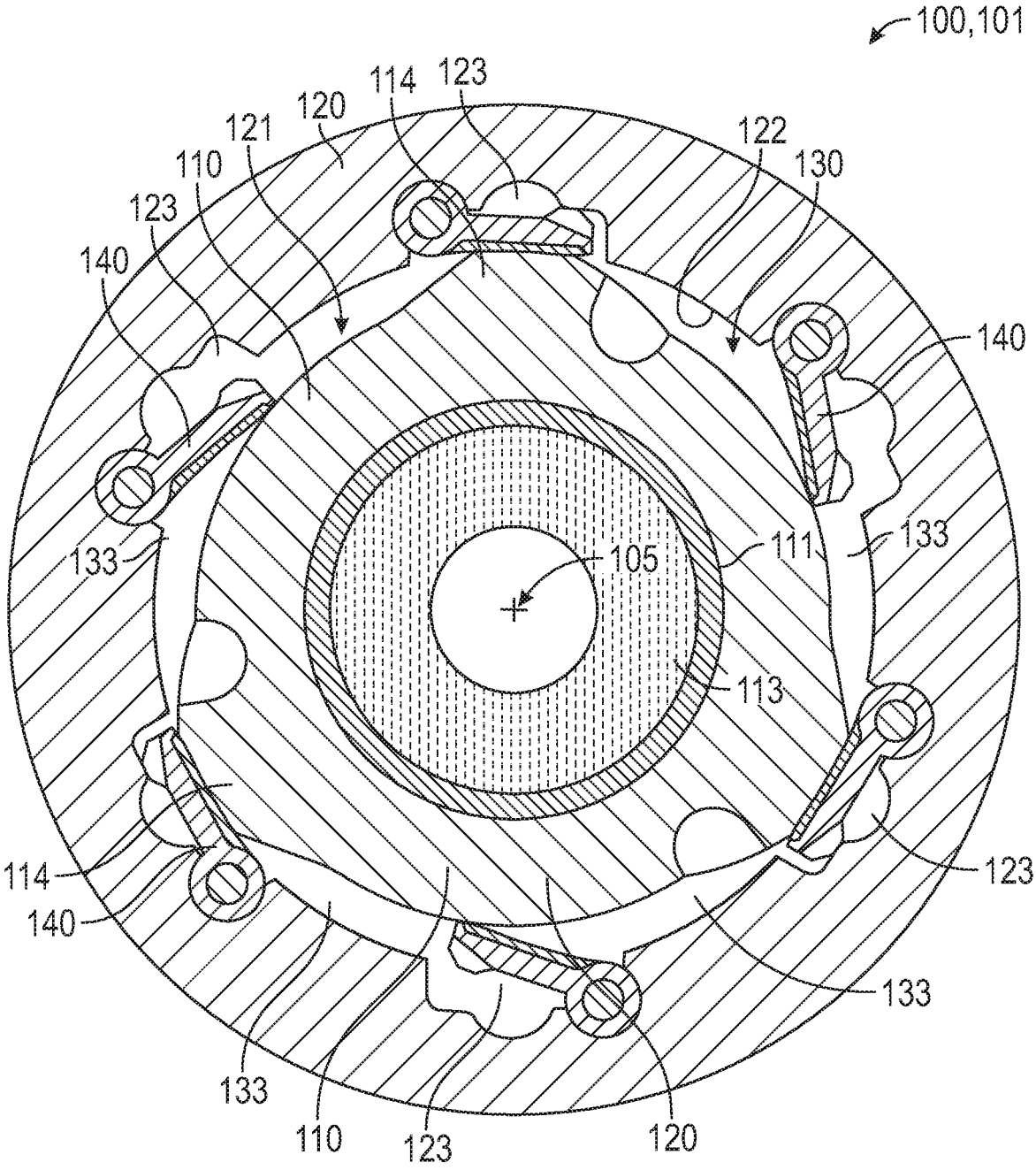
FIG. 4 is a cross-sectional view of the concentric power section of FIG. 2 taken along section 4-4 of FIG. 2.

Referring now to FIGS. 2-4, both stages 101, 102 have the same structure and function, and thus, first stage 101 will be described, it being understood that second stage 102 is the same. Stage 101 of power section 100 includes a tubular central shaft or rotor 110 rotatably disposed within a tubular housing or stator 120. Rotor 110 is coaxially aligned with and concentrically disposed within stator 120. In particular, rotor 110 and stator 120 have central axes coaxially aligned with axis 105 of power section 100. An annulus or working fluid space 130 is radially positioned between rotor 110 and stator 120. The upper and lower boundaries of working fluid space 130 are defined by upper and lower shoulders 131, 132 fixed within stator 120. Shoulders 131, 132 also constrain the axial position of rotor 110 relative to stator 120 (i.e., prevent rotor 110 from moving axially relative to stator 120).

As best shown in FIGS. 2 and 3, rotor 110 has a first or upper end 110*a*, a second or lower end 110*b*, and a central throughbore 111 extending axially between ends 110*a*, 110*b*. In addition, rotor 110 includes a plurality of fluid inlet ports 116 proximal upper end 110*a*, a plurality of fluid outlet ports 117 proximal lower end 110*b*, and a flow restrictor 113 disposed within bore 111 axially between ports 116, 117. Ports 116, 117 are in fluid communication with working fluid space 130 and throughbore 111. Flow restrictor 113 divides throughbore 111 into a first or upstream region 111*a* extending axially from upper end 110*a* to restrictor 113 and a second or downstream region 111*b* extending axially from restrictor 113 to downstream end 110*b*. In general, flow restrictor 113 allows axial flow directly between regions 111*a*, 111*b*, but restricts and limits the fluid flow through bore 111 and between regions 111*a*, 111*b*, thereby forcing at least some of the fluid flowing through upstream region 111*a* of bore 111 to pass through ports 116 into working fluid space 130. The fluid flowing into and through working space 130 passes back into downstream region 111*b* of bore 111 via ports 117. Accordingly, stage 101 may be described as defining a fluid path between a fluid intake zone in an upstream region 111*a* of bore 111, through inlet ports 116 into working fluid space 130, and out of working fluid space 130 through outlet ports 117 into a fluid exit zone in a downstream region 111*b* of bore proximal lower end 110*b*, from which zone fluid flow can continue to second stage 102.

Stator 120 has a first or upper end 120*a*, a second or lower end 120*b*, and a central throughbore 121 extending axially between ends 120*a*, 120*b*. Throughbore 121 is defined by a generally cylindrical radially inner surface 122 of stator 120. As shown in FIG. 2, lower end 110*b* of rotor 110 of first stage 101 is coupled to upper end 110*a* of rotor 110 of second stage 102 with throughbores 111 of rotors 110 in fluid communication, and lower end 120*b* of stator 120 of first stage 101 is coupled to upper end 120*a* of stator 120 of second stage 102.

As best shown in FIG. 4, the radially outer surface of rotor 110 includes a plurality of uniformly circumferentially-spaced longitudinal rotor lobes 114. A plurality of axially extending, uniformly circumferentially-spaced elongate gates 140 are disposed along inner surface 122 of stator 120 and are pivotally mounted to stator 120 within respective elongate gate-receiving pockets 123 in inner surface 122 of stator 120. As rotor 110 rotates within stator 120, lobes 114 sequentially engage gates 140 and deflect gates 140 into corresponding gate pockets 123 in stator 120 so that rotor lobes 114 can pass by. Thus, each gate 140 pivots between a first or extended position in contact with or closely adjacent to rotor 110 when positioned circumferentially between adjacent rotor lobes 114, and a second or deflected position when displaced into its corresponding gate pocket 123 by a passing rotor lobe 114.

Gates 140 are biased into substantially fluid-tight contact with rotor 110. As a result, working fluid space 130 between rotor 110 and stator 120 is divided into longitudinal chambers 133 between rotor lobes 114 and adjacent gates 140. Longitudinal chambers 133 are bound at either end by shoulders 131, 132. In operation, a pressurized working fluid (e.g., drilling mud) is pumped from the surface into region 111*a* of throughbore 111. The working fluid then passes through inlet ports 116, thereby pressurizing (at any given time) one or more longitudinal chambers 133 and inducing rotation of rotor 110 relative to stator 120. Opposite the high pressure side of each lobe 114, the fluid is directed through fluid outlet ports 117 and onward to region 111*a* of second stage 102.

The number of rotor lobes 114 and the number of gates 140 can vary. Preferably, however, there will always be at least one fluid inlet port 116 and at least one fluid outlet port 117 located between adjacent rotor lobes 114 at any given time, and at least one gate 140 sealing between adjacent fluid inlet and outlet ports 116, 117 at any given time. Torque and speed outputs of each stage 101, 102 are dependent on the length and radial height (i.e., gate lift) of chambers 133. For a given stage length, a smaller gate lift produces higher rotational speed and lower torque. Conversely, a larger gate lift produces higher torque and lower rotational speed. In this embodiment, each stage 101, 102 is substantially the same as an embodiment of a concentric rotary drive system disclosed in U.S. Pat. No. 9,574,401. However, in general, each stage (e.g., stage 101, 102) can comprise any suitable concentric rotary drive system known in the art. Examples of concentric rotary drive systems that can be used in connection with embodiments described herein are disclosed in U.S. Pat. Nos. 6,976,832 and 9,574,401, and European Patent Application Nos. EP 20130780628 EP2013078062850 of which are hereby incorporated herein by reference in their entirety.

Referring again to FIG. 2, bearing assembly 150 includes an elongate tubular mandrel 160 coaxially and rotatably disposed within a generally cylindrical outer housing 170. Mandrel 160 has a central axis 165 coaxially aligned with axis 105, a first or upper end 160*a* coupled to lower end 110*b* of rotor 110 of second stage 102, a second or lower end 160*b* coupled to drill bit 21, and a throughbore 161 extending axially from upper end 160*a* to lower end 160*b*. Throughbore 161 is in fluid communication with throughbores 111 of rotors 110 such that drilling fluid passes through bore 161 to bit 21 coupled to lower end 160*b* of mandrel 160. In this embodiment, lower end 110*b* of rotor 110 of second stage 102 is concentrically coupled to upper end 160*a* of mandrel 160 by a splined connection. In other embodiments, a threaded connection may be used to concentrically couple lower end 110*b* of rotor 110 of second stage 102 to upper end 160*a* of mandrel 160. Housing 170 has a central axis 175 coaxially aligned with axes 105, 165, a first or upper end 170*a* directly coupled to lower end 120*b* of stator 120 of second stage 102, and a second or lower end 170*b* distal power section 100. Mandrel 160 extends axially through lower end 170*b* of housing 170.

Bearing assembly 150 comprises multiple bearings for transferring the various axial and radial loads between mandrel 160 and housing 170 that occur during the drilling process. Thrust bearings transfer on-bottom and off-bottom operating loads, while radial bearings transfers radial loads between mandrel 160 and housing 170. In preferred embodiments, the thrust bearings and radial bearings are mud-lubricated PDC (polycrystalline diamond compact) insert bearings, and a small portion of the drilling fluid is diverted through the bearings to provide lubrication and cooling. In other embodiments, other types of mud-lubricated bearings may be used, or one or more of the bearings may be oil-sealed. Notwithstanding the foregoing discussion of thrust bearings and radial bearings in downhole bearing assembly 150, it is to be noted that any suitable type and arrangement bearings known in the art can be used.

Referring still to FIG. 2, in this embodiment, second stage 102 of power section 100 includes an optional relief or bypass valve 180 seated in throughbore 111 of rotor 110 of second stage 102. More specifically, bypass valve 180 is axially positioned between inlet ports 116 and outlet ports 117 of rotor 110 of second stage 102. Thus, similar to flow restrictor 113 of first stage 101, bypass valve 180 of second stage 102 divides throughbore 111 of the corresponding rotor 110 (of second stage 102) into a first or upstream region 111*a* extending axially from upper end 110*a* of the corresponding rotor 110 to bypass valve 180 and a second or downstream region 111*b* extending axially from bypass valve 180 to downstream end 110*b* of the corresponding rotor 110. Valve 180 has a closed position preventing axial flow between regions 111*a*, 111*b* of throughbore 111 of the corresponding rotor 110 and an open position allowing axial flow between regions 111*a*, 111*b*. In particular, valve 180 can open to varying degrees to allow an adjustable volumetric flow of axial flow between regions 111*a*, 111*b*—the more valve 180 is open, the greater the volumetric flow of axial flow between regions 111*a*, 111*b*.

In this embodiment, bypass valve 180 is transitioned from the closed position to the open position at a predetermined or threshold pressure differential across second stage 102 (e.g., fluid pressure differential between regions 111*a*, 111*b* on opposite sides of valve 180) and is transitioned between varying degrees of openness as the pressure differential across second stage 102 varies above the predetermined pressure differential—once above the predetermined pressure differential, the greater the pressure differential across second stage 102 the more open valve 180 and the lesser the pressure differential across second stage, the less open valve 180. In other embodiments, the bypass valve in the second stage (e.g., bypass valve 180 of second stage 102) actuates in response to the flow rate of fluid through the upstream region of the corresponding rotor (e.g., upstream region 111*a* of throughbore 111 of rotor 110 of second stage 102). In general, bypass valve 180 can be any valve known in the art that can be selectively opened to varying degrees in response to a pressure differential or flow rate. Examples of such suitable valves are disclosed in PCT patent application no. PCT/US2013/038446 (WO 2013/163565), which is hereby incorporated herein by reference in its entirety for all purposes.

When valve 180 is closed, axial flow between regions 111*a*, 111*b* is prevented, and thus, all the flow through region 111*a* of the corresponding rotor 110 is forced to pass through ports 116 into working fluid space 130 of second stage 102, and then from working fluid space 130 of second stage into downstream region 111*b* of bore 111 via ports 117. However, when valve 180 is open, a portion of the flow through region 111*a* of the corresponding rotor 110 is allowed to flow axially from region 111*a* into region 111*b*, thereby bypassing inlet ports 116, outlet ports 117, and working fluid space 130 of second stage 102. Thus, any axial flow directly between regions 111*a*, 111*b*, as permitted by bypass valve 180, bypasses inlets 116, outlets 117, and working fluid space 130 of second stage 102. In general, the more open valve 180, the greater the portion of fluid flowing through region 111*a* that is allowed to flow axially into region 111*b* and bypass working fluid space 130 of second stage; and the less open valve, the smaller the portion of fluid flowing through region 111*a* that is allowed to flow axially into region 111*b* and bypass working fluid space of second stage 102. Accordingly, second stage 102 may also be described as defining a fluid path between a fluid intake zone in an upstream region 111*a* of bore 111 of the corresponding rotor 110, through inlet ports 116 into working fluid space 130, and out of working fluid space 130 through outlet ports 117 into a fluid exit zone in a downstream region 111*b* of bore 111 of the corresponding rotor 110 proximal lower end 110*b*, from which zone fluid flow can continue to throughbore 161 of mandrel 160.

As previously described, in operation, the pressurized working fluid (e.g., drilling mud) flowing into and through working fluid spaces 130 of stages 101, 102 of power section 100 drives the rotation of rotors 110 relative to stators 120 of stages 101, 102. The opening of bypass valve 180 increases the relative quantity of drilling fluid that bypasses working fluid space 130 of second stage 102, and hence, decreases the relative quantity of drilling fluid flowing through working fluid space 130 of second stage 102, thereby decreasing the rotational speed of rotors 110 of stages 101, 102. Similarly, the more open bypass valve 180 (once valve 180 is open), the greater the relative quantity of drilling fluid that bypasses working fluid space 130 of second stage 102, and hence, the lesser the relative quantity of drilling fluid flowing through working fluid space 130 of second stage 102, thereby decreasing the rotational speed of rotors 110 of stages 101, 102. Likewise, the less open bypass valve 180 (and closing of valve 180), the lesser the relative quantity of drilling fluid that bypasses working fluid space 130 of second stage 102, and hence, the greater the relative quantity of drilling fluid flowing through working fluid space 130 of second stage 102, thereby increasing the rotational speed of rotors 110 of stages 101, 102. As previously described, in this embodiment, bypass valve 180 is transitioned from the closed position to the open position at a threshold pressure differential across second stage 102, and is transitioned between varying degrees of openness as the pressure differential across second stage 102 varies (once the threshold pressure differential is achieved). Thus, in this embodiment, by controlling the pressure of drilling fluid flowing through power section 100 (and rotors 101), and hence the pressure differential across second stage 102, the rotational speed of rotors 110 can be controlled and adjusted.

Referring again to FIG. 3, an oscillating or rotary valve 200 is coupled to upper end 100*a* of power section 100. Consequently, valve 200, as well as other embodiments of valves disclosed herein that are coupled to the upper end of a power section and/or positioned upstream of the power section, may also be referred to as a "top mount" valve. Top mount valves offer several potential benefits. For example, top mount valves enable the ability to bypass a substantial volume of drilling fluid around the power section (e.g., via directing more flow through the rotor as opposed to the working fluid space) since the pressure pulses are generated above the power section. In addition, in embodiments of top mount valves including variable bypass nozzles, the speed of the downstream power section can be altered without damping or killing the pressure pulse generated uphole of the power section. In addition, top mount valves allow the frequency of pressure pulses to be more easily tuned independent of flowrate. Still further, top mount valves can more easily be modified for selective actuation or deactivation, in combination with the ability to be fished through for retrieval of components (e.g., nuclear sources) downhole of the top mount valve and power section.

Figure 5:
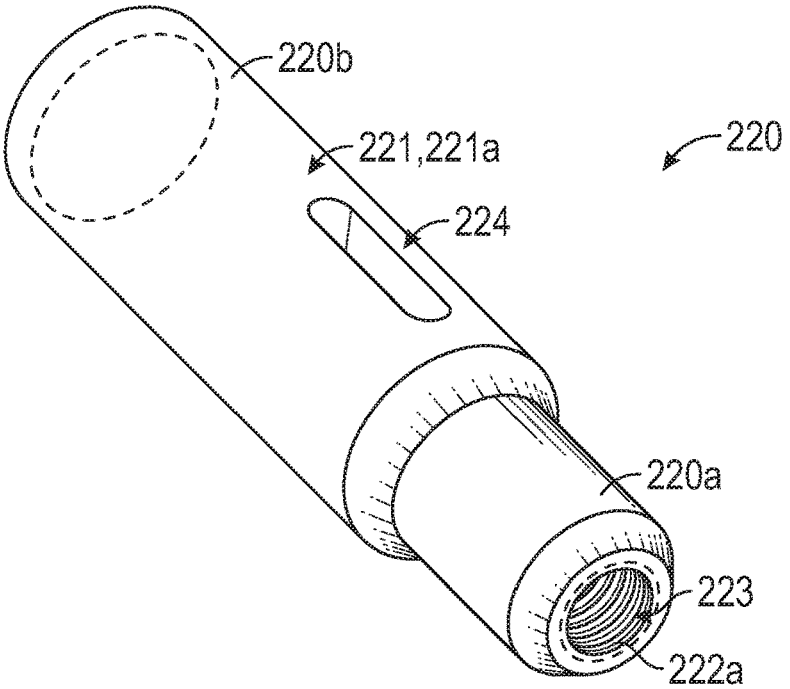
FIG. 5 is a perspective view of the valve member of the top mount radial valve of FIG. 3.
Figure 6:
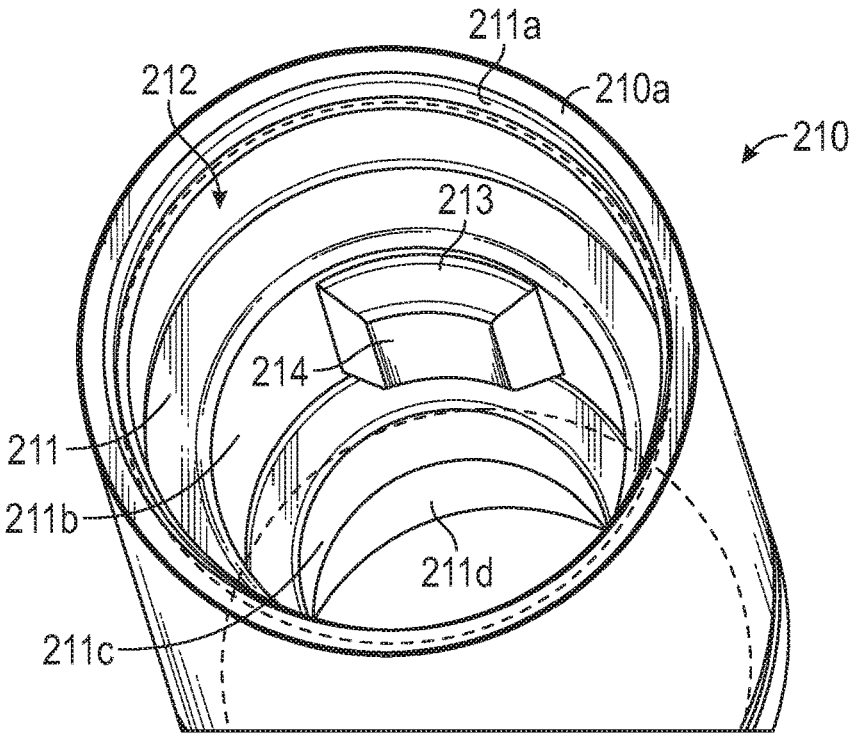
FIG. 6 is a perspective view of the outer housing of the top mount radial valve of FIG. 3.

In general, oscillating valve 200 is operated by the rotation of rotor 110 to selectively generate pressure pulses in the drilling fluid upstream of power section 100. The pressure pulses generated by valve 200 drive the axial reciprocation of shock tool 92 (FIG. 1). As best shown in FIGS. 3, 5, and 6, in this embodiment, valve 200 includes a first valve member or outer housing 210 and a second valve member or body 220 rotatably disposed within housing 210. Body 220 is concentrically disposed within housing 210, and further, body 220 and housing 210 are coaxially aligned with each rotor 110 and stator 120 of power section 100. In other words, body 220 and housing 210 have central axes that are coaxially aligned with axis 105.

Referring now to FIGS. 3 and 6, housing 210 has a first or upper end 210*a* coupled to drillstring 22, a second or lower end 210*b* directly coupled to upper end 120*a* of stator 120, and a radially inner surface 211 extending axially from upper end 210*a* to lower end 210*b*. Inner surface 211 defines a central throughbore 212 extending axially between ends 210*a*, 210*b*. Body 220 extends through central throughbore 212. In this embodiment, upper end 210*a* is a box end that threadably receives a mating pin end of a sub that couples housing 210 and power section 100 to drillstring 22, while lower end 210*b* is a pin end that threadably couples housing 210 to a mating box end disposed at upper end 120*a* of stator 120. Thus, housing 210 is static or fixed relative to stator 120 and drillstring 22.

The inner radius of housing 210 measured radially from axis 105 to inner surface 211 varies moving axially along inner surface 211. In particular, moving axially from upper end 210*a* to lower end 210*b*, inner surface 211 includes an internally threaded first cylindrical surface 211*a* extending axially from upper end 210*a* and defining a box end, a second cylindrical surface 211*b*, a third cylindrical surface 211*c*, and a fourth cylindrical surface 211*d*. The radii of each pair of axially adjacent cylindrical surfaces 211*a*, 211*b*, 211*c*, 211*d* are different, and thus, an annular shoulder extends radially between each pair of axially adjacent cylindrical surfaces 211*a*, 211*b*, 211*c*, 211*d*. In this embodiment, surface 211*a* has a radius that is greater than the radius of surface 211*b*, surface 211*b* has a radius that is greater than the radius of surface 211*c*, and surface 211*c* has a radius that is less than the radius of surface 211*d*. Thus, in this embodiment, the radius of cylindrical surface 211*c* defines the smallest inner radius of housing 210. As best shown in FIGS. 3 and 6, a raised lug 213 is disposed on surface 211*b* and extends radially inward relative to surface 211*b*. Lug 213 extends circumferentially along a portion of surface 211*b* (e.g., about 30° measured about axis 105) and has a radially inner cylindrical surface 214. As will be described in more detail below, surfaces 211*c*, 214 directly contact and slidingly engage body 220.

Referring now to FIGS. 3 and 5, body 220 is rotatably disposed within housing 210 and has a first or upper end 220*a*, a second or lower end 220*b*, a radially outer surface 221 extending axially between ends 220*a*, 220*b*, and a radially inner surface 222 extending axially between ends 220*a*, 220*b*. Lower end 220*b* is fixably coupled to upper end 110*a* of rotor 110 such that body 220 rotates with rotor 110 relative to housing 210 and stator 120.

Inner surface 222 defines a central passage 223 extending axially between ends 220*a*, 220*b*. In addition, body 220 includes a port 224 axially positioned between ends 220*a*, 220*b* and extending radially from outer surface 221 to inner surface 222. In this embodiment, lower end 220*b* is a box end that threadably receives a mating pin end at upper end 110*a* of rotor 110.

Referring still to FIGS. 3 and 5, in this embodiment, inner surface 222 includes a receptacle 222*a* at upper end 220*a*, a reduced inner radius section 222*b* axially adjacent receptacle 222*a*, and a cylindrical surface 222*c* extending axially between section 222*b* and end 220*b*. Reduced inner radius section 222*b* define a flow restriction along passage 223.

As best shown in FIG. 3, in this embodiment, a plug seat 225 is coupled to upper end 220*a* and a nozzle 226 is removably threaded into receptacle 222*a*. Seat 225 defines a receptacle immediately above end 220*a* and nozzle 226 sized and positioned to receive a plug 230. In this embodiment, seat 225 is an annular sleeve threadably mounted to upper end 220*a* and plug 230 is a ball sized to be slidingly received by seat 225 when dropped from the surface down drillstring 22 to valve 200. When plug 230 is disposed in seat 225 as shown in FIG. 3, it blocks the flow of drilling fluid through nozzle 226 and passage 223 of body 220, thereby forcing the drilling fluid to bypass passage 223 and flow between body 220 and housing 210. However, when plug 230 is not disposed in seat 225, drilling fluid can flow through seat 225, nozzle 226, and passage 223. As used herein, the term "block(s)" means to obstruct fluid flow, and hence restrict the fluid flow in a particular direction or along a particular path. In general, a structure or device that "blocks" fluid flow may partially restrict the fluid flow or completely restrict (i.e., prevent) the fluid flow in a particular direction or along a particular path.

In general, the size of the orifice in nozzle 226 influences the amount of drilling fluid that flows through bore 223 relative to the amount of drilling fluid that bypasses or flows around passage 223 between body 220 and housing 210 when plug 230 is not disposed in seat 225. In particular, a smaller orifice in nozzle 226 allows less drilling fluid into passage 223 (resulting in more drilling fluid bypassing passage 223) and a larger orifice in nozzle allows more drilling fluid into passage 223 (result in less drilling fluid bypassing passage 223). Thus, different nozzles 226 having different sized orifices can be used to alter the relative quantity of drilling fluid flowing through bore 223 versus bypassing bore 223, which in turn affects the amplitude of each pressure pulse generated by valve 200.

Outer surface 221 of body 220 includes a cylindrical surface 221*a* extending from lower end 220*b*. Port 224 extends radially from surface 221*a* to surface 222*c*.

Referring again to FIG. 3, body 220 is disposed in housing 210 with port 224 axially aligned with lug 213 and cylindrical surface 221*a* of body 220 radially opposed cylindrical surfaces 211*b*, 211*c* of housing 210. Cylindrical surface 211*b* of housing 210 is radially spaced from cylindrical surface 221*a* of body 220, thereby resulting in an annular space or annulus 227 radially disposed between surfaces 221*a*, 211*b*. Surface 221*a* is disposed at substantially the same radius as surfaces 211*c*, 214 of housing 210, and thus, surface 221*a* directly contacts and slidingly engages surfaces 211*c*, 214. Port 224 has a circumferential width that is less than the circumferential width of lug 213 and corresponding surface 214, and further, port 224 has an axial height that is less than the axial height of lug 213 and corresponding surface 214. Thus, when port 224 is circumferentially aligned with lug 213, port 224 is closed (or substantially closed) by lug 213 and fluid communication between annulus 227 and passage 223 via port 224 is substantially restricted and/or prevented. However, when port 224 is not circumferentially aligned with lug 213, port 224 is open and allowed fluid communication between annulus 227 and passage 223. Although valve 200 is shown and described as including one port 224 and one lug 213, in general, the valve (e.g., valve 200) can have one or more ports (e.g., ports 224) and one or more lugs (e.g., lug 213).

Referring still to FIG. 3, during drilling operations, drilling fluid is pumped down drillstring 22 to power section 100. At least initially, plug 230 is not disposed in seat 225, and thus, a portion of the drilling fluid flows through nozzle 226 and a portion of the drilling fluid flows into annulus 227. The drilling fluid that passes through nozzle 226 enters passage 223 of body 220. The drilling fluid that passes through annulus 227 also enters passage 223, but it does so via port 224. The drilling fluid flowing into and through bore 223 (via nozzle 226 and port 224) flows downstream into rotor 110 of first stage 101 and drives the rotation of rotors 110 of stages 101, 102 as previously described. Body 220 is fixably coupled to rotors 110, and thus, body 220 rotates with rotors 110 relative to housing 210. Rotation of body 220 results in the cyclically opening and closing of port 224 with lug 213—as port 224 rotates into circumferential alignment with lug 213, port 224 is temporarily closed, and when port 224 rotates out of circumferential alignment with lug 213, port 224 is opened. The cyclical opening and closing of port 224 generates pressure pulses in the drilling fluid upstream of valve 200—when port 224 is closed, the pressure of drilling fluid immediately upstream of valve 200 increases, and when port 224 is open, the pressure of the drilling fluid immediately upstream of valve decreases. In this manner, the rotation of rotors 110 drive the rotation of body 220 relative to housing 210, which in turn generates cyclical pressure pulses in the drilling fluid that drive the axial reciprocation of shock tool 92.

The drilling fluid passing through port 224 flows radially inward from annulus 227 through port 224 into passage 223. Accordingly, valve 200, as well as other embodiments of valves disclosed herein that cyclically vary the radial flow of drilling fluid (e.g., flow generally perpendicular to the central axis of the valve and the power section) to generate pressure pulses for operating a shock tool (e.g., shock tool 92) may also be referred to herein as "radial" valves. In contrast, embodiments of valves disclosed herein that cyclically vary the axial flow of drilling fluid to generate pressure pulses for operating a shock tool (e.g., shock tool 92) may also be referred to herein as "axial" valves.

As previously described, bypass valve 180 can be used to controllably adjust the rotational speed of rotors 110 of stages 101, 102—the more drilling fluid that bypasses working fluid space 130 of second stage 102, the lower the rotational speed of rotors 110, and the less drilling fluid that bypasses working fluid space 130 of second stage 102, the greater the rotational speed of rotors 110. Body 220 is fixably coupled to rotors 110, and thus, rotates at the same rotational speed as rotors 110. The greater the rotational speed of body 220, the greater the frequency of the pressure pulses generated by valve 200, and the lower the rotational speed of body 220, the lower the frequency of the pressure pulses generated by valve 200. In this manner, bypass valve 180 can be used to selectively decrease or increase the frequency of pressure pulses generated by valve 200.

As previously described, the size of the orifice in nozzle 226 determines the relative amounts of drilling fluid that pass through nozzle 226 and annulus 227. Without being limited by this or any particular theory, the greater the relative amount of drilling fluid that passes into annulus 227 (and less relative amount of drilling fluid that passes through nozzle 226), the greater the amplitude or height of each pressure pulse generated by valve 200. Thus, by using nozzles 226 having different sized orifices, the amplitude and pulse height of the pressure pulses generated by valve 200 can be adjusted.

Plug seat 225 and corresponding plug 230 enable the selective ability to increase the amplitude and pulse height of the pressure pulses generated by valve 200 downhole without retrieving valve 200 to the surface to change nozzle 226. In particular, when plug 230 is seated in plug seat 225, nozzle 226 is blocked and drilling fluid is restricted and/or prevented from flowing therethrough, thereby increasing the relative quantity of drilling fluid directed into annulus 227 and port 224 (when nozzle 226 is blocked, essentially all of the drilling fluid is directed into annulus 227 and port 224). In other words, when plug 230 is seated in plug seat 225, none of the drilling fluid can bypass port 224 via nozzle 226.

Figure 7:
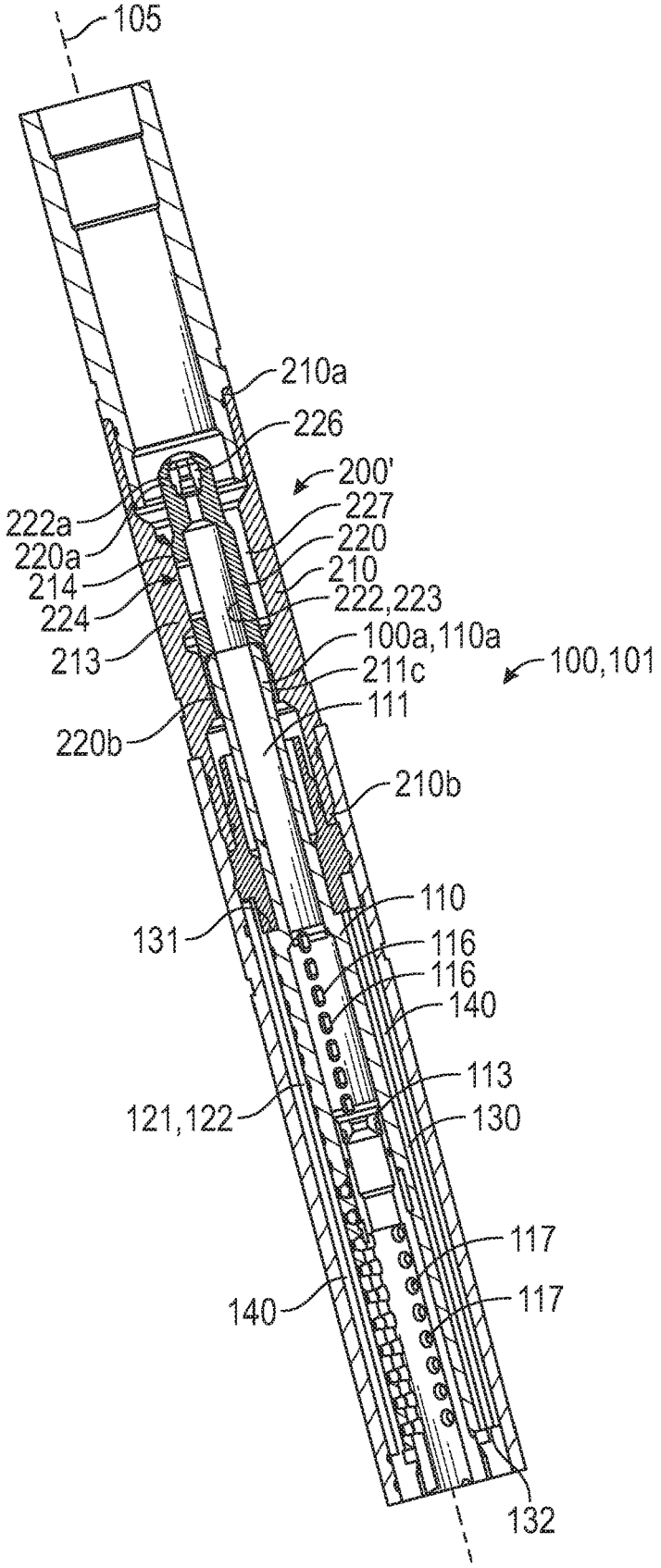
FIG. 7 is an enlarged cross-sectional view of an embodiment of a top mount radial valve in accordance with the principles described herein coupled to a concentric power section.

Although this embodiment of valve 200 includes plug seat 225 sized and positioned to receive plug 230, in other embodiments, no plug seat (e.g., plug seat 225) is provided. For example, FIG. 7 illustrates an oscillating valve 200' that is substantially the same as valve 200 previously described with the exception that valve 200' does not include a plug seat (e.g., plug seat 225) for receiving a plug from the surface. Thus, in this embodiment of valve 200', the ability to selectively increase the amplitude and pulse height of the pressure pulses generated by the valve by dropping a plug (e.g. plug 230) from the surface may not be possible.

As previously described, valve 200 includes nozzle 226, which can be changed to adjust the size of the orifice and relative amounts of drilling fluid that flow through nozzle 226 and annulus 227. In that embodiment of valve 200, nozzle 226 is threaded into mating receptacle 222*a* at upper end 220*a* of body 220, and thus, is generally fixed in position once valve 200 is disposed downhole. Although nozzle 226 enables the ability to adjust the amplitude and height of the pressure pulses generated by valve 200, the presence of nozzle 226 may limit the ability to fish through valve 200 (e.g., nozzle 226 limits axial access to passage 223). Accordingly, in other embodiments, no nozzle (e.g., nozzle 226) is provided to enable fish through capability. For example, referring now to FIG. 8, an embodiment of an oscillating valve 300 without a nozzle is shown.

Figure 8:
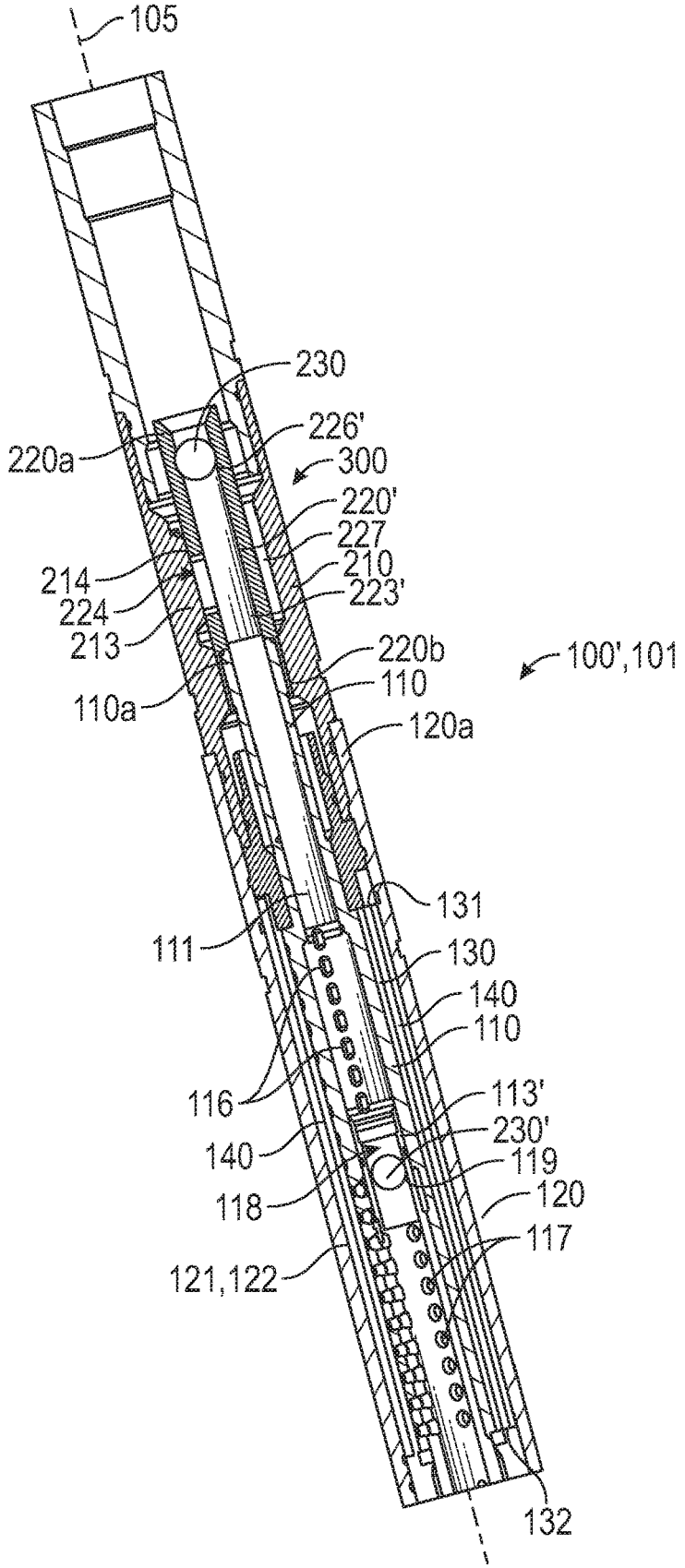
FIG. 8 is an enlarged cross-sectional view of an embodiment of a top mount radial valve in accordance with the principles described herein coupled to a concentric power section.

As shown in FIG. 8, valve 300 is coupled to a power section 100' that is substantially the same as power section 100 previously described with the exception that flow restrictor 113 is replaced with a plug seat 113' disposed within bore 111 axially between ports 116, 117. In this embodiment, plug seat 113' has a central throughbore 118 and an annular uphole facing shoulder or seat 119 disposed along throughbore 118. Seat 119 is sized to sealingly engage a plug 230', which is a ball in this embodiment. Throughbore 118 is coaxially aligned with central axis 105 of power section 100' and is substantially "full bore," meaning the diameter of throughbore 118 is greater than the diameter of throughbore 111 of rotor 110 within which plug seat 113' is disposed, substantially the same as the diameter of throughbore 111 of rotor 110 within which plug seat 113' is disposed, or only slightly less than (e.g., within 10%) the diameter of throughbore 111 of rotor 110 within which plug seat 113' is disposed. The relatively large diameter of throughbore 118 and coaxial alignment of throughbore 118 with power section 100' enables fish through capability when plug 230' is not seated therein.

Plug seat 113' also allows for the selective actuation of stage 101 of power section 100'. In particular, when plug 230' is not seated in plug seat 113', drilling fluid is free to flow through plug seat 113' with little to no restriction due to throughbore 118 having a full bore diameter. As a result, the drilling fluid flowing through bore 111 and plug seat 113' bypasses working fluid space 130 of stage 101—all or substantially all of the drilling fluid flows through throughbore 111 and little to none of the drilling fluid flows through working fluid space 130 of stage 101. Consequently, the drilling fluid does not drive the rotation of rotor 110 of stage 101. However, when plug 230' is dropped from the surface and lands in plug seat 113', throughbore 118 is closed and drilling fluid is prevented from flowing therethrough. Consequently, all of the drilling fluid flowing down upstream region 111*a* of throughbore 111 is forced into working fluid space 130, thereby driving the rotation of rotor 110 of stage 101. Although only one stage 101 is shown in FIG. 8, it should be appreciated that power section 100' may include additional stages (e.g., second stage 102) that are the same as stage 101 shown in FIG. 8.

Referring still to FIG. 8, valve 300 is substantially the same as valve 200 previously described. In particular, valve 300 is operated by the rotation of rotor 110 to selectively generate pressure pulses in the drilling fluid upstream power section 100', which drive the axial reciprocation of shock tool 92 (FIG. 1). In this embodiment, valve 300 includes a first valve member or outer housing 210 and a second valve member or body 220' rotatably disposed within housing 210. Body 220' is concentrically disposed within housing 210, and further, body 220' and housing 210 are coaxially aligned with rotor 110 and stator 120 of power section 100'. In other words, body 220' and housing 210 have central axes that are coaxially aligned with axis 105.

Housing 210 is as previously described with respect to valve 200. Body 220' is substantially the same as body 220 previously described with the exception that no nozzle (e.g., nozzle 226) is provided in body 220' and the central passage 223' of body 220' has a full bore diameter (e.g., within 10% of the diameter of throughbore 111 of rotor 110) between its upper and lower ends 220*a*, 220*b*. An annular uphole facing shoulder or seat 226' is disposed along passage 223' and sized to sealingly engage a plug 230, which is a ball in this embodiment. Passage 223' is coaxially aligned with central axis 105 of power section 100'. The relatively large diameter of passage 223' and coaxial alignment of passage 223' with power section 100' enables fish through capability.

Plug seat 226' also allows for the selective actuation, or at least selective increase in the amplitude and height of the pressure pulses generated by valve 300. In particular, when plug 230 is not seated in plug seat 226', drilling fluid is free to flow through passage 223' with little to no restriction due to passage 223' having a full bore diameter. As a result, most or substantially all of the drilling fluid flowing down drillstring 22 bypasses annulus 227 and port 224—all or substantially all of the drilling fluid flows through passage 223' and little to none of the drilling fluid flows through annulus 227 and port 224. Consequently, amplitude and height of the pressure pulses generated by valve 300, if any, is relatively small, and hence, induces little to no axial reciprocation of shock tool 92. However, when plug 230 is dropped from the surface and lands in plug seat 226', passage 223' is closed at upper end 220*a* and drilling fluid is prevented from flowing into passage 223' at upper end 220*a*. Consequently, all of the drilling fluid flowing down drillstring 22 is forced into annulus 227 and port 224, thereby "turning on" or at least increasing the amplitude and height of the pressure pulses generated by valve 300.

In the embodiment of valve 300 and power section 100' shown in FIG. 8 and described above, stage 101 of power section 100' can be fished through prior to both (1) actuation of stage 101 via seating of plug 230' in plug seat 113', and (2) actuation of valve 300 via seating of plug 230 in plug seat 226'; and valve 300 can be fished through prior to actuation of valve 300 via seating of plug 230 in plug seat 226'. However, since each plug 230, 230' is a ball that is generally not retrievable, once plug 230' and/or plug 230 are seated in the corresponding seats 113', 226' respectively, the ability to fish through stage 101 is limited and/or prevented; and once plug 230 is seated in seat 226', the ability to fish through valve 300 is limited and/or prevented. However, in other embodiments, the plugs used to actuate stage 101 and valve 300 are specifically designed to be retrievable, thereby allowing fish through capability before actuation of stage 101 and valve 300, as well as fish through capability after actuation of stage 101 and valve 300 via retrieval of the associated plugs. For example, FIG. 9 illustrates valve 300 and power section 100', each as previously described, in connection with embodiments of retrievable plugs.

Figure 9:
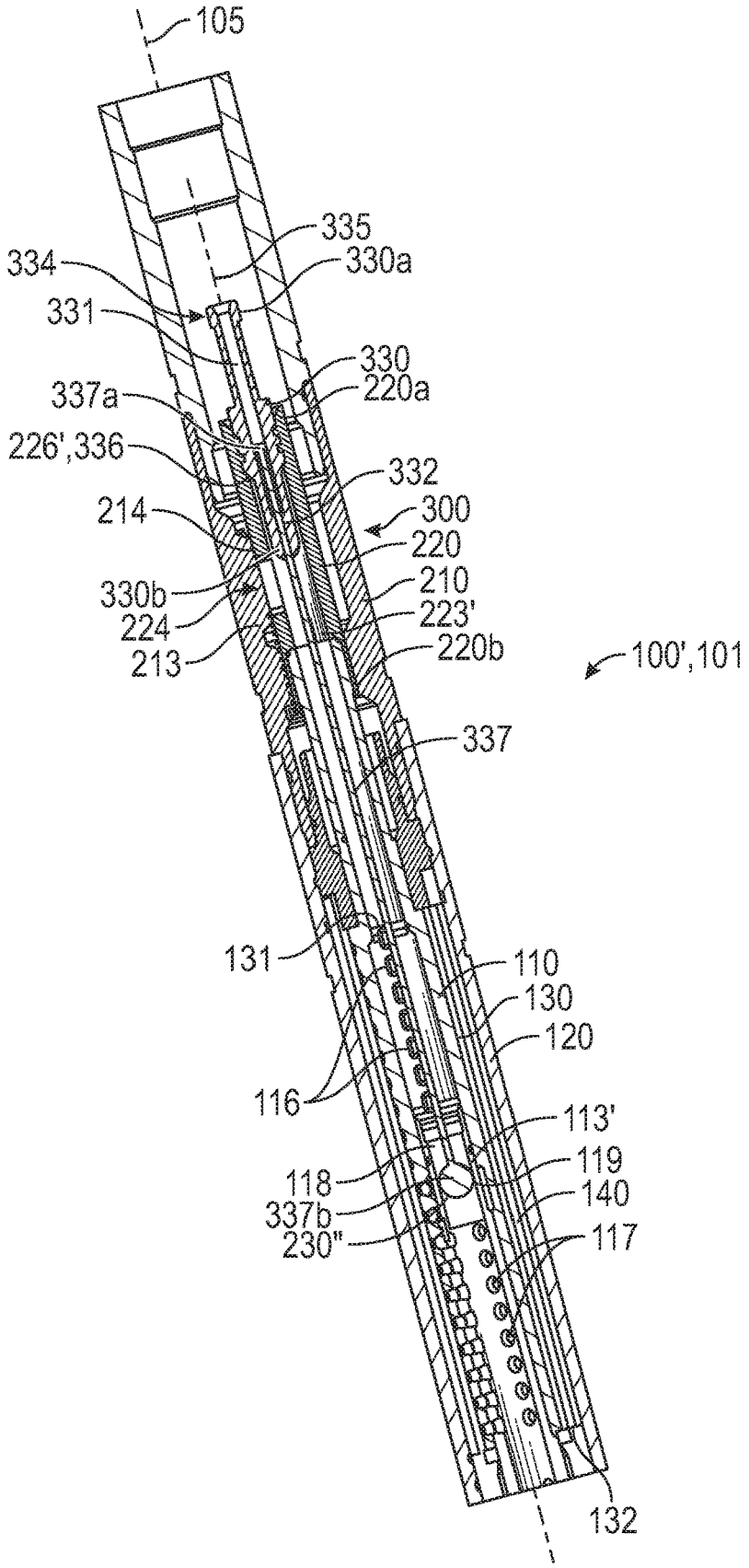
FIG. 9 is an enlarged cross-sectional view of an embodiment of a top mount radial valve in accordance with the principles described herein coupled to a concentric power section.

Referring now to FIG. 9, plug 230' is replaced with a plug 230", and plug 230 is replaced with a plug 330. Unlike plugs 230, 230' previously described, which were both free floating and independent balls, in this embodiment, plug 330 is a dart and plug 230" is a ball coupled to plug 330. In particular, plug 330 is an elongate dart having a central or longitudinal axis 335, a first or upper end 330*a*, a second or lower end 330*b*, an elongate counterbore or recess 331 extending axially from upper end 330*a*, and a throughbore 332 extending axially from recess 331 to lower end 330*b*. Upper end 330*a* includes a fishing-neck 334 configured to be engaged and grasped by a retrieval tool lowered down drillstring 22 from the surface. In this embodiment, fishing-neck 334 includes an annular downward facing shoulder proximal upper end 330*a*. The radially outer surface of plug 330 includes an annular downward facing shoulder 336 sized and positioned to seat against mating seat 226' of valve 300 with fishing-neck 334 axially positioned above valve 300 and lower end 330*b* disposed within passage 223' of body 220'.

In this embodiment, plug 230" is a ball, but is hung or suspended from plug 330 with an elongate connection member 337. In particular, connection member 337 has a first or upper end 337*a* disposed in recess 331 and a second or lower end 337*b* fixably secured to plug 230". Upper end 337*a* can move axially within recess 331, but has an outer diameter greater than the diameter of throughbore 332, which prevents upper end 337*a* from passing through bore 332. In this embodiment, connection member 337 is a rigid rod, however, in other embodiments; the connection member (e.g., connection member 337) can be a flexible cable.

Referring still to FIG. 9, plug seat 113' allows for the selective actuation of stage 101 of power section 100' in the same manner as previously described. Namely, when plug 230" is not seated in plug seat 113', drilling fluid is free to flow through plug seat 113' with little to no restriction due to throughbore 118 having a full bore diameter. As a result, the drilling fluid flowing through bore 111 and plug seat 113' bypasses working fluid space 130 of stage 101 and does not drive the rotation of rotor 110 of stage 101. However, when plug 230" is seated in plug seat 113', throughbore 118 is closed and drilling fluid is prevented from flowing therethrough. As a result, all of the drilling fluid flowing down upstream region 111*a* of throughbore 111 is forced into working fluid space 130, thereby driving the rotation of rotor 110 of stage 101.

Plug seat 226' allows for the selective actuation, or at least selective increase in the amplitude and height of the pressure pulses generated by valve 300 in the same manner as previously described. Namely, when plug 330 is not seated in plug seat 226', drilling fluid is free to flow through passage 223' with little to no restriction due to passage 223' having a full bore diameter. As a result, most or substantially all of the drilling fluid flowing down drillstring 22 bypasses annulus 227 and port 224. Consequently, amplitude and height of the pressure pulses generated by valve 300, if any, is relatively small, and hence, induces little to no axial reciprocation of shock tool 92. However, when plug 330 is seated in plug seat 226', passage 223' is closed at upper end 220*a* and all of the drilling fluid flowing down drillstring 22 is forced into annulus 227 and port 224, thereby "turning on" or at least increasing the amplitude and height of the pressure pulses generated by valve 300.

In the embodiment shown in FIG. 9, plugs 230", 330 are coupled via connection member 337, and thus, are dropped from the surface down drillstring 22 together, with plug 230" hung from plug 330 as previously described. Connection member 337 has a length selected such that both plugs 230", 330 are seated in corresponding seats 113', 226' at the same time.

As previously described, plugs 230", 330 can be retrieved from the surface to allow fish through capability for both valve 300 and stage 101 after actuation of valve 300 and stage 101. To retrieve plugs 230", 330, a fishing tool is lowered from the surface through drillstring 22 to plug 330, the fishing tool engages mating fishing-neck 334 at upper end 330*a*, and then the fishing tool is pulled back to the surface. Due to the positive engagement of the fishing tool and fishing-neck 334, plug 330 is pulled from seat 226' and retrieved to the surface with the fishing tool; and since upper end 337*a* of connection member 337 cannot be pulled through bore 332, plug 230" is pulled from seat 113' and retrieved to the surface with the fishing tool and plug 330. In general, the fishing tool used to retrieve plugs 230", 330 can be any fishing tool known in the art. Once plugs 230", 330 are retrieved to the surface, valve 300 and stage 101 can be fished through. Following the fish through operation, plugs 230", 330 can be dropped down drillstring 22 form the surface and reseated in corresponding seats 113', 226'.

Valves 200, 200', 300 previously described are top mount valves because each is coupled to the upper end of a corresponding power section and/or positioned upstream of the corresponding power section. Although top mount oscillating valves may offer the potential for some advantages, embodiments of oscillating valves for use in connection with concentric drive systems to generate pressure pulses can also be "bottom mount." As used herein, the term "bottom mount" may be used to describe an oscillating valve that is coupled to the lower end of a power section and/or positioned downstream of the power section.

Figure 10:
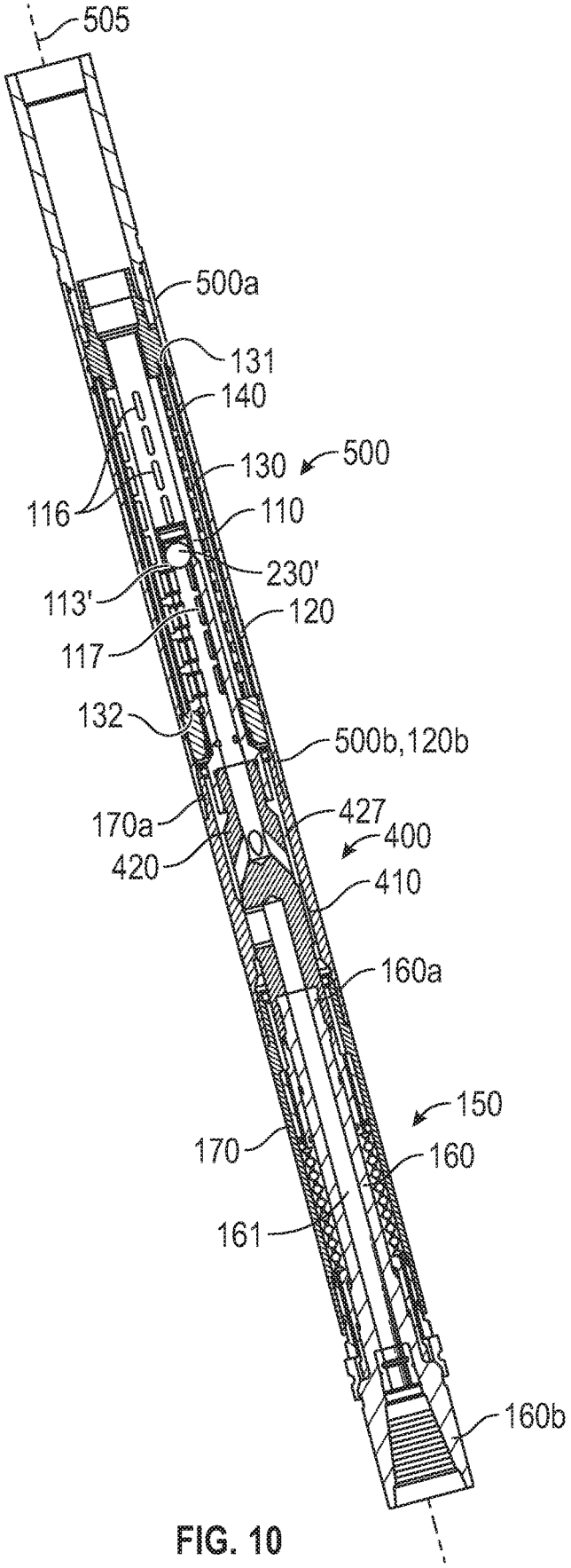
FIG. 10 is an enlarged cross-sectional view of an embodiment of a bottom mount radial valve in accordance with the principles described herein coupled to a concentric power section.

Referring now to FIG. 10, an embodiment of a bottom mount oscillating or rotary valve 400 is shown in connection with a power section 500, which can be used in place of power section 100 previously described. In this embodiment, power section 500 is substantially the same as power section 100' previously described with the exception that power section 500 includes only a single stage and valve 400 is axially positioned between power section 500 and bearing assembly 150. In particular, power section 500 is a concentric rotary drive system having a first or upper end 500*a*, a second or lower end 500*b*, and a central or longitudinal axis 505. Lower end 500*b* is coupled to valve 400. When power section 500 is disposed along drillstring 22, upper end 500*a* is coupled to shock tool 92. As noted above, power section 500 includes one stage that is similar to stage 101 previously described. Although power section 500 includes one stage in this embodiment, in other embodiments, the power section (e.g., power section 500) may include more than one stage.

Referring still to FIG. 10, power section 500 includes a tubular central shaft or rotor 110 rotatably disposed within a tubular housing or stator 120. Rotor 110 and stator 120 are each as previously described (e.g., rotor 110 is coaxially aligned with and concentrically disposed within stator 120). A plug seat 113' as previously described is disposed within bore 111 of rotor 110 axially between ports 116, 117. Plug seat 113' is sized to sealingly engage a plug 230', which is a ball in this embodiment. Plug seat 113' also allows for the selective actuation power section 500 in the same manner as previously described. In particular, when plug 230' is not seated in plug seat 113', drilling fluid is free to flow through plug seat 113' with little to no restriction, thereby bypassing working fluid space 130; and when plug 230' is seated in plug seat 113', throughbore 118 is closed and drilling fluid is prevented from flowing therethrough, thereby forcing all of the drilling fluid flowing down upstream region 111*a* of throughbore 111 into working fluid space 130 and driving the rotation of rotor 110.

Figure 11:
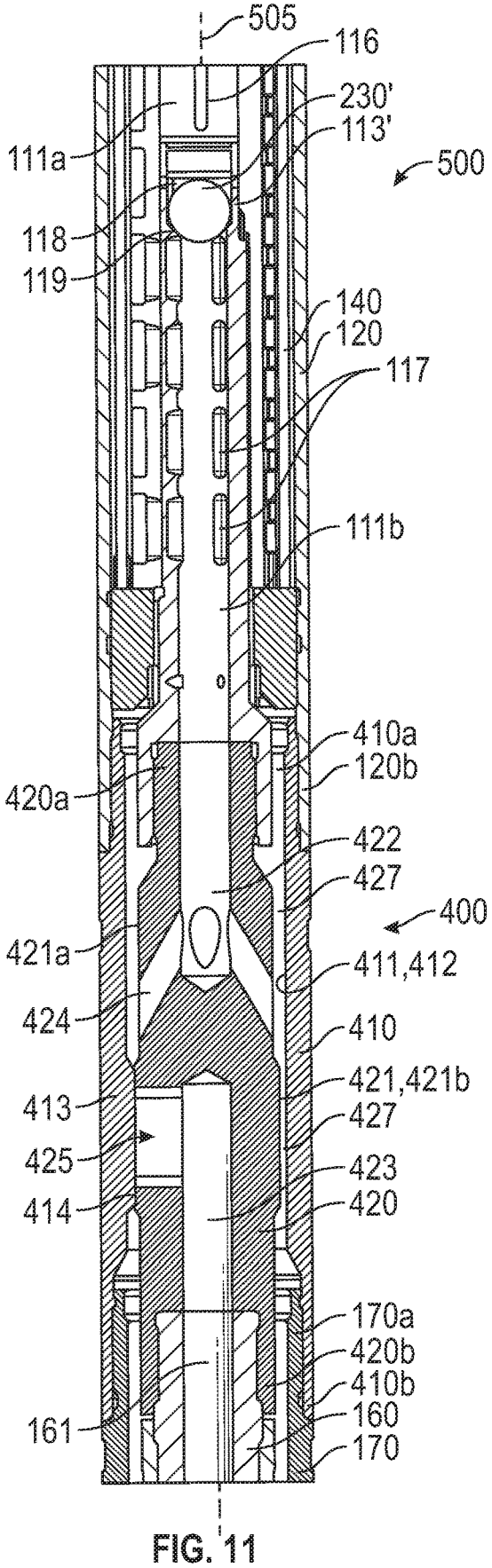
FIG. 11 is an enlarged cross-sectional view of the bottom mount radial valve of FIG. 10.
Figure 12:
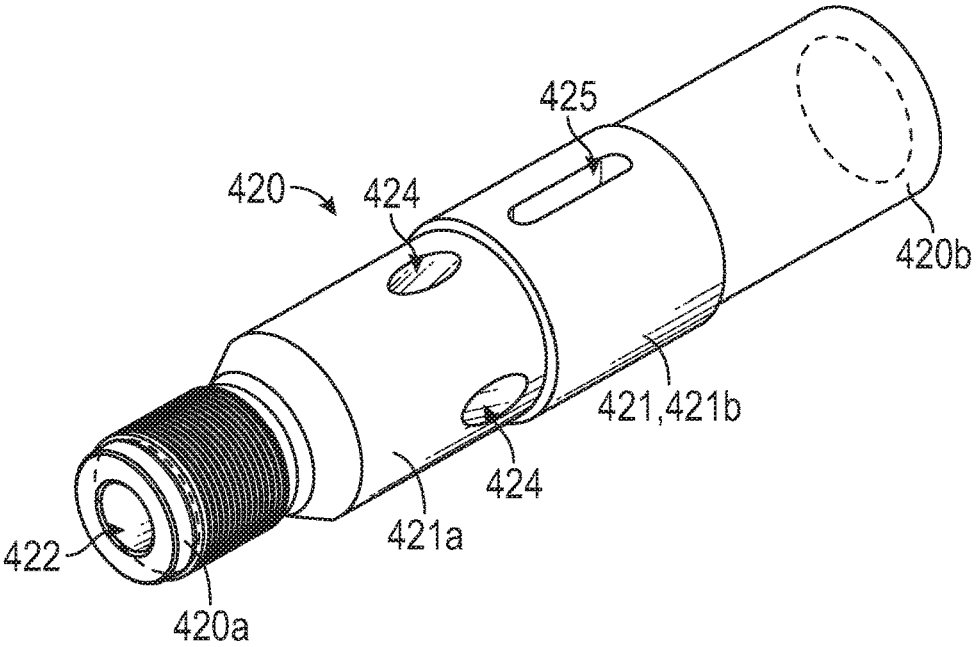
FIG. 12 is a perspective view of the valve member of the bottom mount radial valve of FIG. 10.
Figure 13:
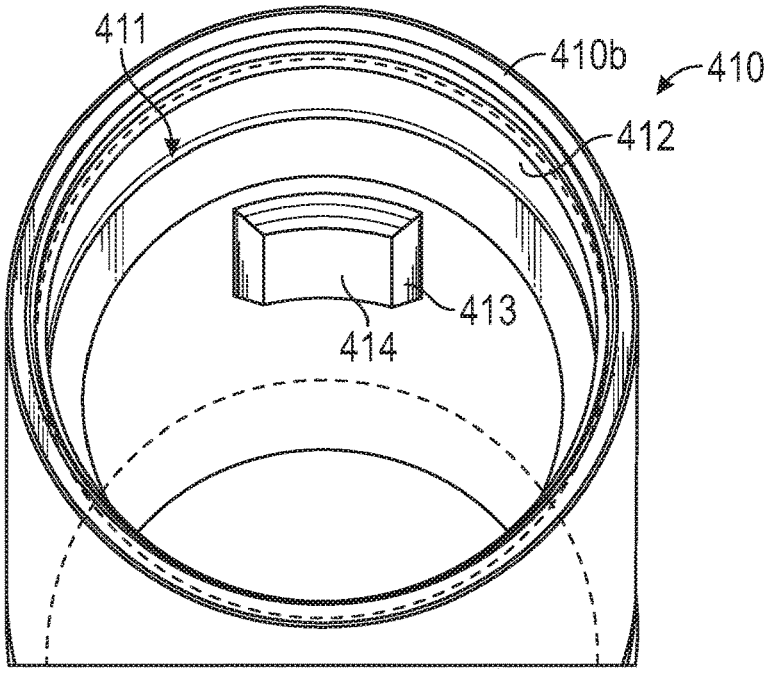
FIG. 13 is a perspective view of the outer housing of the bottom mount radial valve of FIG. 10.

Referring now to FIGS. 11-13, oscillating valve 400 is operated by the rotation of rotor 110 of power section 500 to selectively generate pressure pulses in the drilling fluid upstream of valve 400. The pressure pulses generated by valve 400 are transferred upstream through the drilling fluid in power section 500 to shock tool 92, and drive the axial reciprocation of shock tool 92 (FIG. 1). In this embodiment, valve 400 includes a first valve member or outer housing 410 and a second valve member or body 420 rotatably disposed within housing 410. Body 420 is concentrically disposed within housing 410, and further, body 420 and housing 410 are coaxially aligned with rotor 110 and stator 120 of power section 500. In other words, body 420 and housing 410 have central axes that are coaxially aligned with axes 105, 505.

Referring now to FIGS. 11 and 13, housing 410 has a first or upper end 410*a* directly coupled to lower end 120*b* of stator 120, a second or lower end 410*b* coupled to upper end 170*a* of housing 170 of bearing assembly 150, and a radially inner surface 411 extending axially from upper end 410*a* to lower end 410*b*. Inner surface 411 defines a central throughbore 412 extending axially between ends 410*a*, 410*b*. Body 420 extends through central throughbore 412. In this embodiment, upper end 410*a* is a pin end threadably received by a mating box end at lower end 120*b* of stator 120 while lower end 410*b* is a box end that threadably receives a mating pin end at upper end 170*a* of housing 170. Thus, housing 410 is static or fixed relative to stator 120 and drillstring 22.

In this embodiment, inner surface 411 is a cylindrical surface disposed at a uniform and constant radius moving axially along inner surface 411 between the pin and box ends disposed at upper and lower ends 410*a*, 410*b*, respectively. A raised lug 413 is disposed on surface 411 between ends 410*a*, 410*b*, and extends radially inward relative to surface 411. Lug 413 extends circumferentially along a portion of surface 411*b* (e.g., about 30° measured about axis 105) and has a radially inner cylindrical surface 414. As will be described in more detail below, surface 414 directly contacts and slidingly engages body 420.

Referring now to FIGS. 11 and 12, body 420 is rotatably disposed within housing 410 and has a first or upper end 420*a*, a second or lower end 420*b*, a radially outer surface 421 extending axially between ends 420*a*, 420*b*, a first cylindrical flow passage 422 extending axially from upper end 420*a*, and a second cylindrical flow passage 423 extending axially from lower end 420*b*. Flow passage 422 is in fluid communication with downstream region 111*b* of throughbore 111 of rotor 110 and flow passage 423 is in fluid communication with throughbore 161 of mandrel 160. However, in this embodiment, flow passages 422, 423 are not connected and are not in direct fluid communication—the lower end of flow passage 422 is axially positioned above the upper end of flow passage 423. Both flow passages 422, 423 are coaxially aligned with rotor 110 and stator 120. Upper end 420*a* is fixably coupled to lower end 110*b* of rotor 110 and lower end 420*b* is fixably coupled to upper end 160*a* of mandrel 160 such that body 420 rotates with rotor 110 and mandrel 160 relative to housing 410 and stator 120. In this embodiment, upper end 420*a* comprises a pin end that is threadably disposed in a mating box end disposed at lower end 110*b* of rotor 110 and lower end 420*b* comprises a box end that receives a mating pin end disposed at upper end 160*a* of mandrel 160.

A plurality of circumferentially-spaced outlet ports 424 extend radially from the lower end of flow passage 422 to outer surface 421 and an inlet port 425 extends radially from outer surface 421 to the upper end of flow passage 423. Port 425 is axially positioned below ports 424.

Outer surface 421 of body 420 includes a plurality of axially adjacent cylindrical surfaces positioned between ends 420*a*, 420*b*. In particular, outer surface 421 include a first cylindrical surface 421*a* proximal upper end 420*a* and a second cylindrical surface 421*b* axially positioned between surface 421*a* and lower end 420*b*. Ports 424 extend to surface 421*a* and port 425 extends to surface 421*b*.

Referring again to FIG. 11, body 420 is disposed in housing 410 with ports 424 axially positioned above lug 413 and port 425 axially aligned with lug 413. Outer surface 421 of body 420 is radially spaced from inner surface 411 of housing 410, thereby resulting in an annular space or annulus 427 radially disposed between surfaces 411, 421. As shown in FIG. 10, the upper and lower ends of annulus 427 are closed off and sealed (or substantially restricted) within lower end 120*b* of stator 120 and axially upper end 170*a* of housing 170, respectively.

Inner surface 414 of lug 413 is disposed at substantially the same radius as cylindrical surface 421*b* of valve member 421, and thus, surface 421*b* directly contacts and slidingly engages surface 414. Port 425 has a circumferential width that is less than the circumferential width of lug 413 and corresponding surface 414, and further, port 425 has an axial height that is less than the axial height of lug 413 and corresponding surface 414. Thus, when port 425 is circumferentially aligned with lug 413, port 425 is closed (or substantially closed) by lug 413 and fluid communication between annulus 427 and throughbore 423 via port 425 is substantially restricted and/or prevented. However, when port 425 is not circumferentially aligned with lug 413, port 425 is open and allowed fluid communication between annulus 427 and passage 423. Although valve 400 is shown and described as including one port 425 and one lug 413, in general, the valve (e.g., valve 400) can have one or more ports (e.g., ports 425) and one or more lugs (e.g., lug 413).

Referring still to FIG. 11, during drilling operations, pressured drilling fluid is pumped down drillstring 22 to power section 500. With plug 230' disposed in plug seat 113', drilling fluid flows through upstream region 111*a* of throughbore 111 and inlet ports 130 into working fluid space 130, and then from working fluid space 130 through outlet ports 117 into downstream region of throughbore 111, thereby driving the rotation of rotor 110 relative to stator 120. Body 420 is coupled to rotor 110, and thus, rotates with rotor 110 relative to stator 120 and housing 410 coupled thereto. The drilling fluid in downstream region 111*b* flows into passage 422 and out ports 424 into annulus 427, and then flows from annulus 427 through port 425 into passage 423. The drilling fluid in passage 423 then flows into throughbore 161 of mandrel 160.

Rotation of body 420 results in the cyclically opening and closing of port 425 with lug 413—as port 425 rotates into circumferential alignment with lug 413, port 425 is temporarily closed, and when port 425 rotates out of circumferential alignment with lug 413, port 425 is opened. The cyclical opening and closing of port 425 generates pressure pulses in the drilling fluid upstream of valve 400. The pressure pulses travel through the drilling fluid in power section 500 to shock tool 92. In this manner, the rotation of rotors 110 drive the rotation of body 420 relative to housing 410, which in turn generates cyclical pressure pulses in the drilling fluid that drive the axial reciprocation of shock tool 92.

The drilling fluid passing through port 425 flows radially inward from annulus 427 through port 425 into passage 423. Accordingly, valve 400 may also be described as a radial valve.

Figure 14:
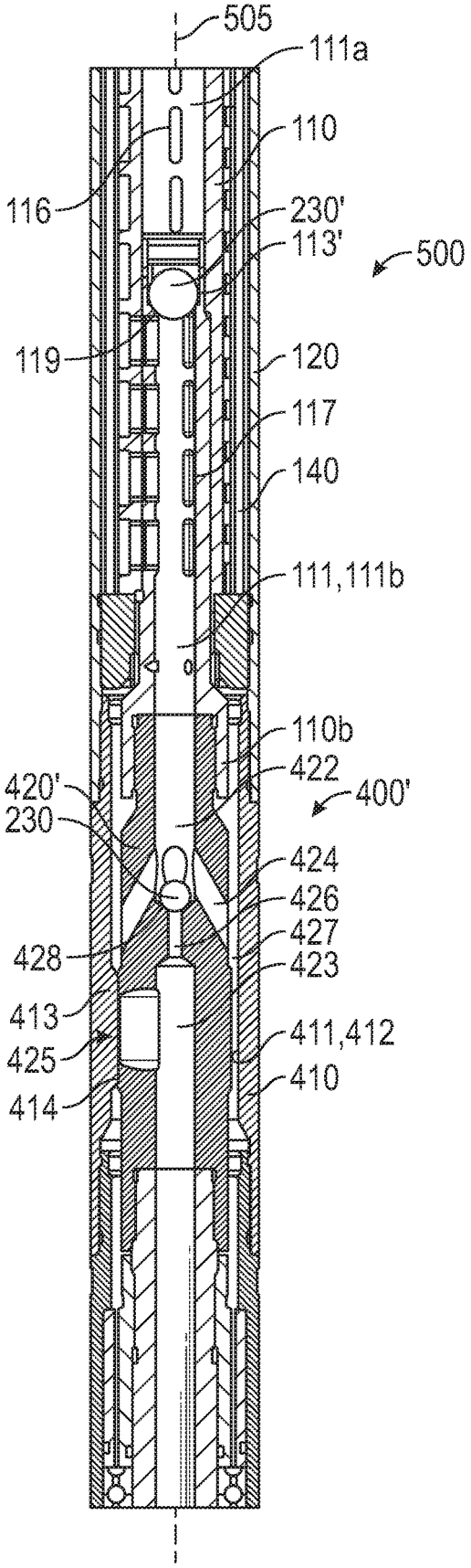
FIG. 14 is an enlarged cross-sectional view of an embodiment of a bottom mount radial valve in accordance with the principles described herein coupled to a concentric power section.

Referring now to FIG. 14, another embodiment of a bottom mount, oscillating or rotating radial valve 400' is shown coupled to power section 500 previously described. Valve 400' is substantially the same as valve 400 previously described with the exception that a throughbore extends axially between flow passages 422, 423 and a plug can be used to selectively block flow between passages 422, 423. Thus, valve 400' includes a first valve member or outer housing 410 and a second valve member or body 420' rotatably disposed within housing 410. Body 420' is concentrically disposed within housing 410, and further, body 420' and housing 410 are coaxially aligned with rotor 110 and stator 120 of power section 500. In other words, body 420' and housing 410 have central axes that are coaxially aligned with axis 105. Housing 410 is as previously described. Body 420' is substantially the same as body 420 previously described with the exception that a throughbore 426 extends axially between flow passages 422, 423. A plug 230 can be used to selectively block flow between passages 422, 423 via throughbore 426. In particular, the lower end of flow passage 422 defines a seat 428 for plug 230, which is a ball in this embodiment. Seat 428 is positioned axially below the inlets to ports 424 from flow passage 422.

Throughbore 426 and plug 230 can be used to selectively increase the amplitude and height of the pressure pulses generated by valve 400'. In particular, when plug 230 is not seated in flow passage 422 against seat 428, drilling fluid flowing through passage 422 is free through bore 426 directly into passage 423 or through ports 424 into annulus 427. Thus, the drilling fluid flowing through passage 422 is divided into a first portion that flows through ports 424 into annulus 427 and a second portion that flows from passage 422 directly into passage 423 via throughbore 426. The drilling fluid in annulus 427 flows through port 425, which is cyclically opened and closed with lug 413 by rotation of rotation of body 420 as previously described to generate pressure pulses. However, the drilling fluid flowing from passage 422 directly into passage 423 via throughbore 426 bypasses port 425, and thus, does not contribute to the generation of pressure pulses. It should be appreciated that the diameter of throughbore 426 can be adjusted (e.g., with nozzles having different sized orifices) to adjust the relative quantity of drilling fluid drilling fluid flowing through annulus 427 and port 425 versus bypassing port 425 via throughbore 426. However, when plug 230 is seated in flow passage 422 against seat 428, throughbore 426 is blocked and drilling fluid is restricted and/or prevented from flowing therethrough, thereby increasing the relative quantity of drilling fluid directed into annulus 427 and port 425 (when throughbore 426 is blocked, essentially all of the drilling fluid is directed into annulus 427 and port 425). In other words, when plug 230 is seated in against seat 428, none of the drilling fluid can bypass port 425 via throughbore 426.

Figure 15:
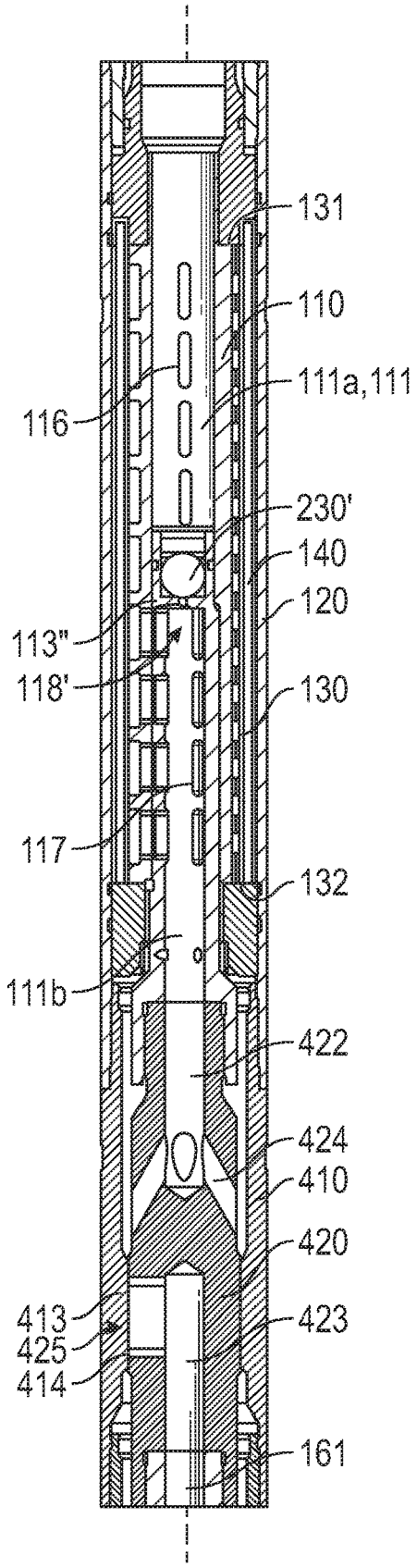
FIG. 15 is an enlarged cross-sectional view of an embodiment of a bottom mount radial valve in accordance with the principles described herein coupled to a concentric power section.

In the embodiment of power section 500 previously described and shown in FIGS. 10 and 11, central throughbore 118 of plug seat 113' is substantially full bore, meaning the diameter of throughbore 118 is substantially the same or only slightly less than (e.g., within 10%) the diameter of throughbore 111 of rotor 110 within which plug seat 113' is disposed. Thus, when plug 230' is not seated in plug seat 113', substantially all of the drilling fluid flowing through rotor 110 flows directly from upstream region 111*a* into downstream region 111*b* via throughbore 118. However, in other embodiments, the plug seat disposed in throughbore 111 of rotor 110 may comprise a flow restricting orifice that limits the quantity of drilling fluid that bypasses working fluid space 130. For example, in FIG. 15, plug seat 113' having a full bore throughbore 118 is replaced with a plug seat 113" having a restricted throughbore 118'. As a result, when plug 230' is not seated in plug seat 113", the restrictive throughbore 118' forces a portion of the drilling fluid flowing down upstream region 111*a* into working fluid chamber 130, thereby driving the rotation of rotor 110. When plug 230' is seated in plug seat 113", throughbore 118' is closed and drilling fluid is prevented from flowing therethrough, thereby forcing all of the drilling fluid flowing down upstream region 111*a* of throughbore 111 into working fluid space 130, thereby driving the rotation of rotor 110. Thus, with or without plug 230' seated in seat 113", drilling fluid is supplied to working fluid space 130 to drive rotation of rotor 110. However, the seating of plug 230' in seat 113" increases the relative quantity of drilling fluid flowing through working fluid space 130, thereby increasing the rotational speed of rotor 110. Without being limited by this or any particular theory, the increased rotational speed of rotor 110 generates increased power and increased frequency of pressure pulses generated. In this manner, plug 230' can be used to selectively increase the rotational speed of rotor 110, increase the power output of power section 500, and increase the frequency of pressure pulses generated by valve 400'.

In the embodiment of valve 400' and power section 500 shown in FIG. 14 and described above, power section 500 can be fished through prior to actuation via seating of plug 230' in plug seat 113'. Although throughbore 426 is coaxially aligned with throughbore 111 and passages 422, 423, it may be challenging to fish through valve 400' because throughbore 426 does not have a full bore diameter (e.g., the diameter of throughbore 426 is substantially less than the diameter of passages 422, 423 extending axially therefrom). Moreover, since each plug 230, 230' is a ball that is generally not retrievable, once plug 230' is seated in the corresponding seat 113', the ability to fish through power section 500 is limited and/or prevented; and once plug 230 is seated in seat 428, the ability to fish through valve 400' is limited and/or prevented. However, in other embodiments, the plugs used to actuate power section 500 and the bottom mount valve coupled thereto (e.g., valve 400') are specifically designed to be retrievable, thereby allowing fish through capability prior to and after actuation of power section 500 and the bottom mount valve coupled thereto. For example, FIG. 16 illustrates power section 500 as previously described and a bottom mount valve 400" in connection with retrievable plugs 230", 330 (and associated connection member 337) as previously described.

In this embodiment, reduced diameter throughbore 426 is replaced with a full bore diameter passage. In particular, plug seat 428 is positioned along flow passage 422 below ports 424, however, a throughbore 426' with a full diameter bore extends axially from seat 428 and flow passage 422 to flow passage 423. In this embodiment, and as previously described, plug 330 is a dart and plug 230" is a ball hung or suspended from plug 330 with elongate connection member 337.

Figure 16:
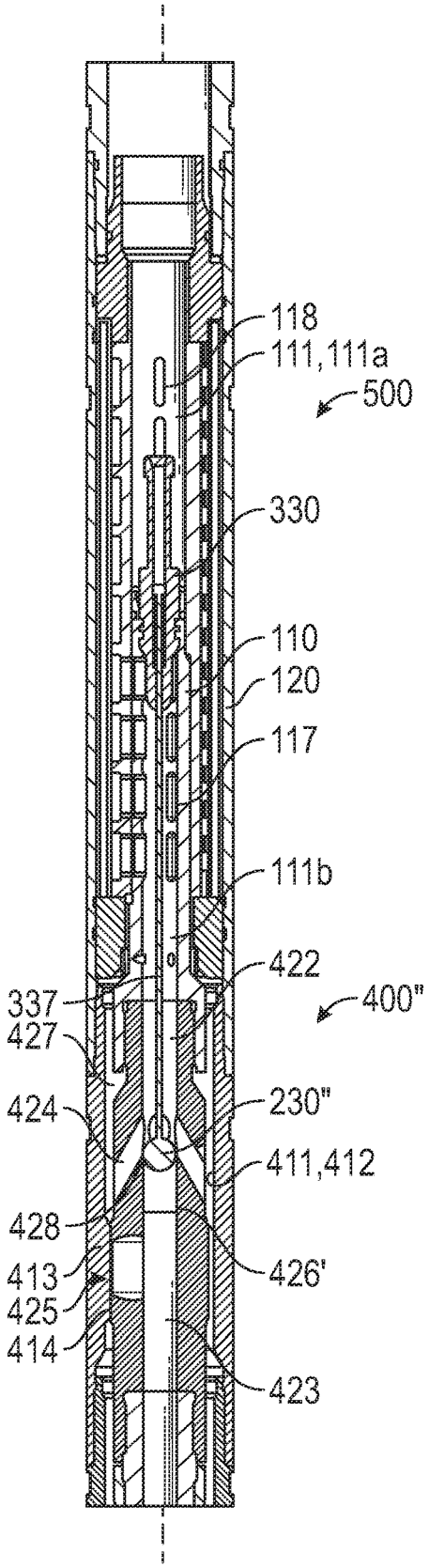
FIG. 16 is an enlarged cross-sectional view of an embodiment of a bottom mount radial valve in accordance with the principles described herein coupled to a concentric power section.

Referring still to FIG. 16, plug seat 113' allows for the selective actuation of power section 500 in the same manner as previously described. Namely, when plug 230" is not seated in plug seat 113', drilling fluid is free to flow through plug seat 113' with little to no restriction due to throughbore 118 having a full bore diameter. As a result, the drilling fluid flowing through bore 111 and plug seat 113' bypasses working fluid space 130 of power section 500 and does not drive the rotation of rotor 110. However, when plug 230" is seated in plug seat 113', throughbore 118 is closed and drilling fluid is prevented from flowing therethrough. As a result, all of the drilling fluid flowing down upstream region 111*a* of throughbore 111 is forced into working fluid space 130, thereby driving the rotation of rotor 110 of power section 500.

Plug seat 428 allows for the selective actuation or at least selective increase in the amplitude and height of the pressure pulses generated by valve 400". In particular, when plug 330 is not seated in plug seat 428, drilling fluid is free to flow through throughbore 426' with little to no restriction due to throughbore 426' having a full bore diameter. In other words, the drilling fluid can flow directly from passage 422 into passage 423 via throughbore 426'. As a result, most or substantially all of the drilling fluid flowing down drillstring 22 bypasses annulus 427 and port 425. Consequently, amplitude and height of the pressure pulses generated by valve 400", if any, is relatively small, and hence, induces little to no axial reciprocation of shock tool 92. However, when plug 330 is seated in plug seat 428, throughbore 426' is closed and direct fluid communication between passages 422, 423 is prevented. As a result, all of the drilling fluid flowing down drillstring 22 is forced into annulus 427 and port 425, thereby "turning on" or at least increasing the amplitude and height of the pressure pulses generated by valve 400".

In the embodiment shown in FIG. 16, plugs 230", 330 are coupled via connection member 337, and thus, are dropped from the surface down drillstring 22 together, with plug 230" hung from plug 330 as previously described. Connection member 337 has a length selected such that both plugs 230", 330 are seated in corresponding seats 113', 428 at the same time. Plugs 230", 330 can be retrieved from the surface to allow fish through capability for both valve 400" and power section 500 after actuation of valve 400" and stage power section 500. As previously described, to retrieve plugs 230", 330, a fishing tool is lowered from the surface through drillstring 22 to plug 330, the fishing tool engages mating fishing-neck 334 at upper end 330*a*, and then the fishing tool is pulled back to the surface. Due to the positive engagement of the fishing tool and fishing-neck 334, plug 330 is pulled from seat 113' and retrieved to the surface with the fishing tool; and since upper end 337*a* of connection member 337 cannot be pulled through bore 332, plug 230" is pulled from seat 428 and retrieved to the surface with the fishing tool and plug 330. In general, the fishing tool used to retrieve plugs 230", 330 can be any fishing tool known in the art. Once plugs 230", 330 are retrieved to the surface, valve 400" and power section 500 can be fished through. Following the fish through operation, plugs 230", 330 can be dropped down drillstring 22 form the surface and reseated in corresponding seats 113', 428.

Embodiments of valves 200, 200', 300, 400, 400', 400" used in connection with concentric rotary drive systems described herein are radial valves that cyclically vary the radial flow of drilling fluid to generate pressure pulses for operating a shock tool (e.g., shock tool 92). However, in other embodiments, axial valves can be used in connection with concentric rotary drive systems. As described above, axial valves cyclically vary the axial flow of drilling fluid (e.g., flow generally parallel to the central axis of the valve and the power section) to generate pressure pulses for operating a shock tool (e.g., shock tool 92).

Figure 17:
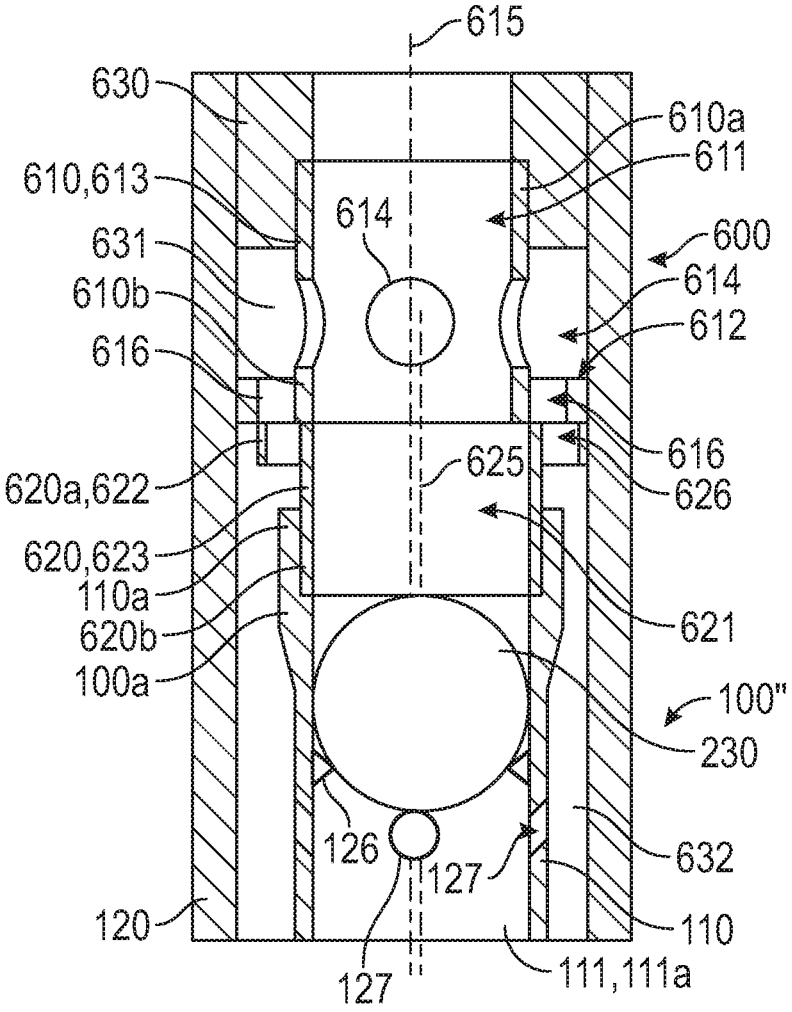
FIG. 17 is an enlarged cross-sectional view of an embodiment of a top mount axial valve in accordance with the principles described herein coupled to a concentric power section.

Referring now to FIG. 17, an embodiment of an oscillating or rotary axial valve 600 is shown coupled to a power section 100". Power section 100" is substantially the same as power section 100 previously described with the exception that rotor 110 of first stage 101 includes an annular plug seat 126 and a plurality of circumferentially-spaced ports 127. Seat 126 is axially positioned proximal upper end 110*a* and is sized and arranged to receive a plug 230, which in this embodiment is a ball. Ports 127 extend radially through rotor 110 from the outer surface of rotor 110 to upstream region

111*a* of central throughbore 111. In addition, ports 127 are axially adjacent and below seat 126.

In this embodiment, valve 600 is coupled to upper end 100*a* of power section 100", and thus, valve 600 is a top mount valve. In general, valve 600 is operated by the rotation of rotor 110 to selectively generate pressure pulses in the drilling fluid upstream of power section 100". The pressure pulses generated by valve 600 drive the axial reciprocation of shock tool 92 (FIG. 1). In this embodiment, valve 600 includes a first or upper valve member 610 fixably coupled to stator 120 and a second or lower valve member 620 fixably coupled to upper end 110*a* of rotor 110. Although valve member 610 and stator 120 are fixably coupled in this embodiment, in other embodiments, the upper valve member (e.g., valve member 610) and the stator (e.g., stator 120) are coupled via a splined connection that allows relative axial movement but not relative rotational movement. As previously described, rotor 110 rotates relative to stator 120, and thus, lower valve member 620 rotates with rotor 110 relative to upper valve member 610. Accordingly, upper valve member 610 may also be referred to as a static or stationary valve member and lower valve member 620 may also be referred to as a rotating or oscillating valve member.

Figure 18:
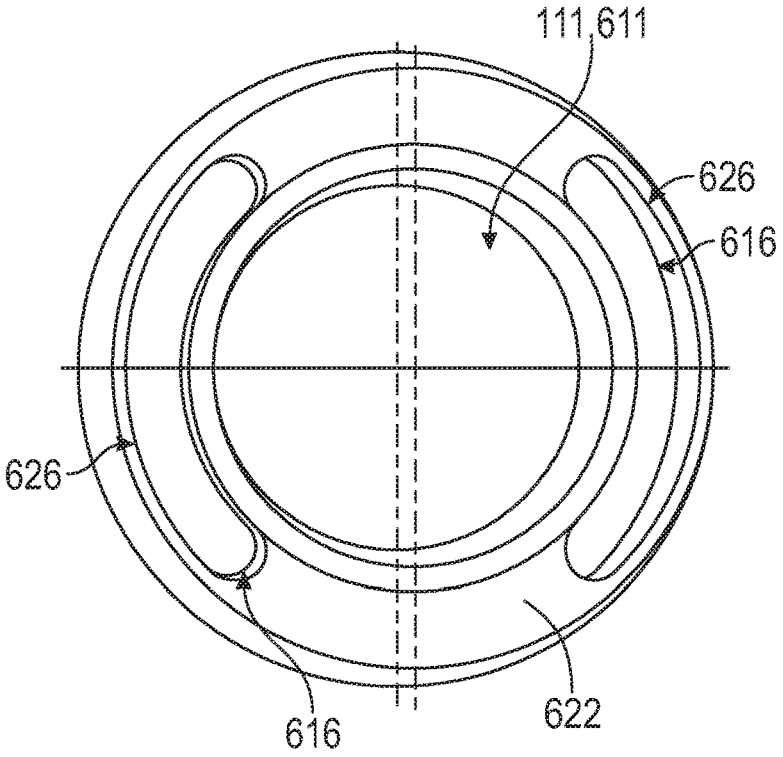
FIG. 18 is bottom view of the radial valve of FIG. 17 with the ports of the upper valve member open.
Figure 19:
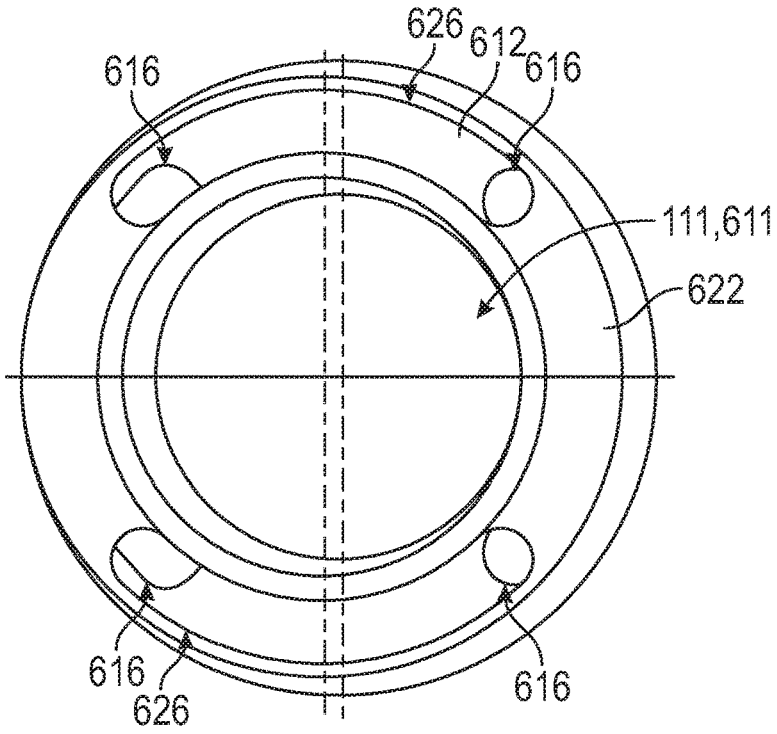
FIG. 19 is bottom view of the radial valve of FIG. 17 with the ports of the upper valve member substantially closed.

Upper valve member 610 has a central or longitudinal axis 615, a first or upper end 610*a*, a second or lower end 610*b*, and a central throughbore 611 extending axially between ends 610*a*, 610*b*. In addition, upper valve member 610 includes an annular flange or valve plate 612 at lower end 610*b* and a tubular sleeve 613 extending axially from plate 612 to upper end 610*a*. Throughbore 611 extends through both sleeve 613 and plate 612. Upper end 610*a* includes external threads that threadably engaging mating internal threads in the bottom of a sub 630 fixably coupled to stator 120. Sleeve 613 includes plurality of circumferentially-spaced ports 614 extending radially from the radially outer surface of sleeve 613 to throughbore 611. As best shown in FIGS. 17-19, annular plate 612 includes a plurality of circumferentially-spaced flow ports 616 extending axially therethrough. In this embodiment, two flow ports 616 spaced 180° apart are provided, and further, each flow port 616 is an elongate throughbore having terminal ends 616*a*, 616*b* that are angularly-spaced about 100° apart.

Referring again to FIG. 17, lower valve member 620 has a central or longitudinal axis 625, a first or upper end 620*a*, a second or lower end 620*b*, and a central throughbore 621 extending axially between ends 620*a*, 620*b*. In this embodiment, axis 625 of lower valve member 620 is parallel to but radially offset from axis 615 of upper valve member 610 to further choke flow. However, in other embodiments, the central axes of the upper and lower valve members (e.g., axes 615, 625 of valve members 610, 620) are coaxially aligned. In addition, lower valve member 620 includes an annular flange or valve plate 622 at upper end 620*a* and a tubular sleeve 623 extending axially from plate 622 to lower end 620*a*. Throughbore 621 extends through both sleeve 623 and plate 622. Lower end 620*b* includes external threads that threadably engaging mating internal threads in upper end 110*a* of rotor 110. As best shown in FIGS. 17-19, annular plate 622 includes a plurality of circumferentially-spaced flow ports 626 extending axially therethrough. In this embodiment, two flow ports 626 spaced 180° apart are provided, and further, each flow port 626 is an elongate throughbore having terminal ends 626*a*, 626*b* that are angularly-spaced about 100° apart.

As best shown in FIG. 17, ends 610*b*, 620*a* and corresponding plates 612, 622 are axially biased into engagement with each other. In addition, annular plate 612 extends radially outward from sleeve 613 and slidingly engages inner surface 122 of stator 120. In particular, the radially outer cylindrical surface of sleeve 613 is disposed at substantially the same radius as inner surface 122. A first or upper annulus 631 is radially positioned between sleeve 613 and stator 120 axially above plate 612, and a second or lower annulus 632 is radially positioned between stator 120 and sleeve 623. Annulus 632 extends axially downward between upper end 110*a* of rotor 110 and stator 120. As best shown in FIGS. 18 and 19, ports 616, 626 are disposed at substantially the same radii. Accordingly, as rotor 110 and lower valve member 620 coupled thereto rotate relative to stator 120 and upper valve member 610 coupled thereto, ports 626 rotate into and out of circumferential alignment with ports 616.

Referring again to FIG. 17, during drilling operations, drilling fluid is pumped down drillstring 22 to power section 100". At least initially, plug 230 is not disposed in plug seat 126, and thus, drilling fluid is free to flow axially through bores 611, 621 and directly into throughbore 111 of rotor 110. It should be appreciated that in this embodiment, throughbores 611, 621 have substantially full bore diameters (e.g., each has a diameter within 10% of diameter of throughbore 111), and thus, when plug 230 is not seated in plug seat 126, there is little resistance to the axial flow of drilling fluid through bores 611, 621, 111. Consequently, substantially all or all of the drilling fluid flows axially from throughbores 611, 621 into and through bore 111, and little to none of the drilling fluid passes annuli 631, 632. Thus, the drilling fluid effectively bypasses valve 600. The drilling fluid flowing downstream into rotor 110 drives the rotation of rotors 110 of stages 101, 102 as previously described. The drilling fluid bypassing valve 600 does not contribute to the generation of pressure pulses for driving the axial reciprocating of shock tool 92.

Plug seat 126 and corresponding plug 230 enable the selective ability to actuate valve 600 to generate pressure pulses. In particular, when plug 230 is seated in plug seat 126, throughbore 111 is blocked at upper end 110*a* and drilling fluid is restricted and/or prevented from flowing axially from bores 611, 621 into throughbore 111 of rotor 110. As a result, the drilling fluid flowing through bore 611 flows radially outward through ports 614 of upper valve member 610 into upper annulus 631, then flow axially from upper annulus 631 to lower annulus 632 via ports 616, 626, and then flows radially from lower annulus 632 into throughbore 111 via ports 127. This increases the quantity of drilling fluid directed into annuli 631, 632 and ports 616, 626 (when throughbore 111 is blocked at upper end 110*a* of rotor 110, essentially all of the drilling fluid is directed into annuli 631, 632 and ports 616, 626). In other words, when plug 230 is seated in plug seat 126, none of the drilling fluid can bypass valve 600. The drilling fluid entering throughbore 111 below plug 230 flows downstream through rotor 110 drives the rotation of rotors 110 of stages 101, 102 as previously described.

As previously described, valve member 620 is fixably coupled to rotors 110, and thus, valve member 620 rotates with rotors 110 relative to valve member 610. Rotation of valve member 620 results in the cyclically opening and closing of ports 616—when ports 626 rotate into alignment with ports 616, ports 616 are opened and fluid can flow through aligned ports 616, 626, and when ports 626 rotate out of alignment with ports 616, ports 616 are closed and fluid is restricted and/or prevented from flowing through ports 616. Thus, when drilling fluid is flowing through annuli 631, 632 and ports 616, 626 (e.g., when plug 230 is seated in plug seat 126), the cyclical opening and closing of ports 616 generates pressure pulses in the drilling fluid upstream of valve 600—when ports 616 are closed, the pressure of drilling fluid immediately upstream of valve 600 increases, and when ports 616 are open, the pressure of the drilling fluid immediately upstream of valve 600 decreases. In this manner, the rotation of rotors 110 drive the rotation of valve member 620 relative to valve member 610, which in turn generates cyclical pressure pulses in the drilling fluid that drive the axial reciprocation of shock tool 92.

It should be appreciated that the full bore diameters of throughbores 611, 621 and coaxial alignment of throughbores 611, 621 with power section 100" enables fish through capability prior to actuation of valve 600 with plug 230. Although plug 230 is a ball in this embodiment, in other embodiments, the plug used to actuate valve 600 is a dart (e.g., plug 330) that can be retrieved to the surface following actuation of valve 600 to enable fish through capability.

Although axial valve 600 is configured as a top mount valve in FIG. 17, in other embodiments, axial valves (e.g., valve 600) used in connection with concentric rotary drive systems are arranged as bottom mount valves.

In select embodiments of rotary valves described herein, the valve can be actuated or "turned on" to generate pressure pulses that induce axial reciprocation of a shock tool (e.g., shock tool 92). In such embodiments, the valve is actuated with a plug to selectively induce axial reciprocation of the shock tool when desired (e.g., valve 600 is actuated by seating plug 230 in plug seat 126). However, in other embodiments, the valve is actuated by mechanisms or means other than a plug. For example, referring now to FIGS. 20 and 21, an embodiment of a valve 700 that is actuated by axial movement is shown. Valve 700 is shown coupled to a power section 100". Power section 100'" is substantially the same as power section 100 previously described with the exception that rotor 110 of first stage 101 includes a plurality of circumferentially-spaced ports 127 proximal upper end 110*a*. Ports 127 extend radially through rotor 110 from the outer surface of rotor 110 to upstream region 111*a* of central throughbore 111.

Figure 20:
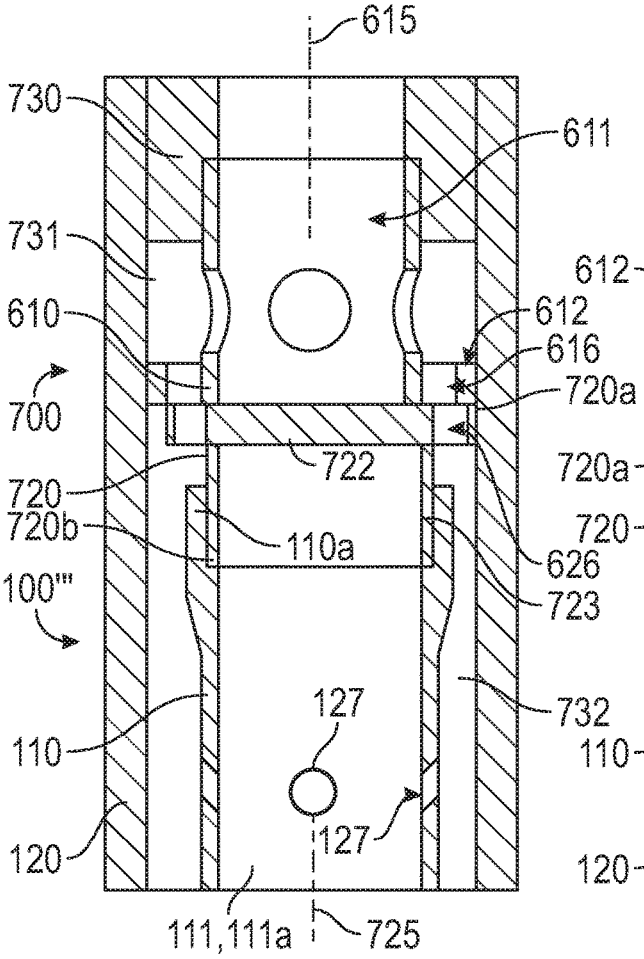
FIG. 20 is an enlarged cross-sectional view of an embodiment of a top mount axial valve in accordance with the principles described herein coupled to a concentric power section and with the valve in an actuated position.
Figure 21:
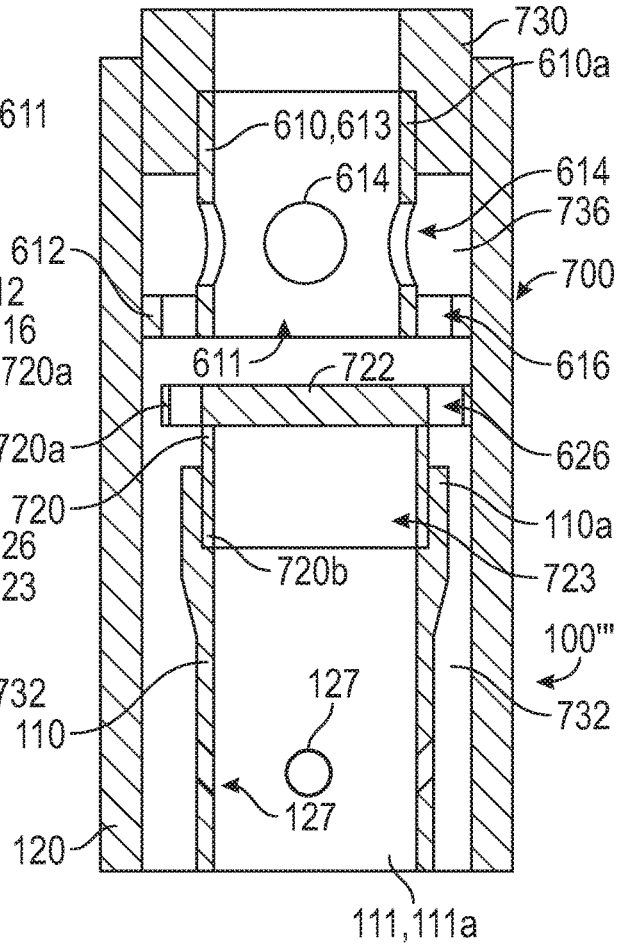
FIG. 21 is an enlarged cross-sectional view of an embodiment of the top mount axial valve of FIG. 20 with the valve in an bypass position.

Referring still to FIGS. 20 and 21, valve 700 is substantially the same as valve 600 previously described with the exception that the throughbore of the lower valve member is closed at its upper end and valve 700 is actuated by relative axial movement of the upper and lower valve members. More specifically, valve 700 includes a first or upper valve member 610 as previously described and second or lower valve member 720. Upper valve member 610 is fixably coupled to a connection member 730 that is axially movable relative to stator 120. Thus, upper valve member 610 can be moved axially relative to stator 120 and lower valve member 720. In general, connection member 730 and upper valve member 610 can be moved axially by any suitable means known in the art. Exemplary devices that can be used to selectively move connection member 730 and upper valve member 610 relative to lower valve member 720 and stator 120 are disclosed in U.S. Pat. Nos. 8,863,852 and 8,844,634, each of which is hereby incorporated herein by reference in its entirety.

Lower valve member 720 has a central or longitudinal axis 725, a first or upper end 720*a*, and a second or lower end 720*b*. In addition, lower valve member 720 includes a cylindrical valve plate 722 at upper end 720*a* and a tubular sleeve 723 extending axially from plate 722 to lower end 720*b*. Lower end 720*b* includes external threads that threadably engaging mating internal threads in upper end 110*a* of rotor 110. Annular plate 722 includes a plurality of circumferentially-spaced flow ports 626 as previously described extending axially therethrough. In this embodiment, two flow ports 626 spaced 180° apart are provided, and further, each flow port 626 is an elongate throughbore having terminal ends that are angularly-spaced about 100° apart.

A first or upper annulus 731 is radially positioned between sleeve 613 and stator 120 axially above plate 612, and a second or lower annulus 732 is radially positioned between stator 120 and sleeve 723. Annulus 732 extends axially downward between upper end 110*a* of rotor 110 and stator 120.

Valve 700 is coupled to upper end 100*a* of power section 100'", and thus, valve 700 is a top mount valve. In general, valve 700 is selectively actuated or "turned on" to generate pressure pulses in the drilling fluid upstream of power section 100" by moving plates 612, 722 axially together as shown in FIG. 20, and is selectively de-actuated or "turned off" by moving plates 612, 722 axially apart as shown in FIG. 21. More specifically, with plates 612, 722 in axial engagement (FIG. 20), drilling fluid pumped down drillstring to power section 100'" flows through bore 611 but cannot flow axially into sleeve 723 of lower valve member 720 as plate 722 blocks flow into sleeve 723. As a result, the drilling fluid flowing through bore 611 flows radially outward through ports 614 of upper valve member 610 into upper annulus 731, then flow axially from upper annulus 731 to lower annulus 732 via ports 616, 626, and then flows radially from lower annulus 732 into throughbore 111 via ports 127. The drilling fluid entering throughbore 111 flows downstream through rotor 110 drives the rotation of rotors 110 of stages 101, 102 as previously described. Valve member 720 is fixably coupled to rotors 110, and thus, valve member 720 rotates with rotors 110 relative to valve member 610. Rotation of valve member 720 results in the cyclically opening and closing of ports 616 as previously described. Thus, when plates 612, 722 are in axial engagement, drilling fluid flowing through annuli 731, 732 and ports 616, 626 generates pressure pulses in the drilling fluid upstream of valve 700, which in turn generates cyclical pressure pulses in the drilling fluid that drive the axial reciprocation of shock tool 92.

With plates 612, 722 axially spaced apart (FIG. 21), the drilling fluid can flow through bore 611 or through ports 614, 616 into the axial gap or space 740 between plates 612, 722, and then across gap 740 and through ports 722, 127 into throughbore 111 of rotor 110. Due to the presence of gap 740, ports 616 are effectively always opened as lower member 720 rotates. Thus, the drilling fluid effectively bypasses valve 700 when plates 612, 722 are axially spaced apart. The drilling fluid flowing downstream into rotor 110 drives the rotation of rotors 110 of stages 101, 102 as previously described. The drilling fluid bypassing valve 700 does not contribute to the generation of pressure pulses for driving the axial reciprocating of shock tool 92.

Figure 22:
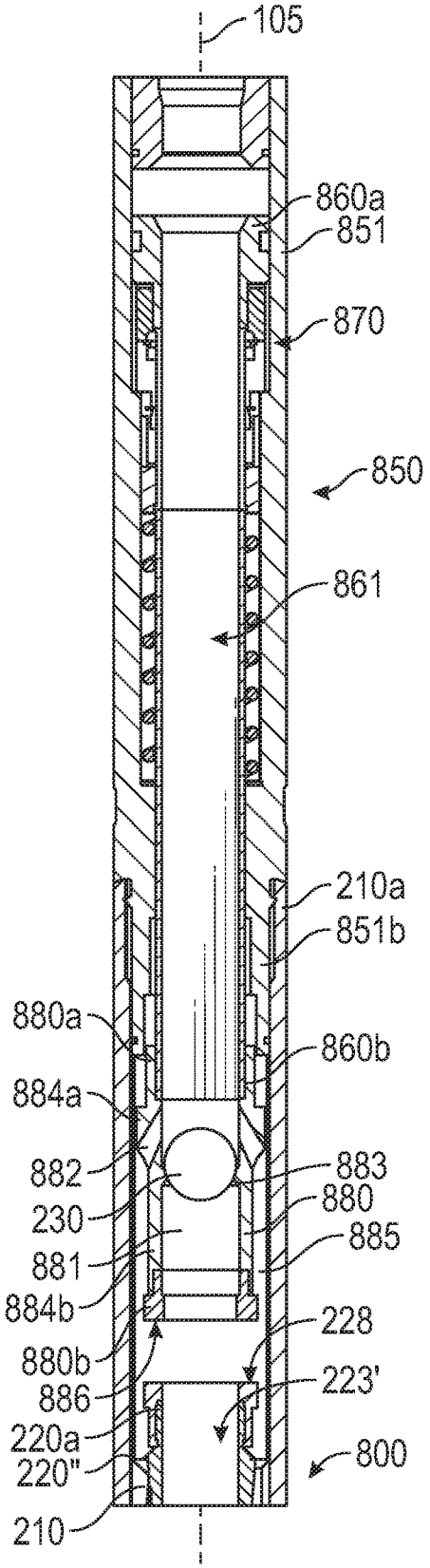
FIG. 22 is an enlarged cross-sectional view of an embodiment of a top mount radial valve in accordance with the principles described herein selectively de-actuated by an axial actuation device.
Figure 23:
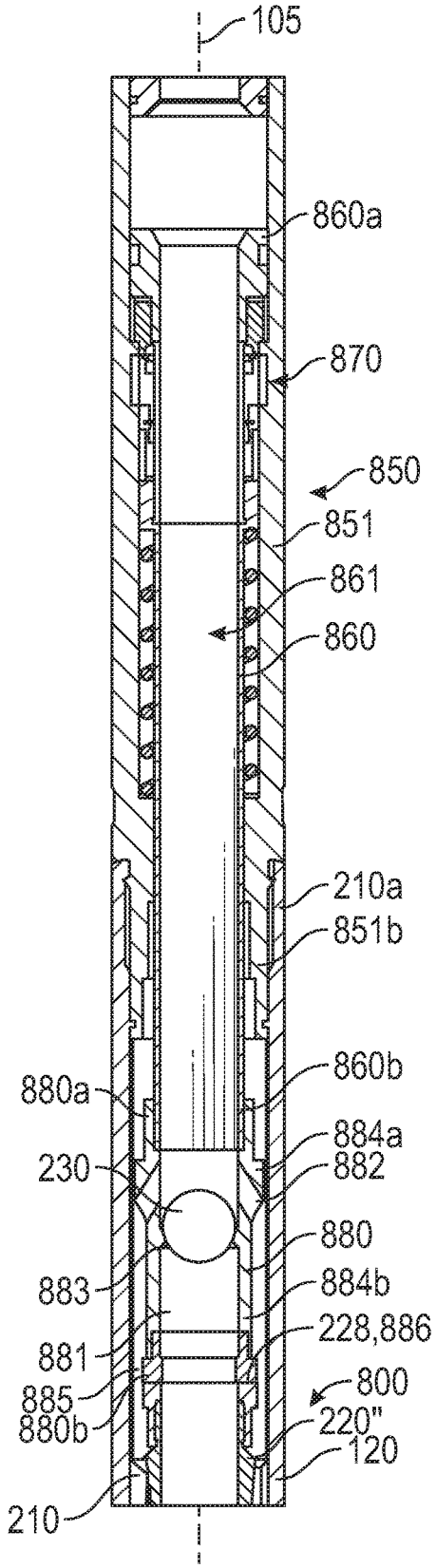
FIG. 23 is an enlarged cross-sectional view of the top mount radial valve of FIG. 22 selectively actuated by an axial actuation device.

Referring now to FIGS. 22 and 23, another embodiment of a top mount radial valve 800 that is selectively actuated by axial movement is shown. Valve 800 is coupled to the upper end of a power section 100' (not shown) as previously described. In this embodiment, valve 800 is substantially the same as valve 300 previously described. In particular, valve 800 includes a first valve member or outer housing 210 coupled to the upper end 120*a* of stator 120 (not shown) and a second valve member or body 220" coupled to upper end 110*a* of rotor 110 (not shown). Thus, valve member 220" is rotatably disposed within housing 210. Body 220" is concentrically disposed within housing 210, and further, body 220" and housing 210 are coaxially aligned with rotor 110 and stator 120 of power section 100'. In other words, body 220" and housing 210 have central axes that are coaxially aligned with axis 105. Housing 210 is as previously described with respect to valve 200. Body 220" is substantially the same as valve member 220' previously described with the exception that no plug seat (e.g., plug seat 226) is provided along passage 223', and further, an uphole facing, planar annular sealing surface 228 is disposed at upper end 220*a*.

An axial actuation device 850 for selectively actuating valve 800 is coupled to upper end 210*a* of outer housing 210. As will be described in more detail below, actuation device 850 allows for the selective actuation, or at least selective increase in the amplitude and height of the pressure pulses generated by valve 800. In this embodiment, actuation device 850 includes an outer housing 851, a mandrel 860 moveably disposed in housing 851, and an indexing mechanism 870 positioned between mandrel 860 and housing 851. Mandrel 860 and housing 851 are coaxially aligned with valve 800 and power section 100'. Housing 851 has a lower end 851*b* threadably coupled to upper end 210*a* of outer housing 210 and an upper end (not shown) coupled to shock tool 92 and drill string 22. Mandrel 860 has a first or upper end 860*a*, a second or lower end 860*b*, and a central throughbore 861 extending axially therethrough. As will be described in more detail below, indexing mechanism 870 allows mandrel 860 to actuate or move axially relative to housing 851 in response to the flow rate and associated pressures of drilling fluid flowing through mandrel 860.

Referring still to FIGS. 22 and 23, a ported piston 880 is fixably attached to mandrel 860, and thus, moves axially with mandrel 860. Ported piston 880 has a first or upper end 880*a* threadably coupled to lower end 860*b* of mandrel 860, a second or lower end 880*b* distal mandrel 860, a central throughbore 881 extending axially from upper end 880*a* to lower end 880*b*, and a plurality of circumferentially-spaced ports 882 extending radially from throughbore 881 to an outer surface of piston 880. An annular plug seat 883 is disposed along throughbore 881 axially below ports 882. In addition, piston 880 has an upper portion 884*a* with an enlarged outer diameter and a lower portion 884*b* with a reduced outer diameter. Upper portion 884*a* slidingly and engages housing 851. Lower portion 884*b* of piston 880 extends from lower end 880*b* to upper portion 884*a* and is radially spaced from housing 210. As a result, an annulus 885 is radially positioned between lower portion 884*b* and housing 851, and extends axially from lower end 880*b* to upper portion 884. Ports 882 extend from throughbore 881 to annulus 885. In this embodiment, lower end 880*b* comprises a downhole facing, planar annular sealing surface 886.

Device 850 is actuated to move mandrel 860 and piston 880 axially up and down relative to housing 851 and body 220" to bring sealing faces 886, 228 into and out of engagement. In this embodiment, indexing mechanism 870 allows mandrel 860 to move axially in response to the flow rate and associated pressures of drilling fluid flowing therethrough. More specifically, plug seat 883 is sized and positioned to receive a plug 230. When plug 230 is not disposed in seat 883, drilling fluid can flow axially through throughbores 861, 881 with little resistance and mandrel 860 is maintained in a position with surfaces 228, 886 axially spaced apart. However, when plug 230 is dropped from the surface and seats in seat 883, it blocks free flow through throughbore 881, chokes the flow rate through mandrel 860, and generates a pressure differential across mandrel 860 that moves mandrel 860 axially downward, thereby bringing surfaces 228, 886 into engagement. Indexing mechanism 870 can be reset to lift mandrel 860 upward and bring surfaces 228, 886 out of engagement by temporarily reducing the flow rate of drilling fluid down the drill string 22 and through device 850, thereby decreasing the pressure differential across mandrel 860. Examples of indexing mechanisms that can be used in device 850 to facilitate the axial movement of mandrel 860 in response to the flow rate and associated pressures of drilling fluid flowing through mandrel 860 are disclosed in U.S. Pat. Nos. 8,863,852 and 8,844,634, each of which is hereby incorporated herein by reference in its entirety.

As previously described, device 850 is actuated to bring sealing face 886 into and out of engagement with mating sealing face 228 disposed at upper end 220*a*. This allows device 850 to controllably open and close the open upper end 220*a* of valve member 220" to selectively distribute drilling fluid between passage 223' and annulus 227. When plug 230 is not disposed in seat 883, drilling fluid can flow through throughbores 861, 881, across any gap between ends 220*a*, 860*b*, and directly into passage 223' at upper end 220*a*. Due to passage 223' having a full bore diameter, the drilling fluid is free to flow through passage 223' with little to no restriction, thereby bypassing annulus 227 and port 224. Consequently, the amplitude and height of the pressure pulses generated by valve 800, if any, is relatively small, and hence, induces little to no axial reciprocation of shock tool 92. When plug 230 is disposed in seat 883 but surfaces 228, 886 are axially spaced apart (e.g., prior to actuation of mandrel 860 or upon reset of indexing mechanism 870), drilling fluid can flow through throughbore 861 and into throughbore 881, then out ports 882 into annulus 885, through annulus 885 and any gap between ends 220*a*, 860*b*, and into passage 223' at upper end 220*a*. Due to passage 223' having a full bore diameter, the drilling fluid is free to flow through passage 223' with little to no restriction, thereby bypassing annulus 227 and port 224. Consequently, the amplitude and height of the pressure pulses generated by valve 800, if any, is relatively small, and hence, induces little to no axial reciprocation of shock tool 92. However, when plug 230 is seated in seat 883 and mandrel 860 is actuated to bring surfaces 228, 886 into engagement, the drilling fluid flows through throughbore 861 and into throughbore 881, and then out ports 882 into annulus 885. Engagement of surfaces 228, 886 prevents or substantially restricts the drilling fluid in annulus 885 from passing into passage 223' at upper end 220*a*. Consequently, all of the drilling fluid flowing down drillstring 22 is forced from annulus 885 into annulus 227 and port 224, thereby "turning on" or at least increasing the amplitude and height of the pressure pulses generated by valve 800. The pressure pulses generated by valve 800 actuate shock tool 92.

Figure 24:
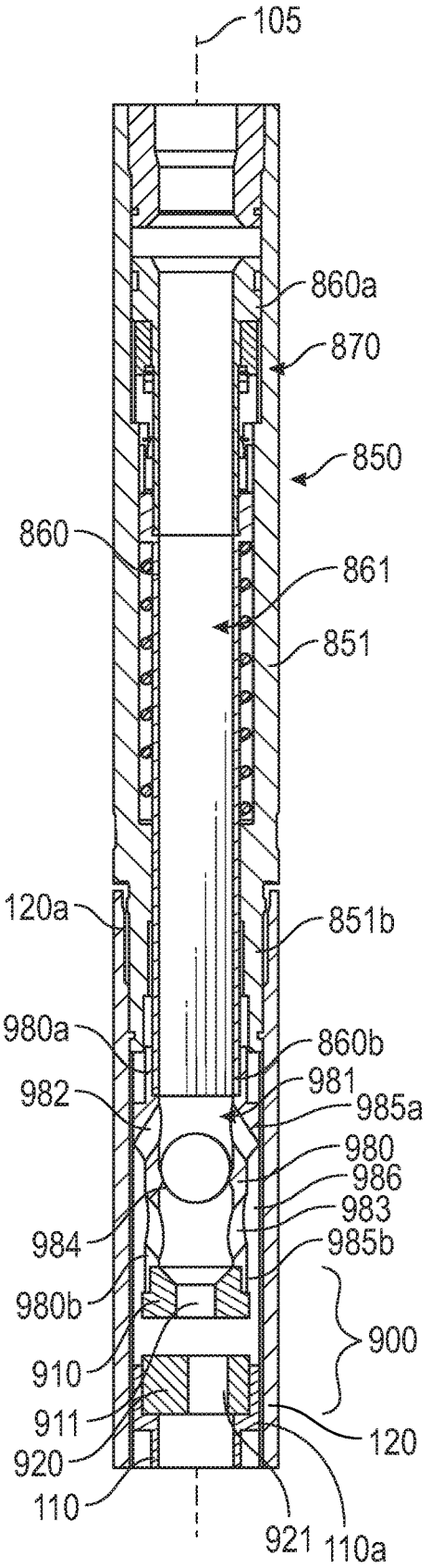
FIG. 24 is an enlarged cross-sectional view of an embodiment of a top mount axial valve in accordance with the principles described herein selectively de-actuated by an axial actuation device.
Figure 25:
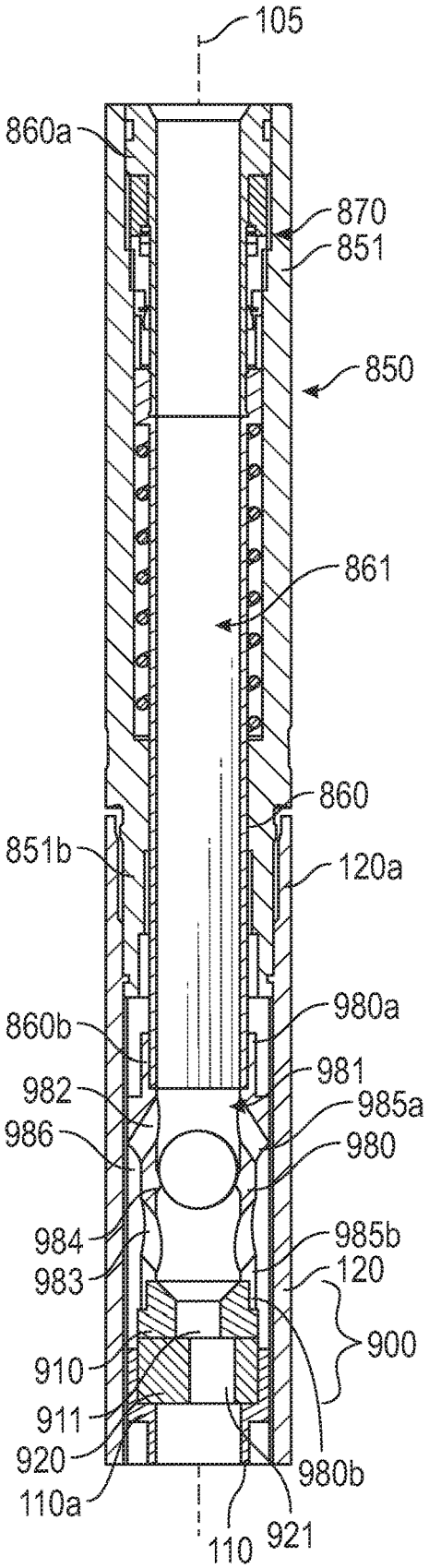
FIG. 25 is an enlarged cross-sectional view of the top mount axial valve of FIG. 24 selectively actuated by an axial actuation device.

Referring now to FIGS. 24 and 25, another embodiment of a top mount axial valve 900 that is selectively actuated by axial movement is shown. Valve 900 is coupled to the upper end of a power section 100' as previously described. An axial actuation device 850 for selectively actuating valve 900 is coupled to upper end 120*a* of stator 120. Device 850 is as previously described and shown in FIGS. 22 and 23. As will be described in more detail below, actuation device 850 allows for the selective actuation, or at least selective increase in the amplitude and height of the pressure pulses generated by valve 900.

In this embodiment, valve 900 includes a first or upper valve member 910 fixably coupled to lower end 860*b* of mandrel 860 and a second or lower valve member 920 fixably coupled to upper end 110*a* of rotor 110. Thus, lower valve member 920 is rotatable relative to upper valve member 910. Valve members 910, 920 are concentrically disposed within stator 120, and further, valve members 910, 920 are coaxially aligned with rotor 110 and stator 120 of power section 100'. In other words, valve members 910, 920 have central axes that are coaxially aligned with axis 105. In addition, each valve member 910, 920 includes a throughbore or port 911, 921, respectively, extending axially therethrough. Ports 911, 921 are sized and positioned such that they come into and out of alignment as lower valve member 920 rotates relative to upper valve member 910. For example, each port 911, 921 can have an oval shape. Thus, when valve members 910, 920 are spaced apart as shown in FIG. 24, drilling fluid can flow through the full, maximum cross-sectional flow area of both ports 911, 921. However, when valve members 910, 920 are brought together with their opposed planar faces slidingly engaging, drilling fluid can only flow through the passage defined by the portions of ports 911, 921 that are aligned and in direct fluid communication. The cross-sectional flow area of that passage will cyclically increase and decrease as lower valve member 920 rotates relative to upper valve member 910, thereby generating pressure pulses in the drilling fluid flowing therethrough. Examples of valve members that can be used as valve members 910, 920 are disclosed in US Patent Application Publication No. 20010054515, which is hereby incorporated herein by reference in its entirety.

Referring still to FIGS. 24 and 25, a ported piston 980 is fixably attached to mandrel 860, and thus, moves axially with mandrel 860. Ported piston 980 has a first or upper end 980*a* threadably coupled to lower end 860*b* of mandrel 860, a second or lower end 980*b* distal mandrel 860, a central throughbore 981 extending axially from upper end 980*a* to lower end 980*b*, a first plurality of circumferentially-spaced ports 982 extending radially from throughbore 981 to an outer surface of piston 980, and a second set of circumferentially-spaced ports 983 extending radially from throughbore 981 to the outer surface of piston 980. Ports 983 are axially positioned below ports 982. An annular plug seat 984 is disposed along throughbore 981 axially between ports 982, 983. In addition, piston 980 has an upper portion 985*a* with an enlarged outer diameter and a lower portion 985*b* with a reduced outer diameter. Upper portion 985*a* slidingly and sealingly engages housing 851. Lower portion 985*b* of piston 980 extends from lower end 980*b* to upper portion 985*a* and is radially spaced from housing 210. As a result, an annulus 986 is radially positioned between lower portion 985*b* and housing 851, and extends axially from lower end 980*b* to upper portion 985*a*. Ports 982, 983 extend from throughbore 981 to annulus 986. Upper valve member 910 is threadably attached to lower end 980*b*, and thus, moves axially with piston 980 and mandrel 860.

Device 850 is actuated to move mandrel 860 and piston 980 axially up and down relative to housing 851 and power section 100' to bring the opposed planar faces of valve members 910, 910 into and out of engagement. In a similar manner as previously described, indexing mechanism 870 allows mandrel 860 to move axially in response to the flow rate and associated pressures of drilling fluid flowing therethrough. More specifically, plug seat 984 is sized and positioned to receive a plug 230. When plug 230 is not disposed in seat 984, drilling fluid can flow axially through throughbores 861, 981 and port 911 with little resistance and mandrel 860 is maintained in a position with valve members 910, 920 axially spaced apart. However, when plug 230 is dropped from the surface and seats in seat 984, it blocks free flow through throughbores 881 and port 911, chokes the flow rate through mandrel 860, and generates a pressure differential across mandrel 860 that moves mandrel 860 axially downward, thereby bringing the opposed planar faces of valve members 910, 920 into engagement. Indexing mechanism 870 can be reset to lift mandrel 860 upward and bring valve members 910, 920 out of engagement by temporarily reducing the flow rate of drilling fluid down the drill string 22 and through device 850, thereby decreasing the pressure differential across mandrel 860.

As previously described, device 850 is actuated to bring upper valve member 910 into and out of engagement with lower valve member 920. This allows device 850 to controllably and selectively force the flow of drilling fluid through both ports 911, 921. When plug 230 is not disposed in seat 984, drilling fluid can flow through throughbores 861, 981, and port 911, across any gap between valve members 910, 920, through port 921 of valve member 920, and directly into throughbore 111 of rotor 110. Due to the spacing of valve members 910, 920, the drilling fluid is free to flow through the full, maximum cross-sectional area of each port 911, 921 with little to no restriction, thereby effectively bypassing valve 900. Consequently, the amplitude and height of the pressure pulses generated by valve 900, if any, is relatively small, and hence, induces little to no axial reciprocation of shock tool 92. When plug 230 is disposed in seat 984 but valve members 910, 920 are axially spaced apart (e.g., prior to actuation of mandrel 860 or upon reset of indexing mechanism 870), drilling fluid can flow through throughbore 861 and into throughbore 981, then out ports 982 into annulus 986, through annulus 986 and any gap between valve members 910, 920 (or from annulus 986 back into throughbore 981 and out port 911 across the any gap between valve members 910, 920), and through port 921 into rotor 110. Due to the spacing of valve members 910, 920, the drilling fluid is free to flow through the full, maximum cross-sectional area of each port 911, 921 with little to no restriction, thereby effectively bypassing valve 900. Consequently, the amplitude and height of the pressure pulses generated by valve 900, if any, is relatively small, and hence, induces little to no axial reciprocation of shock tool 92. However, when plug 230 is seated in seat 984 and mandrel 860 is actuated to bring valve members 910, 920 into engagement, the drilling fluid flows through throughbore 861 and into throughbore 981, and then out ports 982 into annulus 885. Engagement of the opposed planar surfaces of valve members 910, 920 prevents or substantially restricts the drilling fluid in annulus 986 from passing directly into port 921. Consequently, all of the drilling fluid flowing down drillstring 22 is forced from annulus 986 back into throughbore 981 below plug 230 via ports 983, and then through ports 911, 921. As previously described, when valve members 910, 920 slidingly engage, the cross-sectional flow area of the passage through valve members 910, 920 through which the drilling fluid can flow will cyclically increase and decrease as lower valve member 920 rotates relative to upper valve member 910, thereby generating pressure pulses in the drilling fluid flowing therethrough. Thus, moving valve member 910 axially into engagement with valve member 920 "turns on" or at least increases the amplitude and height of the pressure pulses generated by valve 900. The pressure pulses generated by valve 900 actuate shock tool 92.

As previously described, top mount radial valve 200 shown in FIG. 3 includes nozzle 226, which enables the ability to adjust the amplitude and height of the pressure pulses generated by valve 200. In addition, plug 230 can be deployed during drilling operations to block nozzle 226 and restrict and/or prevent drilling fluid from flowing therethrough, thereby enabling the selective ability to increase the amplitude and pulse height of the pressure pulses generated by valve 200 downhole without retrieving valve 200 to the surface to change nozzle 226. Thus, during drilling operations, valve 200 allows for the one-time selective ability to increase the amplitude and pulse height of the pressure pulses it generates. However, in other embodiments, a plurality of plugs can be sequentially deployed to selectively and progressively increase the amplitude and pulse height of the pressure pulses. For example, FIGS. 26 and 27 illustrate a power section 100 as previously described and a top mount, oscillating or rotating radial valve 200" that can selectively and progressively increase the amplitude and pulse height of the pressure pulses via the sequential and selective deployment of a plurality of plugs 230 as previously described.

Figure 26:
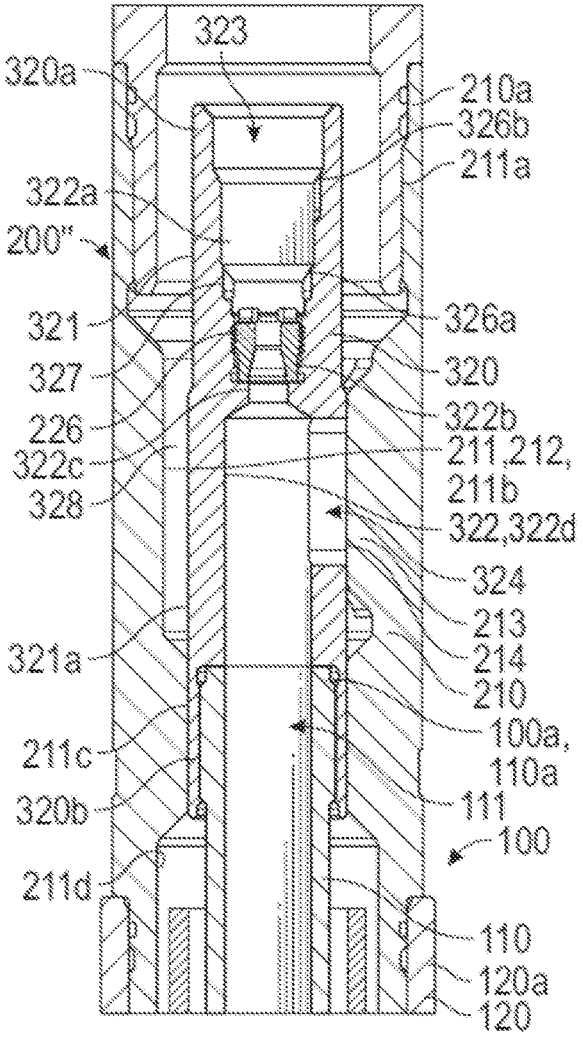
FIG. 26 is an enlarged cross-sectional view of an embodiment of a top mount radial valve in accordance with the principles described herein coupled to a concentric power section.
Figure 27:
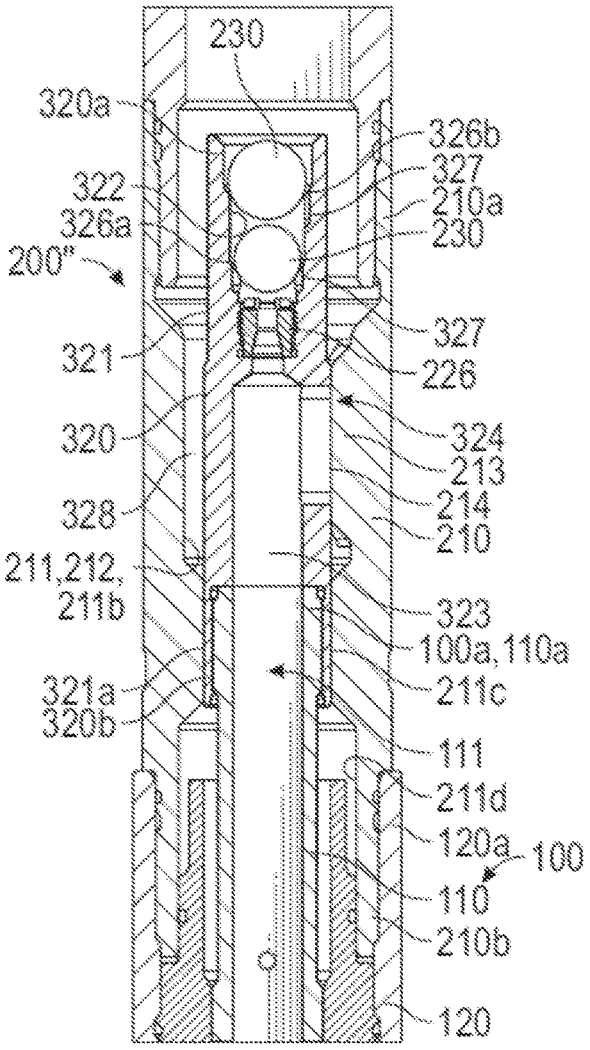
FIG. 27 is an enlarged cross-sectional view of the top mount radial valve of FIG. 26 illustrating the use of sequential plugs to progressively increase the amplitude of the pressure pulse generated.

Referring now to FIGS. 26 and 27, valve 200" is similar valve 200 previously described. In particular, valve 200" is operated by the rotation of rotor 110 to selectively generate pressure pulses in the drilling fluid upstream power section 100, which drive the axial reciprocation of shock tool 92 (FIG. 1). In this embodiment, valve 200" includes a first valve member or outer housing 210 and a second valve member or body 320 rotatably disposed within housing 210. Body 320 is concentrically disposed within housing 210, and further, body 320 and housing 210 are coaxially aligned with rotor 110 and stator 120 of power section 100. In other words, body 320 and housing 210 have central axes that are coaxially aligned with axis 105.

Housing 210 is as previously described with respect to valve 200. Thus, upper end 210*a* of housing 210 is coupled to drillstring 22 and lower end 210*b* of housing 210 is directly coupled to upper end 120*a* of stator 120. Body 320 extends through central throughbore 212 of housing 210.

Body 320 is similar to body 220 previously described. More specifically, body 320 has a first or upper end 320*a*, a second or lower end 320*b*, a radially outer surface 321 extending axially between ends 320*a*, 320*b*, and a radially inner surface 322 extending axially between ends 320*a*, 320*b*. Lower end 320*b* is fixably coupled to upper end 110*a* of rotor 110 such that body 320 rotates with rotor 110 relative to housing 210 and stator 120.

Inner surface 322 defines a central passage 323 extending axially between ends 320*a*, 320*b*. In addition, body 320 includes a port 324 axially positioned between ends 320*a*, 320*b* and extending radially from outer surface 321 to inner surface 322. In this embodiment, lower end 320*b* is a box end that threadably receives a mating pin end at upper end 110*a* of rotor 110.

In this embodiment, inner surface 322 includes a first or stepped receptacle 322*a* at upper end 320*a*, a second receptacle 322*b* extending axially from first receptacle 322*a*, a reduced inner radius section 322*c* extending axially from second receptacle 322*b*, and a cylindrical surface 322*d* extending axially from section 322*c* to the box end disposed at lower end 320*b*. A nozzle 226 as previously described is removably threaded into receptacle 322*b*. Reduced inner radius section 322*c* defines a flow restriction along passage 323 immediately downstream of nozzle 226. As will be described in more detail below, first receptacle 322*a* is sized and positioned to receive a plurality of plugs 230 as previously described to selectively and progressively increase the amplitude and pulse height of the pressure pulses generated by valve 200".

Figure 28:
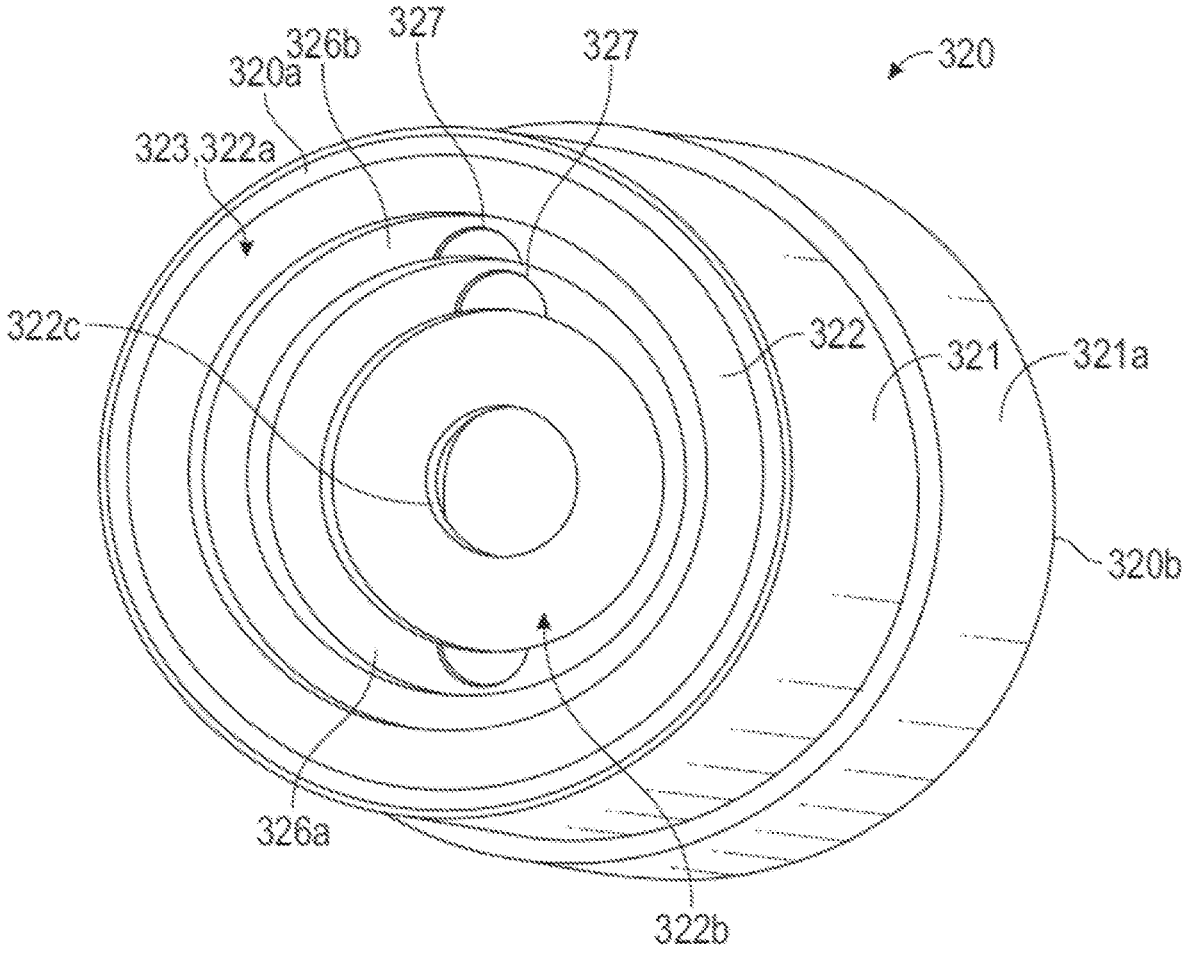
FIG. 28 is a perspective end view of the body of the valve of FIGS. 26 and 27 with the nozzle removed.

Referring now to FIG. 26-28, in this embodiment, inner surface 322 includes a plurality of axially spaced annular uphole facing shoulders or seats along first receptacle 322*a*. In particular, inner surface 322 includes first or lower annular uphole facing shoulder or seat 326*a* axially positioned proximal second receptacle 322*b* (and nozzle 226 when disposed in receptacle 322*b*) and a second or upper annular uphole facing shoulder or seat 326*b* axially positioned between upper end 320*a* and seat 326*a*. Cylindrical surfaces extend between receptacle 322*b* and seat 326*a*, between seats 326*a*, 326*b*, and between seat 326*b* and upper end 320*a*. Each seat 326*a*, 326*b* is sized to sealingly engage one corresponding plug 230. In this embodiment, each plug 230 is a spherical ball.

The inner diameter of passage 323 defined by seats 326*a*, 326*b* generally increases moving axially uphole from nozzle 226 to end 320*a*—the minimum inner diameter defined by lower seat 326*a* is less than the minimum diameter defined by intermediate seat 326*b*. Accordingly, the diameter of plug 230 sized to sealingly engage lower seat 326*a* is less than the diameter of plug 230 sized to sealingly engage upper seat 326*b*. For purposes of clarity and further explanation, the plug 230 that engages lower seat 326*a* will also be referred to herein as first or lower plug 230 and the plug 230 that engages upper seat 326*b* will also be referred to herein as second or upper plug 230.

Referring still to FIGS. 26-28, one or more bypass slots 327 are disposed along inner surface 322 and extend axially from each seat 326*a*, 326*b*. In this embodiment, a plurality of uniformly circumferentially spaced bypass slots 327 extend axially from lower seat 326*a* along inner surface 322 in first receptacle 322*a*, and one bypass slot 327 extends axially from upper seat 326*b* along inner surface 322 in first receptacle 322*a*. Thus, the number of bypass slots 327 associated with seats 326*a*, 326*b* decreases moving axially uphole from lower seat 326*a* to upper seat 326*b*. As will be described in more detail below, bypass slots 327 allow the restricted flow of drilling through passage 323 and around the plug 230 seated against the corresponding seat 326*a*, 326*b*. For example, when lower plug 230 sealingly engages lower seat 326*a*, drilling fluid can flow through passage 323 and around lower plug 230 via slots 327 in seat 326*a*, and similarly, when upper plug 230 sealingly engages upper seat 326*b*, drilling fluid can flow through passage 323 and around upper plug 230 via slot 327 in upper seat 326*b*. Thus, in this embodiment, plugs 230 restrict the flow of drilling fluid through passage 323 and nozzle 226, but do not completely prevent or stop the flow of drilling fluid through passage 323.

Although each bypass slot 327 is a recess disposed along inner surface 322 and extending axially from a corresponding seat 326*a*, 326*b* in this embodiment, in other embodiments, bypass slots 327 may be replaced with bores or holes extending from the corresponding seat 326*a*, 326*b* to inner surface 322 below the corresponding seat 326*a*, 326*b*. In this embodiment, a plurality of bypass slots 327 extend from lower seat 326*a* and one bypass slot 327 extends from upper seat 326*b*. However, in other embodiments, the number of bypass slots (e.g., bypass slots 327) in each seat (e.g., seat 326*a*, 326*b*) may vary with the understanding that the number of bypass slots associated with the seats preferably decreases moving axially uphole from one seat to the next. For example, in another embodiment, one or more bypass slots 327 extend axially from lower seat 326*a* and no bypass slots 327 extend from upper seat 326*b*. In that embodiment, when plug 230 is seated against upper seat 326*b*, all of the drilling fluid bypasses nozzle 226 and flows into annulus 328 and through port 324.

In general, the size of the orifice in nozzle 226 influences the amount of drilling fluid that flows through passage 323 relative to the amount of drilling fluid that bypasses or flows around passage 323 between body 320 and housing 210 when plugs 230 are not disposed in seats 326*a*, 326*b*. As previously described, a smaller orifice in nozzle 226 allows less drilling fluid into passage 323 (resulting in more drilling fluid bypassing passage 323) and a larger orifice in nozzle allows more drilling fluid into passage 323 (result in less drilling fluid bypassing passage 223). Thus, different nozzles 226 having different sized orifices can be used to alter the relative quantity of drilling fluid flowing through passage 323 versus bypassing passage 323, which in turn affects the amplitude of each pressure pulse generated by valve 200".

Referring again to FIGS. 26 and 27, outer surface 321 of body 320 includes a cylindrical surface 321*a* extending from lower end 320*b*. Port 324 extends radially from surface 321*a* to surface 322*d*.

Body 320 is disposed in housing 210 with port 324 axially aligned with lug 213 and cylindrical surface 321*a* of body 320 radially opposed cylindrical surfaces 211*b*, 211*c* of housing 210. Cylindrical surface 211*b* of housing 210 is radially spaced from cylindrical surface 321*a* of body 320, thereby resulting in an annular space or annulus 328 radially disposed between surfaces 321*a*, 211*b*. Surface 321*a* is disposed at substantially the same radius as surfaces 211*c*, 214 of housing 210, and thus, surface 321*a* directly contacts and slidingly engages surfaces 211*c*, 214. Port 324 has a circumferential width that is less than the circumferential width of lug 213 and corresponding surface 214, and further, port 324 has an axial height that is less than the axial height of lug 213 and corresponding surface 214. Thus, when port 324 is circumferentially aligned with lug 213, port 324 is closed (or substantially closed) by lug 213 and fluid communication between annulus 328 and passage 323 via port 324 is substantially restricted and/or prevented. However, when port 324 is not circumferentially aligned with lug 213, port 324 is open and allowed fluid communication between annulus 328 and passage 323. Although valve 200" is shown and described as including one port 324 and one lug 213, in general, the valve (e.g., valve 200") can have one or more ports (e.g., ports 324) and one or more lugs (e.g., lug 213).

Figure 29:
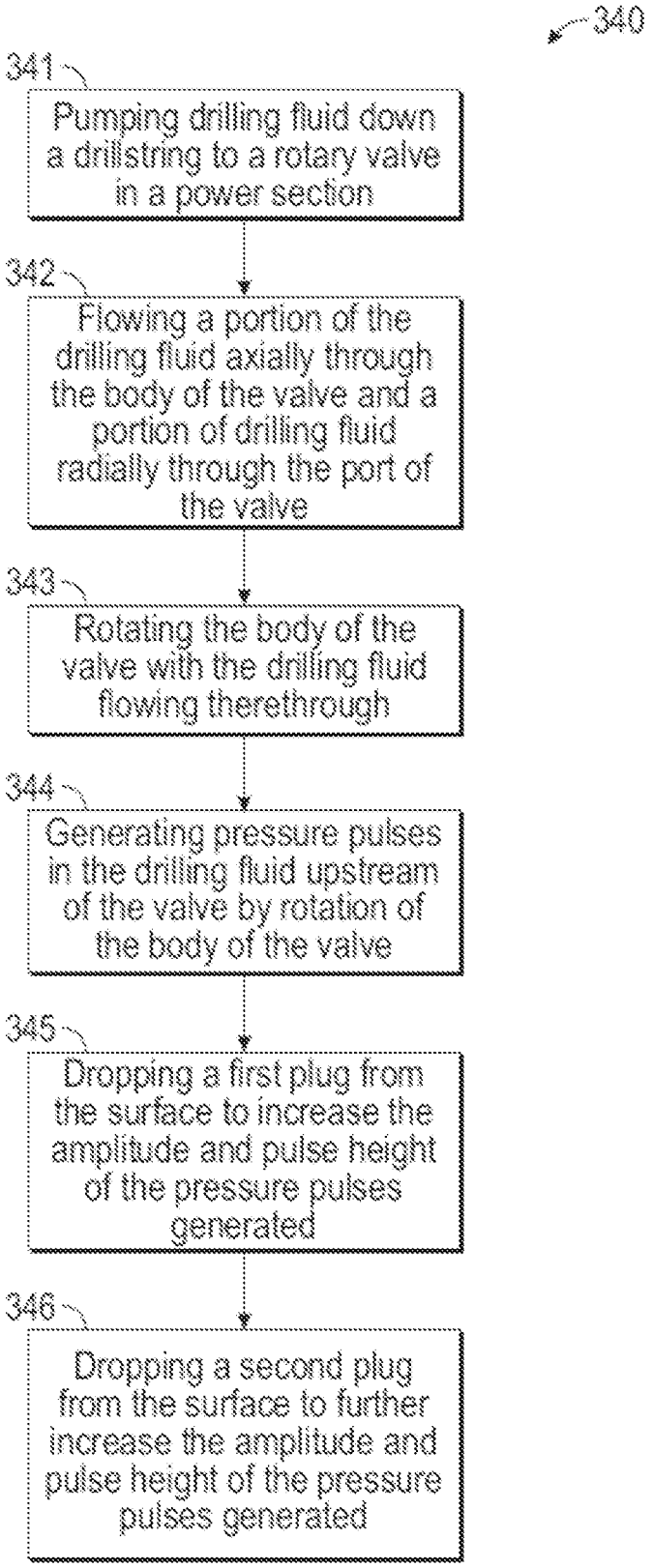
FIG. 29 is a flow chart illustrating an embodiment of a method in accordance with the principles described herein for generating pressure pulses and selectively increasing the amplitude and pulse height of the pressure pulses with the top mount radial valve of FIG. 26.

Referring now to FIG. 29, an embodiment of a method 340 for selectively and progressively increasing the amplitude and height of the pressure pulses in drilling fluid during drilling operations with a top mount, oscillating or rotating radial valve is shown. For purposes of clarity and further explanation, method 340 will be described with respect to the operation of valve 200" described above and shown in FIGS. 26 and 27.

Beginning in block 341, drilling fluid is pumped down drillstring 22 to power section 100. Moving now to block 342, a portion of the drilling fluid flows axially through passage 323 of body 320, and a portion of the drilling fluid flows into annulus 328 and then radially through port 324 into passage 323. More specifically, at least initially, no plugs 230 are disposed in seats 326*a*, 326*b*, and thus, a portion of the drilling fluid flows through nozzle 226 and a portion of the drilling fluid flows into annulus 328. The drilling fluid that passes through nozzle 226 enters passage 323 of body 320. The drilling fluid that passes through annulus 328 also enters passage 323, but it does so via port 324. Next, in block 343, the drilling fluid flowing into and through passage 323 of body 320 (via nozzle 226 and port 324) drives the rotation of body 320 relative to housing 210. In particular, the drilling fluid exits passage 323 and flows downstream into rotor 110 of first stage 101 and drives the rotation of rotors 110 of stages 101, 102 as previously described. Body 320 is fixably coupled to rotors 110, and thus, body 320 rotates with rotors 110 relative to housing 210.

Moving now to block 344, rotation of body 320 relative to housing 210 generates pressure pulses in the drilling fluid upstream of the valve 200". More specifically, rotation of body 320 results in the cyclically opening and closing of port 324 with lug 213—as port 324 rotates into circumferential alignment with lug 213, port 324 is temporarily closed, and when port 324 rotates out of circumferential alignment with lug 213, port 324 is opened. The cyclical opening and closing of port 324 generates pressure pulses in the drilling fluid upstream of valve 200"—when port 324 is closed, the pressure of drilling fluid immediately upstream of valve 200" increases, and when port 324 is open, the pressure of the drilling fluid immediately upstream of valve 200" decreases. In this manner, the rotation of rotors 110 drive the rotation of body 320 relative to housing 210, which in turn generates cyclical pressure pulses in the drilling fluid that drive the axial reciprocation of shock tool 92. As previously described, the size of the orifice in nozzle 226 determines the relative amounts of drilling fluid that pass through nozzle 226 and annulus 328. Without being limited by this or any particular theory, the greater the relative amount of drilling fluid that passes into annulus 328 (and less relative amount of drilling fluid that passes through nozzle 226), the greater the amplitude or height of each pressure pulse generated by valve 200". Thus, by using nozzles 226 having different sized orifices, the amplitude and pulse height of the pressure pulses generated by valve 200" can be adjusted.

Plug seats 326*a*, 326*b* and corresponding plugs 230 enable the selective ability to progressively increase the amplitude and pulse height of the pressure pulses generated by valve 200" downhole without retrieving valve 200" to the surface to change nozzle 226. In particular, to increase in the amplitude and pulse height of the pressure pulses generated by valve 200" when desired, lower plug 230 is dropped from the surface and seats in lower seat 326*a* according to block 345. As a result, flow through nozzle 226 is partially restricted from flowing therethrough, thereby increasing the relative quantity of drilling fluid directed into annulus 328 and port 324, which increases in the amplitude or height of each pressure pulse generated by valve 200". When yet a further increase in the amplitude and pulse height of the pressure pulses generated by valve 200" is desired, upper plug 230 is dropped from the surface and seats in upper seat 326*b* according to block 346. As a result, flow through nozzle 226 is further restricted from flowing therethrough, thereby further increasing the relative quantity of drilling fluid directed into annulus 328 and port 324, which further increases in the amplitude or height of each pressure pulse generated by valve 200". It should be appreciated that in this embodiment, neither lower plug 230 nor upper plug 230 completely prevents flow through nozzle 226 as ports 327 in seats 326*a*, 326*b* allow some drilling fluid to flow around the corresponding plugs 230 and through nozzle 226. However, since upper seat 326*b* includes fewer bypass slots 327 than lower seat 326*a*, the restriction of flow through nozzle 226 is further restricted by upper plug 230 as compared to lower plug 230 alone.

In the manner described, valve 200" allows for the selective and progressive increase in the amplitude and height of the pressure pulses generated by valve 200". In this embodiment, valve 200" can be used to progressively increase the amplitude and height of the pressure pulses twice by dropping lower plug 230 and seating it against lower seat 326*a*, and then by dropping upper plug 230 and seating it against upper seat 326*b*. However, in other embodiments, the valve (e.g., valve 200") may be designed for more than two progressive increases in the amplitude and height of the pressure pulses by increasing the number of seats (e.g., seats 326*a*, 326*b*) disposed along the inner surface of the body (e.g., inner surface 322 of 320) upstream of the nozzle (e.g., nozzle 226) with each seat having fewer bypass slots. In this embodiment, each slot 327 along inner surface 322 of body 320 of valve 200" has the same geometry and size, and the number of slots 327 extending from each seat 326*a*, 326*b* is varied to adjust the degree of bypass of the corresponding plug 230, in other embodiments, the size of the slots (e.g., cross-sectional area of slots 327) extending from each seat (e.g., seat 326*a*, 326*b*) can be varied to adjust the degree of bypass of the corresponding plug (e.g., plug 230).

Figure 30:
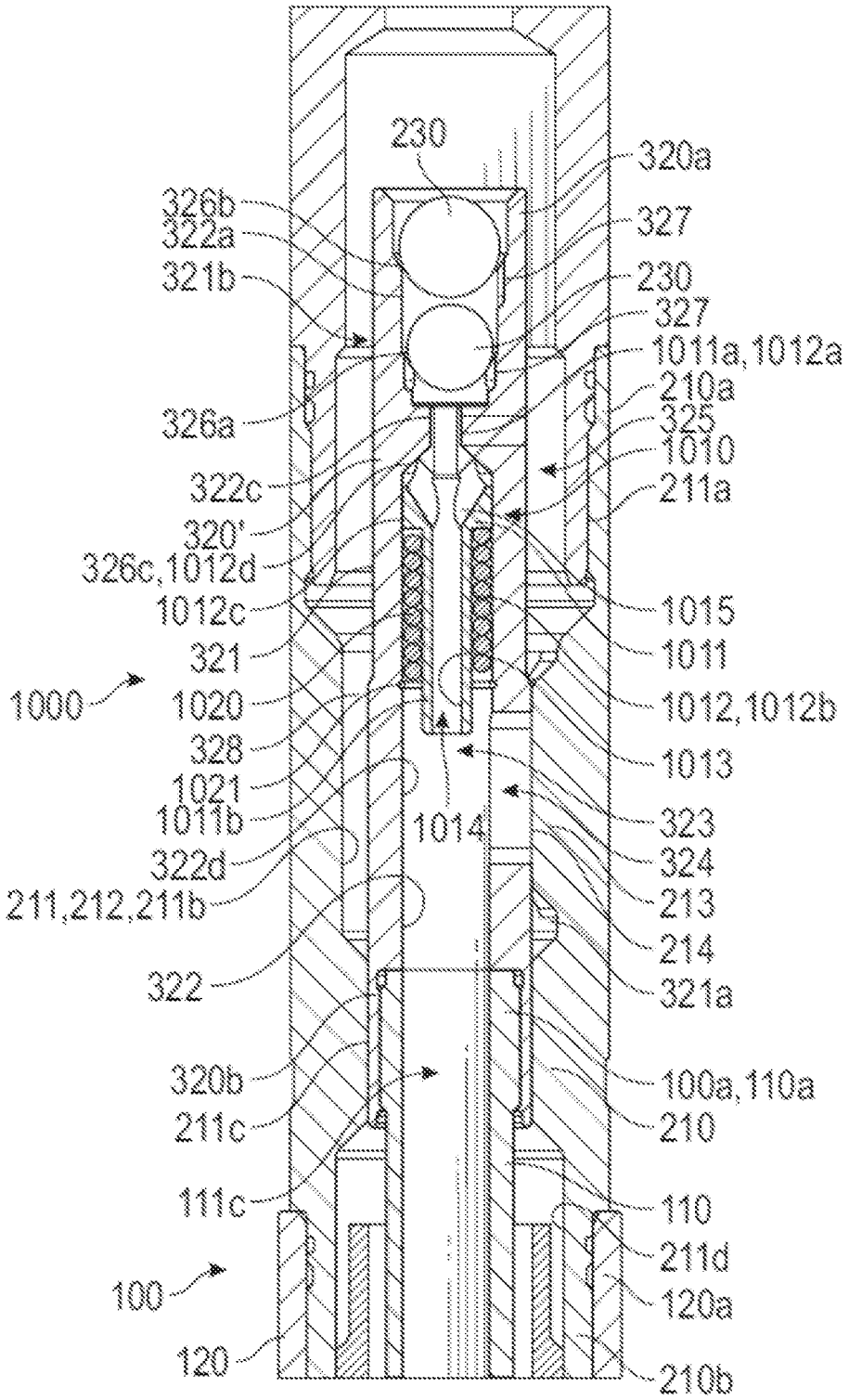
FIG. 30 is an enlarged cross-sectional view of an embodiment of a top mount radial valve in accordance with the principles described herein coupled to a concentric power section.

In some drilling operations, it may be desirable to limit the maximum amplitude and height of the pressure pulses generated by the oscillating or rotary valve used to drive the shock tool (e.g., shock tool 92). For example, it may be desirable to limit the use of relatively high amplitude pressure pulses to select situations when a large portion of the drillstring is engaging the borehole wall as continuous use of high amplitude pressure pulses can increase the likelihood of premature fatigue and failure of components along the drillstring. FIG. 30 illustrates a power section 100 as previously described and a top mount, oscillating or rotating radial valve 1000 that can selectively and progressively increase the amplitude and pulse height of the pressure pulses via the sequential and selective deployment of a plurality of plugs 230, while simultaneously limiting the maximum amplitude and height of the pressure pulses. Valve 1000 is substantially the same as valve 200" previously described with the exception that valve 1000 does not include nozzle 226 and valve 1000 includes a pressure relief valve 1010.

Referring now to FIG. 30, valve 1000 is similar valve 200 previously described. In particular, valve 1000 is operated by the rotation of rotor 110 to selectively generate pressure pulses in the drilling fluid upstream power section 100, which drive the axial reciprocation of shock tool 92 (FIG. 1). In this embodiment, valve 1000 includes a first valve member or outer housing 210 and a second valve member or body 320' rotatably disposed within housing 210. Body 320' is concentrically disposed within housing 210, and further, body 320' and housing 210 are coaxially aligned with rotor 110 and stator 120 of power section 100. In other words, body 320' and housing 210 have central axes that are coaxially aligned with axis 105.

Housing 210 is as previously described with respect to valve 200. Thus, upper end 210*a* of housing 210 is coupled to drillstring 22 and lower end 210*b* of housing 210 is directly coupled to upper end 120*a* of stator 120. Body 320' extends through central throughbore 212 of housing 210.

Body 320' is substantially the same as body 320 previously described. More specifically, body 320' has a first or upper end 320*a*, a second or lower end 320*b*, a radially outer surface 321 extending axially between ends 320*a*, 320*b*, and a radially inner surface 322 extending axially between ends 320*a*, 320*b*. Lower end 320*b* is fixably coupled to upper end 110*a* of rotor 110 such that body 320 rotates with rotor 110 relative to housing 210 and stator 120. Inner surface 322 defines a central passage 323 extending axially between ends 320*a*, 320*b*. In addition, body 320 includes a port 324 axially positioned between ends 320*a*, 320*b* and extending radially from outer surface 321 to inner surface 322. In this embodiment, lower end 320*b* is a box end that threadably receives a mating pin end at upper end 110*a* of rotor 110.

In this embodiment, inner surface 322 includes a first or stepped receptacle 322*a* as previously described at upper end 320*a*, a reduced inner radius section 322*c*, and a cylindrical surface 322*d* extending axially from section 322*c* to the box end disposed at lower end 320*b*. However, in this embodiment, reduced inner radius section 322*c* extends axially from receptacle 322*a*. In other words, in this embodiment, inner surface 322 does not include receptacle 322*b* or associated nozzle 226 between receptacle 322*a* and reduced inner radius section 322*c*. An annular downhole facing frustoconical shoulder 326*c* extends radially between sections 322*c* and surface 322*d*.

Referring still to FIG. 30, outer surface 321 of body 320' includes a cylindrical surface 321*a* extending from lower end 320*b* and a cylindrical surface 321*b* extending from upper end 320*a*. Port 324 extends radially from surface 321*a* to surface 322*d*. However, unlike body 320 previously described, in this embodiment body 320' also includes a relief port 325 extending radially from surface 321*b* to section 322*c*.

Body 320' is disposed in housing 210 with port 324 axially aligned with lug 213 and cylindrical surface 321*a* of body 320' radially opposed cylindrical surfaces 211*b*, 211*c* of housing 210. Cylindrical surface 211*b* of housing 210 is radially spaced from cylindrical surface 321*a* of body 320', thereby resulting in an annular space or annulus 328 radially disposed between surfaces 321*a*, 211*b*. Surface 321*a* is disposed at substantially the same radius as surfaces 211*c*, 214 of housing 210, and thus, surface 321*a* directly contacts and slidingly engages surfaces 211*c*, 214. Port 324 has a circumferential width that is less than the circumferential width of lug 213 and corresponding surface 214, and further, port 324 has an axial height that is less than the axial height of lug 213 and corresponding surface 214. Thus, when port 324 is circumferentially aligned with lug 213, port 324 is closed (or substantially closed) by lug 213 and fluid communication between annulus 328 and passage 323 via port 324 is substantially restricted and/or prevented. However, when port 324 is not circumferentially aligned with lug 213, port 324 is open and allowed fluid communication between annulus 328 and passage 323. Although valve 1000 is shown and described as including one port 324 and one lug 213, in general, the valve (e.g., valve 1000) can have one or more ports (e.g., ports 324) and one or more lugs (e.g., lug 213).

Referring still to FIG. 30, relief valve 1010 is disposed in passage 323 and axially positioned between receptacle 322*a* and port 324. In this embodiment, relief valve 1010 includes a valve body 1011 movably disposed in passage 323 and a biasing member 1020 radially positioned between body 1011 and surface 322*d*. Valve body 1011 has a first or upper end 1011*a*, a second or lower end 1011*b*, a radially outer surface 1012 extending axially between ends 1011*a*, 1011*b*, and a radially inner surface 1013 extending axially between ends 1011*a*, 1011*b*. Inner surface 1013 defines a central passage 1014 extending axially between ends 1011*a*, 1011*b*.

Outer surface 1012 includes a reduced outer radius cylindrical surface 1012*a* extending from upper end 1011*a*, a cylindrical surface 1012*b* extending axially from lower end 1011*b*, and an increased outer radius cylindrical surface 1012*c* axially positioned between surfaces 1012*a*, 1012*b*. An annular upward facing frustoconical shoulder 1012*d* extends radially between surfaces 1012*a*, 1012*c* and an annular downward facing planar shoulder 1012*e* extends radially between surfaces 1012*b*, 1012*c*. Cylindrical surface 1012*a* slidingly engages inner surface 323 along section 322*c* and cylindrical surface 1012*c* slidingly engages inner surface 322*d*. Surfaces 1012*b*, 322*d* are radially spaced, thereby defining an annulus between valve body 1010 and body 320' within which biasing member 1020 is disposed. More specifically, biasing member 1020 is axially compressed between shoulder 1012*e* and a snap ring 1021 seated in a mating recess along cylindrical surface 322*d*. A plurality of uniformly circumferentially spaced ports 1015 extend from shoulder 1012*d* to passage 1014.

Referring still to FIG. 30, valve body 1011 can move axially relative to body 320' and housing 210 between a first or closed position preventing the flow of drilling fluid through relief port 325 and a second or open position allowing the flow of drilling fluid through relief port 325. In the closed position shown in FIG. 30, upper end 1011*a* of valve body 1011 is fully seated within section 322*c* and extends completely across relief port 325, and shoulder 1012*d* engages mating shoulder 326*c*. As a result, drilling fluid is blocked and restricted and/or prevented from flowing from annulus 328 through port 325 and passage 1014 into passage 323 of body 320'. In the open position, upper end 1011*a* of valve body 1011 is at least partially withdrawn from section 322*c* and does not extend completely across, and shoulder 1012*d* is axially spaced from shoulder 326*c*. As a result, drilling fluid is allowed to flow from annulus 328 through port 325 and passage 1014 (via open upper end 1011*a* and/or ports 1015) into passage 323 of body 320'. It should be appreciated that port 325 is disposed axially below receptacle 322*a* and any plugs 230 disposed therein, and further, drilling fluid that flows through port 325 from annulus 328 into passage 323 of body 320' does not flow through port 324. Thus, drilling fluid that flows through port 325 into passage 323 of body 320' bypasses plugs 230 and port 324.

In this embodiment, biasing member 1020 is a spring that axially biases valve body 1011 to the closed position. However, when the pressure differential across relief valve 1010 (e.g., the pressure differential between the drilling fluid in annulus 328 and the drilling fluid in passage 323 axially below relief valve 1010) exceeds the biasing force of biasing member 1020, valve body 1011 moves axially downward relative to body 320' from the closed position to the open position, thereby allowing drilling fluid radially positioned between body 320' and housing 210 to bypass port 324.

Figure 31:
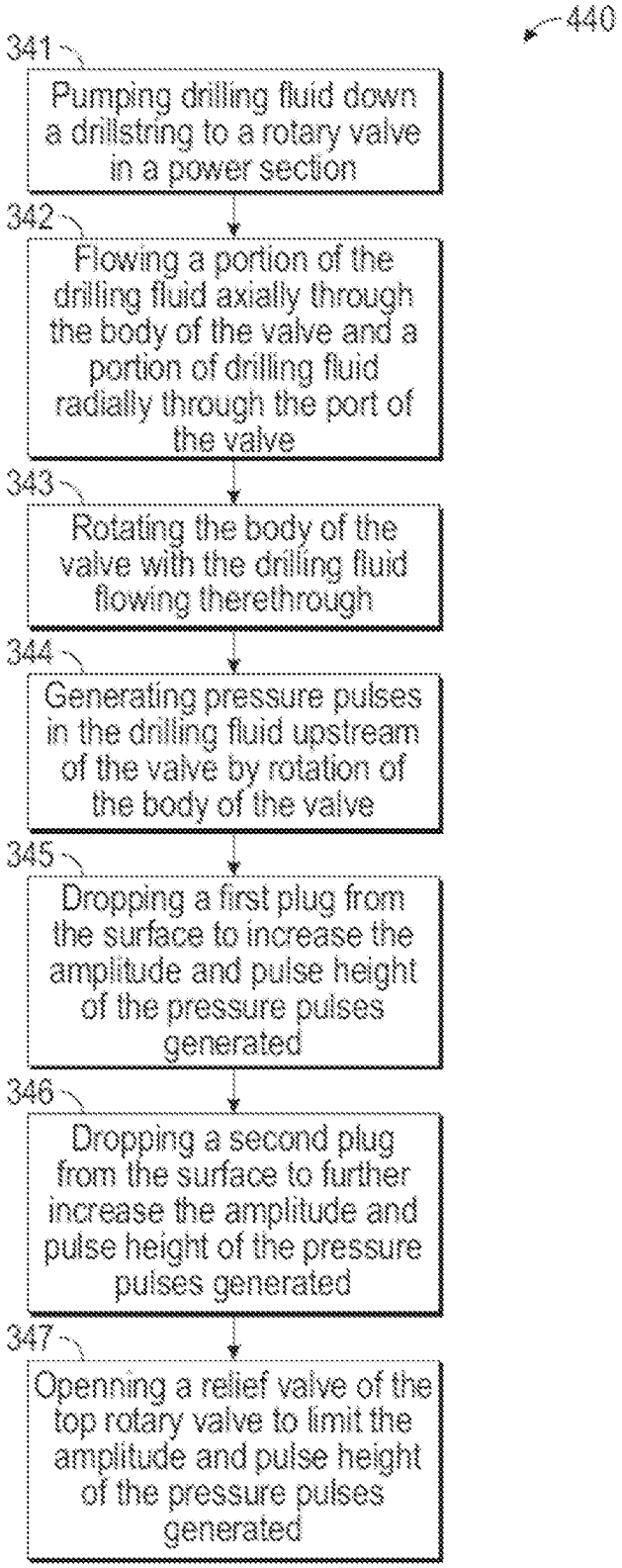
FIG. 31 is a flow chart illustrating an embodiment of a method in accordance with the principles described herein for generating pressure pulses, selectively increasing the amplitude and pulse height of the pressure pulses, and then limiting the amplitude and pulse height of the pressure pulses with the rotary valve of FIG. 30.

Referring now to FIG. 31, an embodiment of a method 440 for selectively and progressively increasing the amplitude and height of the pressure pulses in drilling fluid during drilling operations with a top mount, oscillating or rotating radial valve while simultaneously limiting the maximum amplitude and height of the pressure pulses is shown. For purposes of clarity and further explanation, method 440 will be described with respect to the operation of valve 1000 described above and shown in FIG. 30.

Valve 1000 operates in substantially the same manner as valve 200" previously described with the exception that relief valve 1010 opens to allow drilling fluid to bypass plugs 320 and port 324 at a sufficient pressure differential. Accordingly, method 440 includes blocks 341-346 as previously described. For example, in block 341, drilling fluid is pumped down drillstring 22 to power section 100. In block 342, a portion of the drilling fluid flows axially through passage 323 of body 320', and a portion of the drilling fluid flows into annulus 328 and then radially through port 324 into passage 323. More specifically, at least initially, no plugs 230 are disposed in seats 326*a*, 326*b*, and thus, a portion of the drilling fluid flows through passage 323 and reduced inner radius section 322*c*, and a portion of the drilling fluid flows into annulus 328 and then radially inward through port 324. Next, in block 343, the drilling fluid flowing into and through passage 323 of body 320' (via section 322*c* and port 324) drives the rotation of body 320' relative to housing 210. In particular, the drilling fluid flowing into and through passage 323 (via section 322*c* and port 324) flows downstream into rotor 110 of first stage 101 and drives the rotation of rotors 110 of stages 101, 102 as previously described. Body 320' is fixably coupled to rotors 110, and thus, body 320' rotates with rotors 110 relative to housing 210.

Moving now to block 344, rotation of body 320' relative to housing 210 generates pressure pulses in the drilling fluid upstream of the valve 1000. In particular, rotation of body 320' results in the cyclically opening and closing of port 324 with lug 213 as previously described. The cyclical opening and closing of port 324 generates pressure pulses in the drilling fluid upstream of valve 1000. In this manner, the rotation of rotors 110 drive the rotation of body 320' relative to housing 210, which in turn generates cyclical pressure pulses in the drilling fluid that drive the axial reciprocation of shock tool 92. As previously described, the diameter of section 322*c* determines the relative amounts of drilling fluid that pass through section 322*c* and annulus 328. Without being limited by this or any particular theory, the greater the relative amount of drilling fluid that passes into annulus 328 (and less relative amount of drilling fluid that passes through section 322*c*), the greater the amplitude or height of each pressure pulse generated by valve 1000.

Similar to valve 200", plug seats 326*a*, 326*b* and corresponding plugs 230 enable the selective ability to progressively increase the amplitude and pulse height of the pressure pulses generated by valve 1000 downhole without retrieving valve 1000. In particular, to increase in the amplitude and pulse height of the pressure pulses generated by valve 1000 when desired, lower plug 230 is dropped from the surface and seats in lower seat 326*a* according to block 345. As a result, flow through nozzle 226 is is restricted from flowing therethrough, thereby increasing the relative quantity of drilling fluid directed into annulus 328 and port 324, which increases in the amplitude or height of each pressure pulse generated by valve 1000. When yet a further increase in the amplitude and pulse height of the pressure pulses generated by valve 1000 is desired, upper plug 230 is dropped from the surface and seats in upper seat 326*b* according to block 346. As a result, flow through section 322*c* is further restricted from flowing therethrough, thereby further increasing the relative quantity of drilling fluid directed into annulus 328 and port 324, which further increases in the amplitude or height of each pressure pulse generated by valve 1000. It should be appreciated that in this embodiment, neither lower plug 230 nor upper plug 230 completely prevents flow through section 322*c* as ports 327 in seats 326*a*, 326*b* allow some drilling fluid to flow around the corresponding plugs 230 and through section 322*c*. However, since upper seat 326*b* includes fewer bypass slots 327 than lower seat 326*a*, the restriction of flow through nozzle 226 is further restricted by upper plug 230 as compared to lower plug 230 alone.

Although each bypass slot 327 is a recess disposed along inner surface 322 and extending axially from a corresponding seat 326*a*, 326*b* in this embodiment, in other embodiments, bypass slots 327 may be replaced with bores or holes extending from the corresponding seat 326*a*, 326*b* to inner surface 322 below the corresponding seat 326*a*, 326*b*. In this embodiment, a plurality of bypass slots 327 extend from lower seat 326*a* and one bypass slot 327 extends from upper seat 326*b*. However, in other embodiments, the number of bypass slots (e.g., bypass slots 327) in each seat (e.g., seat 326*a*, 326*b*) may vary with the understanding that the number of bypass slots associated with the seats preferably decreases moving axially uphole from one seat to the next. For example, in another embodiment, one or more bypass slots 327 extend axially from lower seat 326*a* and no bypass slots 327 extend from upper seat 326*b*. In that embodiment, when plug 230 is seated against upper seat 326*b*, all of the drilling fluid flows into annulus 328 and through port 324.

Typically, valve body 1011 remains in the closed position, and thus, all the drilling fluid directed into annulus 328 flows through port 324 to generate pressure pulses in the same manner as valve 200" previously described. However, in this embodiment, valve 1000 includes relief valve 1010, which opens to relieve pressure in annulus 328. Accordingly, method 440 includes an additional block 347 at which relief valve 1010 opens in response to a sufficient pressure differential to relieve pressure in annulus 328, thereby limiting the maximum amplitude and height of the pressure pulses generated by valve 1000. In particular, at the sufficient pressure differential across relief valve 1010 between drilling fluid in annulus 328 and drilling fluid in passage 323 downstream of valve 1010, valve body 1011 transitions to the open position to relieve pressure in annulus 328 by allowing some drilling fluid in annulus 328 to bypass plugs 230 and port 324. Reduction of the pressure of drilling fluid in annulus 328 limits the maximum amplitude and height of the pressure pulses generated by valve 1000.

Figure 34:
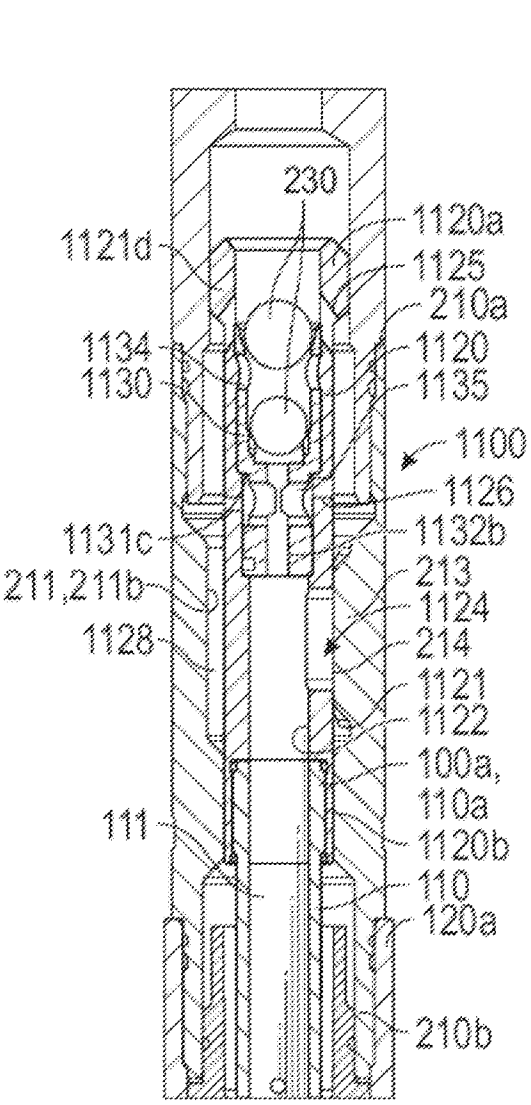
FIGS. 32-34 are enlarged cross-sectional view of an embodiment of a top mount radial valve in accordance with the principles described herein coupled to a concentric power section.
Figure 33:
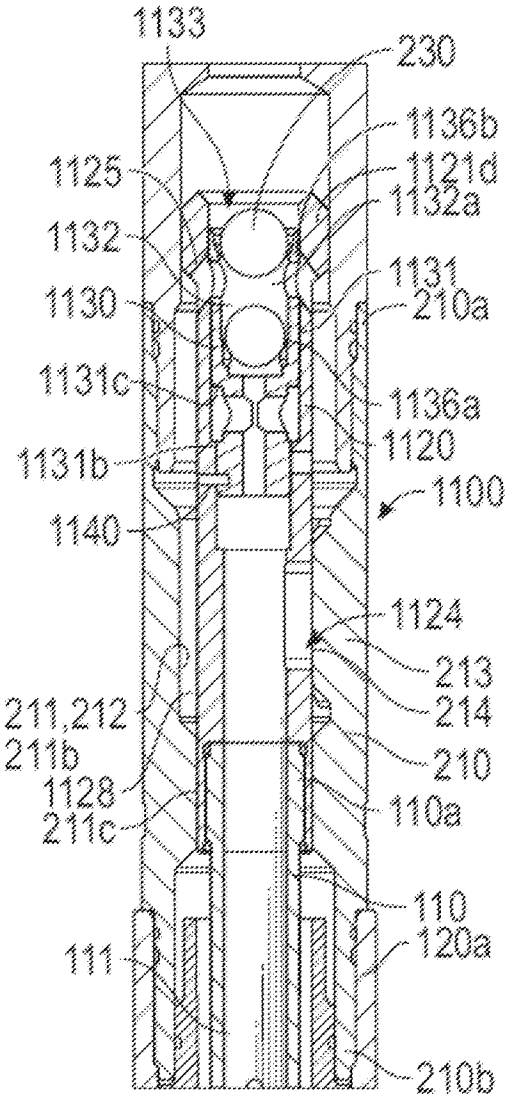
Figure 32:
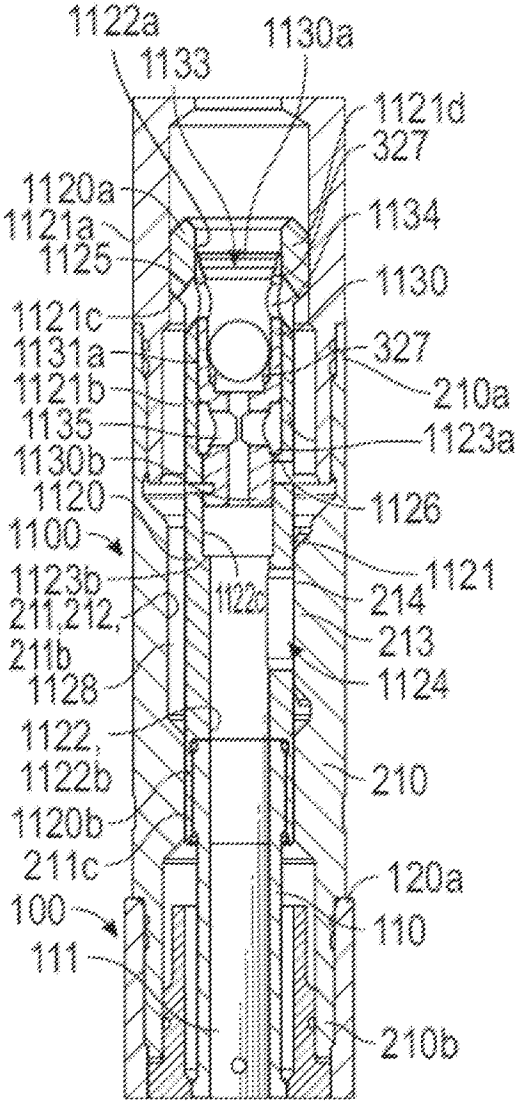

In the embodiments of valves 200", 1000 described above, successively dropped plugs 230 enable the selective and progressive increase in the amplitude and height of the pressure pulses generated by valves 200", 1000. In those embodiments, plugs 230 are not retrievable, and thus, once plugs 230 are seated in corresponding seats 326*a*, 326*b*, it may not be possible to decrease the amplitude and height of the pressure pulses generated by valves 200", 1000. However, in relatively long lateral sections of a borehole, relatively large amplitude pressure pulses may not be necessary or desirable while tripping out of the borehole. In such situations, it may be desirable to decrease the amplitude and height of the pressure pulses, and further to maintain the deceased amplitude and height of the pressure pulses while tripping. FIGS. 32-34 illustrates a power section 100 as previously described and a top mount, oscillating or rotating radial valve 1100 that can selectively increase the amplitude and pulse height of the pressure pulses generated by valve 1100 via deployment of a plug 230, and subsequently, selectively decrease the amplitude and pulse height of the pressure pulses generated by valve 1100.

Referring now to FIGS. 32-34, valve 1100 is operated by the rotation of rotor 110 to selectively generate pressure pulses in the drilling fluid upstream power section 100, which drive the axial reciprocation of shock tool 92 (FIG. 1). In this embodiment, valve 1100 includes a first valve member or outer housing 210, a second valve member or body 1120 rotatably disposed within housing 210, and an actuator 1130 slidably disposed in body 1120. Body 1120 is concentrically disposed within housing 210 and actuator 1130 is concentrically disposed in body 1120. In addition, housing 210, body 1120, and actuator 1130 are coaxially aligned with rotor 110 and stator 120 of power section 100. In other words, housing 210, body 1120, and actuator 1130 have central axes that are coaxially aligned with axis 105.

Housing 210 is as previously described with respect to valve 200. Thus, upper end 210*a* of housing 210 is coupled to drillstring 22 and lower end 210*b* of housing 210 is directly coupled to upper end 120*a* of stator 120. Body 1120 extends through central throughbore 212 of housing 210.

Body 1120 has a first or upper end 1120*a*, a second or lower end 1120*b*, a radially outer surface 1121 extending axially between ends 1120*a*, 1120*b*, and a radially inner surface 1122 extending axially between ends 1120*a*, 1120*b*. Inner surface 1122 defines a central passage 1123 extending axially between ends 1120*a*, 1120*b*. In addition, body 1120 includes a port 1124 axially positioned between ends 1120*a*, 1120*b* (proximal lower end 1120*b*), a plurality of uniformly circumferentially-spaced outlet ports 1125 axially positioned proximal upper end 1120*a*, and a bypass port 1126 axially positioned between port 1124 and ports 1125. Each port 1124, 1125, 1126 extends radially from outer surface 1121 to inner surface 1122. Lower end 1120*b* of body 1120 is fixably coupled to upper end 110*a* of rotor 110 such that body 1120 rotates with rotor 110 relative to housing 210 and stator 120. In this embodiment, lower end 1120*b* is a box end that threadably receives a mating pin end at upper end 110*a* of rotor 110.

In this embodiment, outer surface 1121 includes a cylindrical surface 1121*a* extending axially from upper end 1120*a* and a cylindrical surface 1121*b* extending axially from lower end 1120*b*. A downward facing annular shoulder 1121*c* extends radially between surfaces 1121*a*, 1121*b*. Surface 1121*a* is disposed at a diameter greater than surface 1121*b*, thereby defining an enlarged head 1121*d* at upper end 1120*a*. Head 1121*d* and corresponding surface 1121*a* slidingly engages a mating cylindrical portion of inner surface 211 of housing 210. Sliding engagement of head 1121*d* and housing 210 restricts the flow of drilling fluid therebetween but does not define a seal therebetween or prevent the flow of drilling fluid therebetween. Cylindrical surface 1121*b* is radially spaced from inner surface 211 of housing 210 with the exception of lug 213 and corresponding surface 214, which slidingly engages surface 1121*b*.

In this embodiment, inner surface 1122 includes a first cylindrical surface 1122*a* extending axially from upper end 1120*a*, a second cylindrical surface 1122*b* extending axially from the box end at lower end 1120*b*, and a third cylindrical surface 1122*c* axially positioned between surfaces 1122*a*, 1122*b*. An annular uphole facing planar shoulder 1123*a* extends radially inward from surface 1122*a* to surface 1122*c*, and an annular uphole facing planar shoulder 1123*b* extends radially inward from surface 1122*c* to surface 1122*b*. Thus, surface 1122*a* is disposed at a diameter greater than surface 1122*c*, and surface 1122*c* is disposed at a dimeter greater than surface 1122*b*. Port 1124 extends radially from surface 1121*b* to surface 1122*b*, ports 1125 extend from surface 1121*a* to surface 1122*b* at shoulder 1122*c*, and port 1126 extends radially from surface 1121*b* to surface 1122*c*.

Referring still to FIGS. 32-34, body 1120 is disposed in housing 210 with port 1124 axially aligned with lug 213 and cylindrical surface 1121*b* of body 1120 radially opposed cylindrical surfaces 211*b*, 211*c* of housing 210. Cylindrical surface 211*b* of housing 210 is radially spaced from cylindrical surface 1121*b* of body 1120, thereby resulting in an annular space or annulus 1128 radially disposed between surfaces 1121*b*, 211*b*. Surface 1121*b* is disposed at substantially the same radius as surfaces 211*c*, 214 of housing 210, and thus, surface 1121*b* directly contacts and slidingly engages surfaces 211*c*, 214. Port 1124 has a circumferential width that is less than the circumferential width of lug 213 and corresponding surface 214, and further, port 1124 has an axial height that is less than the axial height of lug 213 and corresponding surface 214. Thus, when port 1124 is circumferentially aligned with lug 213, port 1124 is closed (or substantially closed) by lug 213 and fluid communication between annulus 1128 and passage 1123 via port 1124 is substantially restricted and/or prevented. However, when port 1124 is not circumferentially aligned with lug 213, port 1124 is open and allowed fluid communication between annulus 1128 and passage 1123. Although valve 1100 is shown and described as including one port 1124 and one lug 213, in general, the valve (e.g., valve 1100) can have one or more ports (e.g., ports 1124) and one or more lugs (e.g., lug 213).

Actuator 1130 includes a first or upper end 1130*a*, a second or lower end 1130*b*, a radially outer surface 1131 extending axially between ends 1130*a*, 1130*b*, and a radially inner surface 1132 extending axially between ends 1130*a*, 1130*b*. Inner surface 1132 defines a central passage 1133 extending axially between ends 1130*a*, 1130*b*. In addition, actuator 1130 includes a plurality of uniformly circumferentially-spaced outlet ports 1134 axially positioned proximal upper end 1130*a* and a plurality of uniformly circumferentially-spaced bypass ports 1135 axially positioned between outlet ports 1134 and lower end 1130*b*. Each port 1134, 1135 extends radially from outer surface 1131 to inner surface 1132.

In this embodiment, outer surface 1131 includes a cylindrical surface 1131*a* extending axially from upper end 1130*a* and a cylindrical surface 1131*b* extending axially from lower end 1130*b*. A downward facing annular shoulder 1131*c* extends radially between surfaces 1131*a*, 1131*b*. Cylindrical surface 1131*a* slidingly engages mating cylindrical surface 1122*a* of body 1120 and cylindrical surface 1131*b* slidingly engages mating cylindrical surface 1122*c* of body 1120.

In this embodiment, inner surface 1132 includes a stepped receptacle 1132*a* at upper end 1130*a* and a reduced inner radius section 1132*b* defined by a cylindrical surface extending axially from receptacle 1132*a* to lower end 1130*b*. A plurality of axially spaced annular uphole facing shoulders or seats are disposed along inner surface 1132 within receptacle 1132*a*. In particular, inner surface 1132 includes first or lower annular uphole facing shoulder or seat 1136*a* axially positioned proximal section 1132*b* and a second or upper annular uphole facing shoulder or seat 1136*b* axially positioned between upper end 1130*a* and seat 1136*a*. Cylindrical surfaces extend between section 1132*b* and seat 1136*a*, between seats 1136*a*, 1136*b*, and between seat 1136*b* and upper end 1130*a*. Each seat 1136*a*, 1136*b* is sized to sealingly engage one corresponding plug 230. In this embodiment, each plug 230 is a spherical ball. A plurality of bypass slots 327 as previously described extend axially along inner surface 1132 from seat 1136*a* and a bypass slot 327 as previously described extends axially along inner surface 1132 from seat 1136*b*. Slots 327 allow restricted flow of drilling fluid around the corresponding plug 230 disposed in the corresponding seat 1136*a*, 1136*b*.

Although each bypass slot 327 is a recess disposed along inner surface 1132 and extending axially from a corresponding seat 1136*a*, 1136*b* in this embodiment, in other embodiments, bypass slots 327 may be replaced with bores or holes extending from the corresponding seat 1136*a*, 1136*b* to inner surface 1132 below the corresponding seat 1136*a*, 1136*b*. In this embodiment, a plurality of bypass slots 327 extend from lower seat 1136*a* and one bypass slot 327 extends from upper seat 1136*b*. However, in other embodiments, the number of bypass slots (e.g., bypass slots 327) in each seat (e.g., seat 1136*a*, 1136*b*) may vary with the understanding that the number of bypass slots associated with the seats preferably decreases moving axially uphole from one seat to the next. For example, in another embodiment, one or more bypass slots 327 extend axially from lower seat 1136*a* and no bypass slots 327 extend from upper seat 1136*b*. In that embodiment, when plug 230 is seated against upper seat 1136*b*, all of the drilling fluid flows into annulus 1128 and through port 1124.

The inner diameter of passage 1133 defined by seats 1136*a*, 1136*b* generally increases moving axially uphole from section 1132*b* to end 1130*a*—the minimum inner diameter defined by seat 1136*a* is less than the minimum diameter defined by seat 1136*b*. Accordingly, the diameter of plug 230 sized to sealingly engage lower seat 1136*a* is less than the diameter of plug 230 sized to sealingly engage upper seat 1136*b*. For purposes of clarity and further explanation, the plug 230 that engages lower seat 1136*a* will also be referred to herein as first or lower plug 230 and the plug 230 that engages upper seat 1136*b* will also be referred to herein as second or upper plug 230.

Outlet ports 1134 are axially positioned between seats 1136*a*, 1136*b*, while bypass ports 1135 are axially positioned below both seats 1136*a*, 1136*b*. Each seat 1136*a*, 1136*b* is sized to engage one corresponding plug 230. In this embodiment, each plug 230 is a spherical ball.

Referring still to FIGS. 32-34, actuator 1130 can be selectively moved axially downward relative to body 1120 and housing 210 between a first or deactivated position (FIGS. 32 and 33) preventing the flow of drilling fluid through bypass ports 1126, 1135 and a second or activated position (FIG. 34) allowing the flow of drilling fluid through bypass ports 1126, 1135. In the deactivated position, shown in FIGS. 32 and 33, outlet ports 1125, 1134 are axially and circumferentially aligned, bypass ports 1126, 1135 are axially misaligned, cylindrical surface 1131*b* of actuator 1130 extends completely across bypass port 1126, and shoulders 1131*c*, 1123*a* are axially spaced apart. As shown in FIG. 32 (without a plug 230 seated against seat 1136*b* and actuator 1130 in the deactivated position, receptacle 1132*a* and annulus 1128 are in fluid communication via outlet ports 1125, 1134, thereby allowing drilling fluid to flow between receptacle 1132*a* and annulus 1128; however, bypass ports 1126, 1135 are not in fluid communication, thereby restricting and/or preventing the flow of drilling fluid through bypass port 1126. In the activated position shown in FIG. 34, outlet ports 1125, 1134 are axially misaligned, bypass ports 1126, 1135 are axially aligned, cylindrical surface 1122*a* extends completely across outlet ports 1135, cylindrical surface 1131*b* of actuator 1130 is axially positioned below bypass port 1126 (e.g., surface 1131*b* does not extend across bypass port 1126), and shoulders 1131*c*, 1123*a* axially abut. As a result, passage 1133 and annulus 1128 are in fluid communication via bypass ports 1126, 1135, thereby allowing drilling fluid to flow between annulus 1128 and passage 1133. It should be appreciated that bypass ports 1126, 1135 are disposed axially below receptacle 1132*a* and any plugs 230 disposed therein, and further, drilling fluid that flows through ports 1126, 1135 from annulus 1128 into passage 1133 of actuator 1130 does not flow through port 1124. Thus, drilling fluid that flows through bypass ports 1126, 1135 into passage 1133 of actuator 1130 bypasses plugs 230 and port 1124. In this embodiment, actuator 1130 is generally held and maintained in the deactivated position during drilling operations by a shear pin 1140 extending between body 1120 and actuator 1130. However, when the pressure differential across actuator 1130 (e.g., the pressure differential between the drilling fluid above actuator 1130 and the drilling fluid in passages 1123, 1133 axially below actuator 1130 exceed the shear strength of pin 1140, actuator 1130 shifts axially downward from the deactivated position to the activated position by shearing pin 1140, thereby allowing drilling fluid in annulus 1128 to bypass port 1124.

Although actuator 1130 is transitioned from the deactivated position to the activated position by shearing the pin 1140 in this embodiment, in other embodiments, shear pin 1140 may be replaced with a shear ring or a spring that allows actuator 1130 to transition from the deactivated position to the activated position in response to a sufficient pressure differential.

Figure 35:
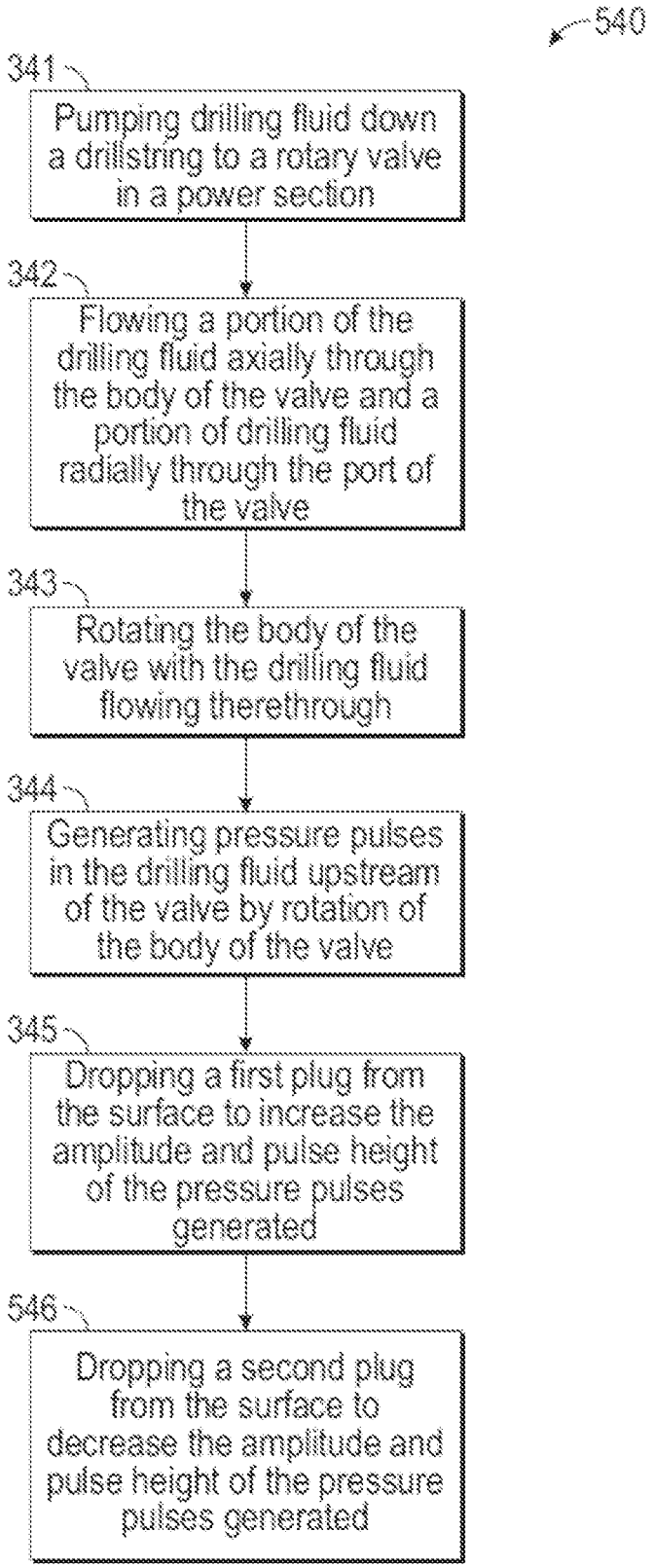
FIG. 35 is a flow chart illustrating an embodiment of a method in accordance with the principles described herein for generating pressure pulses, selectively increasing the amplitude and pulse height of the pressure pulses, and then selectively decreasing the amplitude and pulse height of the pressure pulses with the rotary valve of FIGS. 32-34.

Referring now to FIG. 35, an embodiment of a method 540 for selectively increasing the amplitude and height of the pressure pulses in drilling fluid during drilling operations with a top mount, oscillating or rotating radial valve and subsequently reducing the amplitude and height of the pressure pulses is shown. For purposes of clarity and further explanation, method 540 will be described with respect to the operation of valve 1100 described above and shown in FIGS. 32-34.

Valve 1100 is deployed with actuator 1130 in the deactivated position with shear pin 1140 intact and maintaining actuator 1130 in the deactivated position. During drilling operations, valve 1100 operates in substantially the same manner as valve 200" previously described with the exception that actuator 1130 can be transitioned to the activated position to decrease the amplitude or height of each pressure pulse generated by valve 1100. Accordingly, method 540 includes blocks 341-345 as previously described. For example, in block 341, drilling fluid is pumped down drillstring 22 to power section 100. In block 342, a portion of the drilling fluid flows axially through passage 1133 of body 1120, and a portion of the drilling fluid flows into annulus 1128 and then radially through port 1124 into passage 1133. More specifically, at least initially, no plugs 230 are disposed in seats 1136*a*, 1136*b*, and thus, a portion of the drilling fluid flows through passage 1133 and reduced inner radius section 1132*b*, and a portion of the drilling fluid flows into annulus 1128 and then radially inward through port 1124.

Next, in block 343, the drilling fluid flowing into and through passage 1133 of body 1120 (via section 1132*b* and port 1124) drives the rotation of body 1120 relative to housing 210. In particular, the drilling fluid flowing into and through passage 1133 (via section 1132*b* and port 1124) flows downstream into rotor 110 of first stage 101 and drives the rotation of rotors 110 of stages 101, 102 as previously described. Body 1120 is fixably coupled to rotors 110 and actuator 1130 is fixably coupled to body 1120 via shear pin 1140, and thus, body 1120 and actuator 1130 disposed therein rotate with rotors 110 relative to housing 210.

Moving now to block 344, rotation of body 1120 relative to housing 210 generates pressure pulses in the drilling fluid upstream of the valve 1100. In particular, rotation of body 1120 results in the cyclically opening and closing of port 1124 with lug 213 as previously described. The cyclical opening and closing of port 1124 generates pressure pulses in the drilling fluid upstream of valve 1100. In this manner, the rotation of rotors 110 drive the rotation of body 1120 relative to housing 210, which in turn generates cyclical pressure pulses in the drilling fluid that drive the axial reciprocation of shock tool 92. As previously described, the diameter of section 1132*b* determines the relative amounts of drilling fluid that pass through section 1132*b* and annulus 1128. Without being limited by this or any particular theory, the greater the relative amount of drilling fluid that passes into annulus 1128 (and less relative amount of drilling fluid that passes through section 1132*b*), the greater the amplitude or height of each pressure pulse generated by valve 1100.

Similar to valve 200", plug seat 1136*a* and the corresponding lower plug 230 enables the selective ability to increase the amplitude and pulse height of the pressure pulses generated by valve 1100 downhole without retrieving valve 1100. In particular, to increase the amplitude and pulse height of the pressure pulses generated by valve 1100 when desired, lower plug 230 is dropped from the surface and seats in lower seat 1136*a* according to block 345. As a result, flow from receptacle 1132*a* into section 1132*b* is restricted and the relative quantity of drilling fluid directed from receptacle 1132*a* into annulus 1128 via aligned outlet ports 1125, 1134 is increased. It should also be appreciated that any drilling fluid passing between enlarged head 1121*d* of body 1120 and housing 210 also flows into annulus 1128 and then through port 1124. Thus, the seating of lower plug 230 against seat 1136*a* increases the relative quantity of drilling fluid directed into annulus 1128 and port 1124, which increases in the amplitude or height of each pressure pulse generated by valve 1100.

Typically, actuator 1130 remains in the deactivated position, and thus, all the drilling fluid directed into annulus 1128 flows through port 1124 to generate pressure pulses in the same manner as valve 200" previously described. However, in this embodiment, actuator 1130 can be selectively transitioned to the activated position to decrease the amplitude and pulse height of the pressure pulses generated by valve 1100. Accordingly, method 540 includes an additional block 546 at which actuator 1130 is transitioned to the activated position to decrease the amplitude and pulse height of the pressure pulses generated by valve 1100. In particular, when it is desirable to decrease the amplitude and pulse height of the pressure pulses generated by valve 1100, upper plug 230 is dropped from the surface and seats in upper seat 1136*b*. As a result, flow into receptacle 1132*a* at upper end 1130*a* is restricted at seat 1136*b*. As previously described, enlarged head 1121*d* restricts the flow of drilling fluid between housing 210 and head 1121*d*, and thus, fluid pressure within housing 210 upstream of valve 1100 increases until the pressure differential across actuator 1130 is sufficient to shear or break pin 1140. Once pin 1140 is sheared, the pressure differential across actuator 1130 transitions actuator 1130 from the deactivated position (FIG. 32) to the activated position (FIG. 34). In the activated position, upper plug 230 seated against upper seat 1136*b* is axially positioned below outlet ports 1125, thereby allowing flow of drilling fluid around upper plug 230 and enlarged head 1121*d* through outlet ports 1125. As previously described, in the activated position (FIG. 34), passage 1133 and annulus 1128 are in fluid communication via bypass ports 1126, 1135, thereby allowing drilling fluid to flow between annulus 1128 and passage 1133. Drilling fluid that flows through ports 1126, 1135 from annulus 1128 into passage 1133 of actuator 1130 does not flow through port 1124, thereby bypassing port 1124 and decreasing the relative quantity of drilling fluid directed through port 1124, which decreases the amplitude or height of each pressure pulse generated by valve 1100.

Figure 38:
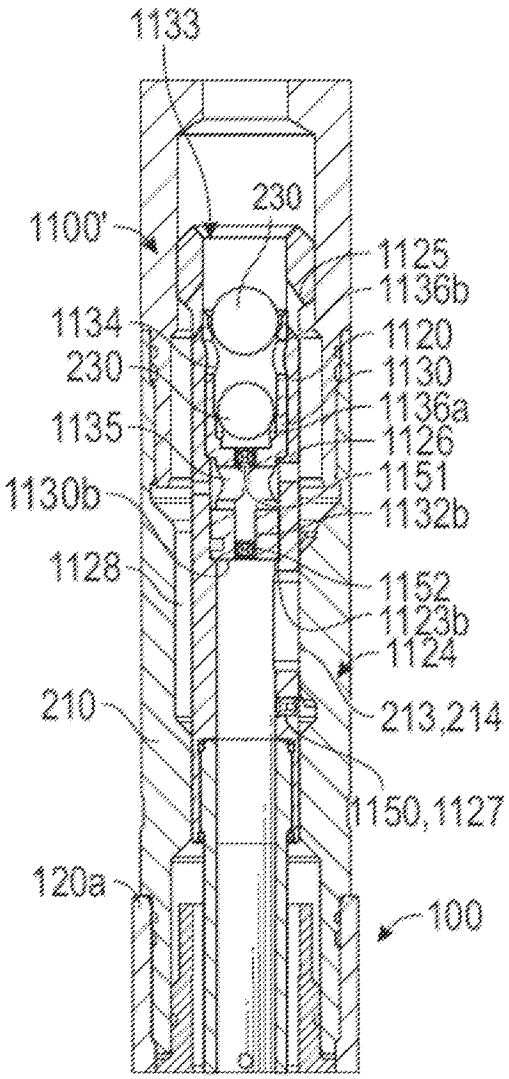
Figure 37:
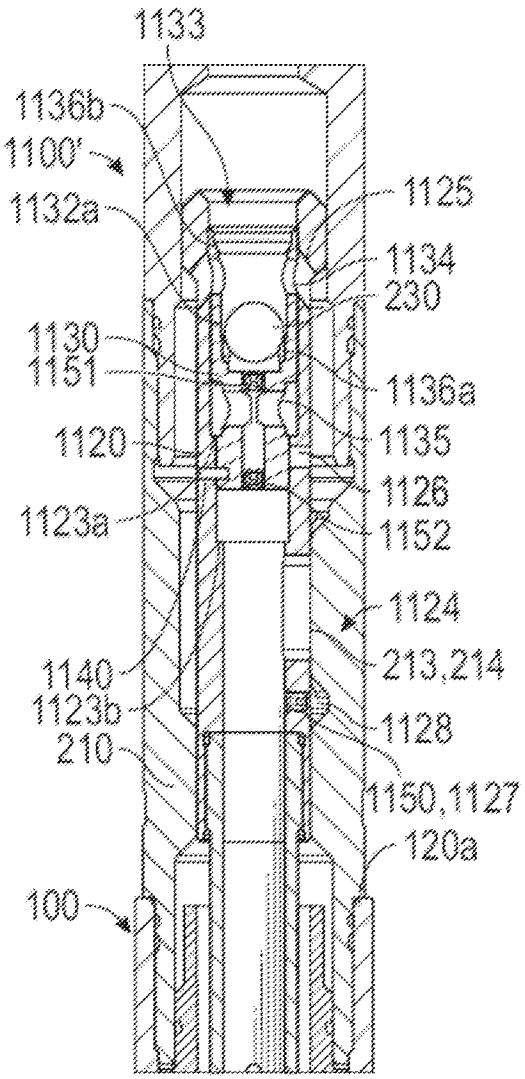
Figure 36:
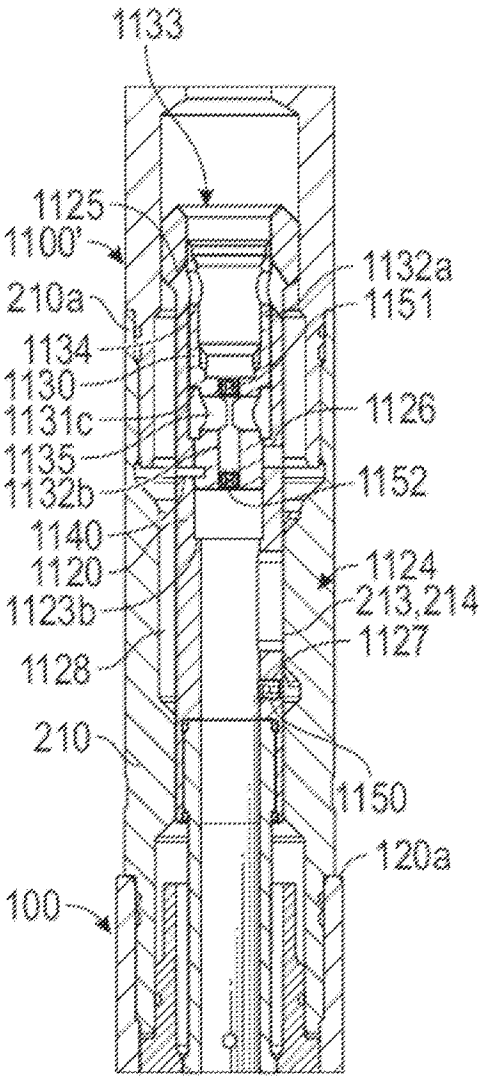

In the embodiment of top mount, oscillating or rotating radial valve 1100 shown in FIGS. 32-34 and described above, deployment of lower plug 230 can be used to selectively increase the amplitude and pulse height of the pressure pulses generated by valve 1100, and then the subsequent deployment of upper plug 230 can be used to selectively decrease the amplitude and pulse height of the pressure pulses generated by valve 1100. Thus, in that embodiment, valve 1100 allows for the selective increase and then decrease in the amplitude and pulse height of the pressure pulses generated by valve 1100. However, in some drilling operations, it may be desirable to tailor or adjust the change in the amplitude and pulse height of the pressure pulses upon deployment of the lower plug 230 and then upon deployment of upper plug 230. FIGS. 36-38 illustrates a power section 100 as previously described and a top mount, oscillating or rotating radial valve 1100' that allows for adjustment of the selective change in the amplitude and pulse height of the pressure pulses generated by valve 1100' via deployment of a lower plug 230 and then an upper plug 230.

Referring now to FIGS. 36-38, valve 1100' is the same as valve 1100 previously described and shown in FIGS. 32-34 with the exception that valve 1100' includes a plurality of nozzles 1150, 1151, 1152 that can be adjusted (e.g., by removal and replacement) to generate pressure pulses having different and distinct amplitudes and pulse heights at each of three sequential stages: (1) prior to deployment of plugs 230 (no plugs 230 disposed in stepped receptacle 1121*a*) (FIG. 36); (2) after deployment of lower plug 230 (lower plug 230 seated against seat 1136*a* but no plug 230 seated against seat 1136*b*) (FIG. 37); and (3) after deployment of both lower plug 230 and upper plug 230 (lower plug 230 seated against seat 1136*a* and upper plug 230 seated against seat 1136*b*) and transition of body 1120 to the activated position (FIG. 38). More specifically, nozzle 1150 is removably threaded into a bore 1127 extending radially through body 1120 axially below shoulder 1123*b* and offset (axially and/or circumferentially) from lug 213 and corresponding surface 214. Nozzle 1151 is removably threaded into the upper end of section 1132*b* and axially positioned between receptacle 1132*a* and ports 1135. Nozzle 1152 is removably threaded into the lower end of section 1132*b* at end 1130*b* and axially positioned below ports 1135.

Prior to deployment of plugs 230 as shown in FIG. 36 (stage one), drilling fluid flows through receptacle 1132*a*, nozzle 1151, section 1132*b*, and nozzle 1152 into passage 1123, and drilling fluid flows from receptacle 1132*a* through aligned outlet ports 1125, 1134, annulus 1128, and both port 1124 and nozzle 1150 into passage 1123. Thus, in stage one, the drilling fluid flows through all three nozzles 1150, 1151, 1152. After deployment of lower plug 230 as shown in FIG. 37 (stage two), drilling fluid flows from receptacle 1132*a* through aligned ports 1125, 1134, annulus 1128, and both port 1124 and nozzle 1150 into passage 1123. Thus, in stage two, drilling fluid flows through nozzle 1150 but does not flow through nozzles 1151, 1152. After deployment of both plugs 230 and transition of body 1120 to the activated position as shown in FIG. 38 (stage three), drilling fluid flows from receptacle 1132*a* through port 1125, annulus 1128, aligned ports 1126, 1135, section 1132*b*, and nozzle 1152 into passage 1132, and drilling fluid flows from receptacle 1132*a* through port 1125, annulus 1128, and both port 1124 and nozzle 1150 into passage 1132. Thus, in stage three (FIG. 38), drilling fluid flows through nozzles 1150, 1152 but does not flow through nozzle 1151. In general, the drilling fluid that flows through any nozzle 1150, 1151, 1152 during any of the stages bypasses port 1124.

In general, the size of the orifices in each nozzle 1150, 1151, 1152 influences the amount of drilling fluid that flows therethrough. As previously described, the drilling fluid flowing through any of the nozzles 1150, 1151, 1152 bypasses port 1124. In addition, as previously described, in stage one (FIG. 36), drilling fluid flows through nozzles 1150 and 1151 (before flowing through nozzle 1152); in stage two (FIG. 37), drilling fluid flows through nozzle 1150; and in stage three (FIG. 38), drilling fluid flows through nozzles 1150, 1152. Thus, in stages one, two, and three, a smaller orifice in nozzle 1150 results in more drilling fluid flowing through port 1124 and a larger orifice in nozzle 1150 results in less drilling fluid flowing through port 1124; in stage one, a smaller orifice in nozzle 1151 results in more drilling fluid flowing through port 1124 and a larger orifice in nozzle 1151 results in less drilling fluid flowing through port 1124; and in stage two, a smaller orifice in nozzle 1152 results in more drilling fluid flowing through port 1124 and a larger orifice in nozzle 1152 results in less drilling fluid flowing through port 1124. Thus, different nozzles 1150, 1151, 1152 having different sized orifices can be used to alter the relative quantity of drilling fluid flowing through port 1124 versus bypassing port 1124 in each stage one, two, and three, which in turn affects the amplitude of each pressure pulse generated by valve 1100' in each stage one, two, and three.

Valve 1100' generally operates in the same manner as valve 1100 previously described and shown in FIG. 35. In particular, valve 1100' is deployed with actuator 1130 in the deactivated position with shear pin 1140 intact and maintaining actuator 1130 in the deactivated position (stage one). At least initially, no plugs 230 are disposed in seats 1136*a*, 1136*b*, and thus, a portion of the drilling fluid flows through passage 1133 and reduced inner radius section 1132*b*, and a portion of the drilling fluid flows into annulus 1128 and then radially inward through port 1124. Nozzles 1150, 1151 generally control the amplitude and pulse height of pressure pulses during stage one. When it is desirable to change the amplitude and pulse height of the pressure pulses generated by valve 1100', lower plug 230 is dropped from the surface and seats in lower seat 1136*a* (stage two). Nozzle 1150 generally controls the amplitude and pulse height of pressure pulses during stage two. When yet a further change in the amplitude and pulse height of the pressure pulses generated by valve 1100' is desired, upper plug 230 is dropped from the surface and seats in upper seat 1136*b*, thereby transitioning actuator 1130 to the activated position (stage three). Nozzles 1150, 1152 generally control the amplitude and pulse height of pressure pulses during stage three. For some drilling operations, nozzles 1150, 1151, 1152 are selected (e.g., the sizes of the orifices of nozzles 1150, 1151, 1152 are selected) such that the sequence of pressure pulse amplitudes are as follows: in stage one (FIG. 36), the pressure pulses have medium amplitudes and pulse heights while running into the borehole and during the early parts of drilling operations; in stage two (FIG. 37), the pressure pulses have large amplitudes and pulse heights when maximum axial oscillation of shock tool 92 is desired during the later stages of drilling; and in stage three (FIG. 38), the pressure pulses have small amplitudes and pulse heights when tripping out of the borehole. In such operations, the amplitudes of the pressure pulses in stage two are greater than the amplitudes of the pressure pulses in stage one, and the amplitudes of the pressure pulses in stage one are greater than the amplitudes of the pressure pulses in stage three. This approach offers the potential to induce high amplitude pressure pulses only when needed, thereby saving the drillstring 22 from unnecessary high amplitude cycles during other stages of drilling and reducing the overall fatigue experienced by the drillstring 22 during drilling operations.

In embodiments described herein, the oscillating or rotary valves (e.g., valves 200, 200', 200", 300, 400, 400', 400", 600, 1000, 1100, 1100') are generally shown and described as being disposed below a shock tool (e.g., shock tool 92) in the same string, and thus, generate pressure pulses that travel uphole to the shock tool and actuate the shock tool. However, in other embodiments, the valves may be positioned above the shock tool such that pressure pulses generated by the valve travel downhole to the shock tool and actuate the shock tool. Such embodiments may provide benefits to excitation depending on the particular application.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A system for generating pressure pulses in drilling fluid, the system comprising:

a concentric drive power section configured to rotate a drill bit, wherein the concentric drive power section includes a stator and a rotor rotatably disposed in the stator, wherein the rotor is coaxially aligned with the stator, and wherein the rotor includes a throughbore configured to pass drilling fluid to the drill bit;

a valve including a first valve member coupled to the stator and a second valve member coupled to the rotor, wherein the second valve member is configured to rotate with the rotor relative to the first valve member and the stator, and wherein the rotation of the second valve member relative to the first valve member is configured to generate pressure pulses in drilling fluid flowing through the concentric drive power section, wherein the second valve member has a central axis, an upper end, a lower end, a radially outer surface extending axially from the upper end of the second valve member to the lower end of the second valve member, and a radially inner surface extending axially from the upper end of the second valve member to the lower end of the second valve member;

wherein the radially inner surface of the second valve member defines a passage extending axially from the upper end of the second valve member to the lower end of the second valve member;

wherein the second valve member includes an inlet port extending radially from the radially outer surface of the second valve member to the passage of the second valve member;

wherein the first valve member has a central axis, an upper end, a lower end, and a radially inner surface extending axially from the upper end of the first valve member to the lower end of the second valve member;

wherein the radially inner surface of the first valve member includes a cylindrical surface radially spaced from the radially outer surface of the second valve member and a lug extending radially inward from the cylindrical surface, wherein the lug slidingly engages the radially outer surface of the second valve member;

wherein the lug is configured to open and close the inlet port of the second valve member.

2. The system of claim 1, wherein the first valve member is coupled to an upper end of the stator and the second valve member is coupled to an upper end of the rotor.

3. The system of claim 1, further comprising a nozzle mounted to the upper end of the second valve member and configured to restrict the flow of fluids into the passage of the second valve member at the upper end.

4. The system of claim 3, further comprising a plug seat coupled to the upper end of the second valve member, wherein the plug seat is configured to receive a plug that blocks the flow of fluid into the passage of the second valve member at the upper end.

5. The system of claim 1, wherein the passage of the second valve member is coaxially aligned with the throughbore of the rotor, and wherein the passage of the second valve member has a diameter that is within 10% of the diameter of the throughbore of the rotor or greater than the diameter of the throughbore of the rotor.

6. The system of claim 5, further comprising a plug seat disposed along the passage of the second valve member, wherein the plug seat is configured to receive a plug that blocks the flow of fluid into the passage of the second valve member at the upper end.

7. The system of claim 6, wherein the plug comprises a dart having an upper end comprising a fishing-neck.

8. The system of claim 1, wherein the first valve member is coupled to a lower end of the stator and the second valve member is coupled to a lower end of the rotor.

9. The system of claim 8, wherein the upper end of the second valve member is coupled to a lower end of the rotor;

wherein the passage of the second valve member includes a first portion extending axially from the upper end of the second valve member, a second portion extending axially from the lower end of the second valve member, and an outlet port extending radially from the first portion of the passage of the second member to the radially outer surface of the second valve member;

wherein inlet port of the second valve member extends radially from the radially outer surface of the second valve member to the second portion of the passage of the second valve member;

wherein the upper end of the first valve member is coupled to a lower end of the stator.

10. The system of claim 9, wherein passage of the second valve member includes a throughbore extending axially from the first portion of the passage to the second portion of the passage.

11. The system of claim 10, further comprising a first plug seat positioned along the first portion of the passage and configured to receive a first plug that blocks the flow of fluids axially through the throughbore of the passage of the second valve member.

12. The system of claim 11, further comprising a second plug seat positioned along a throughbore of the rotor, wherein the second plug seat divides the throughbore of the rotor into an upper region axially positioned above the second plug seat and a lower region axially positioned below the second plug seat;

wherein the second plug seat is configured to receive a second plug that blocks the axial flow of fluids from upper region of the throughbore of the rotor to the lower region of the throughbore of the rotor.

13. The system of claim 12, wherein the second plug comprises a dart having an upper end comprising a fishing-neck, and wherein the first plug is coupled to the dart with a connection member extending from the dart to the first plug.

14. The system of claim 1, wherein the second valve member includes a first plug seat disposed along the inner surface of the second valve member, wherein the first plug seat is axially positioned between the inlet port of the second valve member and the upper end of the second valve member, wherein the first plug seat is configured to receive a first plug that restricts the flow of fluid into the passage of the second valve member through the upper end of the second valve member.

15. The system of claim 14, wherein the second valve member includes a first bypass slot extending axially along the inner surface from the first plug seat, wherein the first bypass slot is configured to allow the flow of fluid around the first plug.

16. The system of claim 15, wherein the second valve member includes a second plug seat disposed along the inner surface of the second valve member, wherein the second plug seat is axially positioned between the first plug seat of the second valve member and the upper end of the second valve member, wherein the second plug seat is configured to receive a second plug that restricts the flow of fluid into the passage of the second valve member through the upper end of the second valve member.

17. The system of claim 16, wherein the second valve member includes a second bypass slot extending axially along the inner surface from the second plug seat, wherein the second bypass slot is configured to allow the flow of fluid around the second plug.

18. The system of claim 17, further comprising a nozzle disposed in the passage of the second valve member, wherein the nozzle is axially positioned between the first plug seat and the lower end of the second valve member, wherein the nozzle is configured to restrict the flow of fluids through the passage of the second valve member.

19. The system of claim 14, further comprising a pressure relief valve disposed in the passage of the second valve member, wherein the pressure relief valve is axially positioned between the first plug seat and the inlet port of the second valve member;

wherein the second valve member includes a bypass port extending radially from the outer surface of the second valve member to the passage of the second valve member, wherein the bypass port of the second valve member is axially positioned between the first plug seat and the inlet port;

wherein the pressure relief valve has a closed position preventing the flow of fluid from the bypass port into the passage of the second valve member and an open position allowing the flow of fluid from the bypass port into the passage of the second valve member.

20. The system of claim 1, further comprising an actuator slidingly disposed in the second valve member;

wherein the second valve member includes:

an outlet port extending radially from the outer surface of the second valve member to the passage of the second valve member; and a bypass port extending radially from the outer surface of the second valve member to the passage of the second valve member;

wherein the bypass port is axially positioned between the outlet port and the inlet port;

wherein the actuator has an upper end, a lower end, a radially outer surface extending axially from the upper end of the actuator to the lower end of the actuator, and a radially inner surface extending axially from the upper end of the actuator to the lower end of the actuator, wherein the radially inner surface of the actuator defines a passage extending axially from the upper end of the actuator to the lower end of the actuator;

wherein the actuator includes an outlet port extending radially from the outer surface of the actuator to the passage of the actuator and a bypass port extending radially from the outer surface of the actuator to the passage of the actuator;

wherein the actuator has a deactivated position with the outlet port of the actuator aligned with the outlet port of the second valve member and the bypass port of the actuator misaligned with the bypass port of the second valve member, and wherein the actuator has an activated position with the bypass port of the actuator aligned with the bypass port of the second valve member;

wherein the actuator is configured to transition from the deactivated position to the activated position in response to a pressure differential across the actuator.

21. The system of claim 20, wherein the second valve member includes a first plug seat and a second plug seat disposed along the inner surface of the second valve member, wherein the first plug seat is axially positioned between the inlet port of the second valve member and the upper end of the second valve member, wherein the second plug seat is axially positioned between the first plug seat of the second valve member and the upper end of the second valve member;

wherein the first plug seat is configured to receive a first plug that prevents the flow of fluid into the passage of the second valve member through the upper end of the second valve member, and wherein the second plug seat is configured to receive a second plug that prevents the flow of fluid into the passage of the second valve member through the upper end of the second valve member;

wherein the bypass port of the actuator is axially positioned below the first plug seat and the second plug seat.

22. The system of claim 21, wherein a shear pin fixably couples the second valve member to the actuator with the actuator in the deactivated position.

23. A system for generating pressure pulses in drilling fluid, the system comprising:

a concentric drive power section configured to rotate a drill bit, wherein the concentric drive power section includes a stator and a rotor rotatably disposed in the stator, wherein the rotor is coaxially aligned with the stator, and wherein the rotor includes a throughbore configured to pass drilling fluid to the drill bit;

a valve including a first valve member coupled to the stator and a second valve member coupled to the rotor, wherein the second valve member is configured to rotate with the rotor relative to the first valve member and the stator, and wherein the rotation of the second valve member relative to the first valve member is configured to generate pressure pulses in drilling fluid flowing through the concentric drive power section;

wherein the valve is an axial valve configured to cyclically block the axial flow of fluids;

wherein the first valve member has a central axis, a first end, a second end, and a throughbore extending axially from the first end of the first valve member to the second end of the first valve member;

wherein the first valve member includes an annular valve plate disposed at the second end of the first valve member and a sleeve extending axially from the annular valve plate to the first end of the first valve member, wherein the valve plate extends radially outward from the sleeve;

wherein the sleeve includes a port extending radially from an outer surface of the sleeve to the throughbore of the first valve member;

wherein the annular valve plate includes a port extending axially therethrough;

wherein the second valve member has a central axis, a first end, and a second end;

wherein the second valve member includes a valve plate disposed at the first end of the second valve member, wherein the valve plate of the second valve member includes a port extending axially therethrough;

wherein the valve plate of the second valve member is configured to open and close the port in the annular valve plate of the first valve member.

24. A system for generating pressure pulses in drilling fluid, the system comprising:

a concentric drive power section including a central axis, a stator, and a rotor rotatably disposed in the stator, wherein the rotor and the stator are coaxially aligned with the central axis, and wherein the rotor includes a throughbore, a fluid inlet port extending radially from the throughbore to a radially outer surface of the rotor, and a fluid outlet port extending radially from the throughbore to the radially outer surface of the rotor, wherein the fluid inlet port is axially spaced from the fluid outlet port;

a valve including an outer housing and a body rotatably disposed in the outer housing, wherein the outer housing is coupled to an upper end of the stator and the body is coupled to an upper end of the rotor;

wherein the body has an upper end, a lower end, a passage extending axially from the upper end to the lower end, and a port extending radially from the passage to a radially outer surface of the body;

an annulus radially positioned between the outer housing and the body;

wherein the body is configured to rotate with the rotor about the central axis relative to the outer housing and the stator, and wherein the body has a first rotational position with the annulus and the passage in fluid communication through the port and a second rotational position with fluid communication through the port between the annulus and the passage blocked.

25. The system of claim 24, further comprising a nozzle removably coupled to the upper end of the body and configured to regulate the flow of fluids into the passage at the upper end of the body and the annulus.

26. The system of claim 24, further comprising a first plug seat coupled to an upper end of the body and configured to receive a first plug that blocks the axial flow of fluids into the passage at the upper end of the body.

27. The system of claim 26, further comprising a second plug seat disposed in the throughbore of the rotor and axially positioned between the fluid inlet port and the fluid outlet port, wherein the second plug seat is configured to receive a second plug that blocks the axial flow of fluids from a first region of the throughbore of the rotor axially positioned above the second plug seat to a second region of the throughbore of the rotor axially positioned below the second plug seat.

28. The system of claim 27, wherein the first plug is a dart coupled to the second plug with a connection member, wherein the dart is configured to be fished from the first plug seat.

29. A method for generating pressure pulses in drilling fluid to operate a downhole shock tool, the method comprising:

(a) flowing drilling fluid down a drillstring to a concentric rotary drive power section, wherein the concentric rotary drive power section includes a rotor rotatably disposed in a stator, wherein the rotor and the stator are coaxially aligned with a central axis of the concentric rotary drive power section;

(b) selectively directing at least a portion of the drilling fluid into an annulus radially positioned between the rotor and the stator to drive the rotation of the rotor about the central axis relative to the stator;

(c) rotating a first valve member with the rotor relative to a second valve member in response to (b);

(d) selectively directing at least a portion of the drilling fluid through a port of the first valve member;

(e) cyclically opening and closing the port of the first valve member with the second valve member to cyclically block the flow of drilling fluid through the port;

(f) generating pressure pulses in the drilling fluid during (e).

30. The method of claim 29, wherein (d) comprises:

(d1) flowing the drilling fluid through a passage of the first valve member to bypass the port; and (d2) dropping a first plug into a first plug seat of the first valve member to direct the drilling fluid through the port.

31. The method of claim 30, wherein (b) comprises:

(b1) flowing the drilling fluid through a throughbore of the rotor to bypass the annulus;

(b2) dropping a second plug into a second plug seat disposed along the throughbore of the rotor to direct the drilling fluid into the annulus;

(b3) rotating the rotor relative to the stator in response to (b2).

32. The method of claim 31, further comprising:

(g) pulling the first plug from the first plug seat;

(h) pulling the second plug from the second plug seat in response to (g).

33. The method of claim 31, further comprising:

(g) pulling the second plug from the second plug seat;

(h) pulling the first plug from the first plug seat in response to (g).

34. The method of claim 29, wherein (d) comprises selectively flowing at least the portion of the drilling fluid radially through the port of the first valve member.

35. The method of claim 29, wherein (d) comprises selectively flowing at least the portion of the drilling fluid axially through the port of the first valve member.

36. The method of claim 29, further comprising:

moving the second valve member axially into engagement with the first valve member after (d) and before (e).

37. The method of claim 36, further comprising:

moving the second valve member axially away from the first valve member after (f) to cease the generation of pressure pulses.

38. The method of claim 29, further comprising dropping a plug into a plug seat disposed along the throughbore of the rotor to change a frequency of the pressure pulses generated in the drilling fluid during (e).

39. A method for adjusting pressure pulses in drilling fluid to operate a downhole shock tool, the method comprising:

(a) flowing drilling fluid down a drillstring to a concentric rotary drive power section, wherein the concentric rotary drive power section includes a rotor rotatably disposed in a stator, wherein the rotor and the stator are coaxially aligned with a central axis of the concentric rotary drive power section;

(b) driving the rotation of the rotor relative to the stator with the drilling fluid;

(c) flowing the drilling fluid through a rotary valve during (a), wherein the rotary valve includes a first valve member fixably coupled to the rotor of the concentric rotary drive power section and a second valve member fixably coupled to the stator of the concentric rotary drive power section;

(d) rotating the first valve member relative to the second valve member in response to (b);

(e) generating pressure pulses in the drilling fluid in the drillstring with the rotary valve during (d), wherein the pressure pulses have an amplitude;

(f) dropping a first plug down the drillstring and seating the plug in the first valve member of the rotary valve; and (g) changing the amplitude of the pressure pulses generated by the rotary valve in response to (f).

40. The method of claim 39, further comprising:

(h) dropping a second plug down the drillstring and seating the plug in the first valve member of the rotary valve after (f) and (g); and (i) changing the amplitude of the pressure pulses generated by the rotary valve in response to (h).

41. The method of claim 40, wherein the first plug is a ball and the second plug is a ball.

42. The method of claim 40, further comprising:

(j) opening a relief valve of the rotary valve at a predetermined pressure differential across the relief valve after (i) to limit the amplitude of the pressure pulses generated by the rotary valve.

43. The method of claim 39, further comprising:

(h) dropping a second plug down the drillstring and seating the plug in the first valve member of the rotary valve after (f) and (g); and (i) decreasing the amplitude of the pressure pulses generated by the rotary valve in response to (h).

44. The method of claim 39, further comprising:

(h) dropping a second plug down the drillstring and seating the second plug along a throughbore of the rotor after (f) and (g); and (i) changing the frequency of the pressure pulses generated by the rotary valve in response to (h).

45. The method of claim 39, further comprising:

(h) changing a rotational speed of the rotor relative to the stator;

(i) changing the frequency of the pressure pulses generated by the rotary valve in response to (h).

46. The method of claim 45, further comprising:

actuating a bypass valve disposed in a throughbore of the rotor to change the rotational speed of the rotor in (h).

47. The method of claim 46, wherein actuating the bypass valve comprises opening the bypass valve at a predetermined pressure differential across the bypass valve;

wherein (h) comprises decreasing the rotational speed of the rotor relative to the stator in response to opening the bypass valve; and wherein (i) comprises decreasing the frequency of the pressure pulses generated by the rotary valve in response to (h).

* * * * *